US010954588B2

(12) United States Patent
Cheney et al.

(10) Patent No.: US 10,954,588 B2
(45) Date of Patent: Mar. 23, 2021

(54) OXIDATION CONTROLLED TWIN WIRE ARC SPRAY MATERIALS

(71) Applicant: Scoperta, Inc., San Diego, CA (US)

(72) Inventors: Justin Lee Cheney, Encinitas, CA (US); David Jiang, San Diego, CA (US)

(73) Assignee: Oerlikon Metco (US) Inc., Westbury, NY (US)

( * ) Notice: Subject to any disclaimer, the term of this patent is extended or adjusted under 35 U.S.C. 154(b) by 385 days.

(21) Appl. No.: 15/347,516

(22) Filed: Nov. 9, 2016

(65) Prior Publication Data

US 2017/0130311 A1 May 11, 2017

Related U.S. Application Data

(60) Provisional application No. 62/253,622, filed on Nov. 10, 2015, provisional application No. 62/406,573, filed on Oct. 11, 2016.

(51) Int. Cl.

| | |
|---|---|
| ***C23C 4/08*** | (2016.01) |
| ***C23C 8/20*** | (2006.01) |
| ***C23C 8/30*** | (2006.01) |
| ***C23C 8/24*** | (2006.01) |
| ***C22C 38/18*** | (2006.01) |
| ***C23C 30/00*** | (2006.01) |
| ***C23C 4/18*** | (2006.01) |
| ***C23C 8/02*** | (2006.01) |

(Continued)

(52) U.S. Cl.

CPC ..... *C23C 4/08* (2013.01); *C22C 38/02* (2013.01); *C22C 38/04* (2013.01); *C22C 38/06* (2013.01); *C22C 38/18* (2013.01); *C22C 38/40* (2013.01); *C23C 4/131* (2016.01); *C23C 4/18* (2013.01); *C23C 8/02* (2013.01); *C23C 8/20* (2013.01); *C23C 8/24* (2013.01); *C23C 8/30* (2013.01); *C23C 30/00* (2013.01)

(58) Field of Classification Search

CPC ..... C23C 4/131; C23C 4/08; B23K 26/3066; B23K 35/0261; B23K 35/0283

See application file for complete search history.

(56) References Cited

U.S. PATENT DOCUMENTS

| | | | |
|---|---|---|---|
| 2,043,952 | A | 6/1936 | Ffield |
| 2,156,306 | A | 5/1939 | Rapatz |

(Continued)

FOREIGN PATENT DOCUMENTS

| | | | |
|---|---|---|---|
| CN | 102233490 | A | 11/2011 |
| CN | 102357750 | A | 2/2012 |

(Continued)

OTHER PUBLICATIONS

Machine translation of DE-4411296-A1, Sep. 2019.*

(Continued)

*Primary Examiner* — Geoffrey S Evans

(74) *Attorney, Agent, or Firm* — Knobbe, Martens, Olson & Bear, LLP

(57) ABSTRACT

Disclosed herein are embodiments of alloys which can be particularly advantageous in twin wire arc spray methods for coating of a substrate. In some embodiments, a plurality of alloys can be used to form both hard and soft particles on a surface. In some embodiments, chromium can be minimized or eliminated.

15 Claims, 7 Drawing Sheets

(51) Int. Cl.

| | |
|---|---|
| ***C23C 4/131*** | (2016.01) |
| ***C22C 38/02*** | (2006.01) |
| ***C22C 38/04*** | (2006.01) |
| ***C22C 38/06*** | (2006.01) |
| ***C22C 38/40*** | (2006.01) |

(56) References Cited

U.S. PATENT DOCUMENTS 2,608,495 A 8/1952 Barry
2,873,187 A 2/1959 Dyrkaez et al.
2,936,229 A 5/1960 Shepard
3,024,137 A 3/1962 Witherell
3,113,021 A 12/1963 Witherell
3,181,970 A 5/1965 Witherell et al.
3,303,063 A 2/1967 Pietryka et al.
3,448,241 A 6/1969 Buckingham et al.
3,554,792 A 1/1971 Johnson
3,650,734 A 3/1972 Kantor et al.
3,843,359 A 10/1974 Fiene et al.
3,859,060 A 1/1975 Eiselstein et al.
3,942,954 A 3/1976 Frehn
3,975,612 A 8/1976 Nakazaki et al.
4,010,309 A 3/1977 Peterson
4,017,339 A 4/1977 Okuda et al.
4,042,383 A 8/1977 Petersen et al.
4,066,451 A 1/1978 Rudy
4,214,145 A 7/1980 Zvanut et al.
4,235,630 A 11/1980 Babu
4,255,709 A 3/1981 Zatsepium et al.
4,277,108 A 7/1981 Wallace
4,297,135 A 10/1981 Giessen et al.
4,365,994 A 12/1982 Ray
4,415,530 A 11/1983 Hunt
4,419,130 A 12/1983 Slaughter
4,576,653 A 3/1986 Ray
4,596,282 A 6/1986 Maddy et al.
4,606,977 A 8/1986 Dickson et al.
4,635,701 A 1/1987 Sare et al.
4,639,576 A 1/1987 Shoemaker et al.
4,666,797 A 5/1987 Newman et al.
4,673,550 A 6/1987 Dallaire et al.
4,762,681 A 8/1988 Tassen et al.
4,803,045 A 2/1989 Ohriner et al.
4,822,415 A 4/1989 Dorfman et al.
4,919,728 A 4/1990 Kohl et al.
4,981,644 A 1/1991 Chang
5,094,812 A 3/1992 Dulmaine et al.
5,252,149 A 10/1993 Dolman
5,306,358 A 4/1994 Lai et al.
5,375,759 A 12/1994 Hiraishi et al.
5,567,251 A 10/1996 Peker et al.
5,570,636 A 11/1996 Lewis
5,618,451 A 4/1997 Ni
5,820,939 A 10/1998 Popoola et al.
5,858,558 A 1/1999 Zhao et al.
5,861,605 A 1/1999 Ogawa et al.
5,907,017 A 5/1999 Ober et al.
5,935,350 A 8/1999 Raghu et al.
5,942,289 A 8/1999 Jackson
5,988,302 A 11/1999 Sreshta et al.
6,117,493 A 9/2000 North
6,171,222 B1 1/2001 Lakeland et al.
6,210,635 B1 4/2001 Jackson et al.
6,232,000 B1 5/2001 Singh et al.
6,326,582 B1 12/2001 North
6,331,688 B1 12/2001 Hallén et al.
6,332,936 B1 12/2001 Hajaligo et al.
6,375,895 B1 4/2002 Daemen
6,398,103 B2 6/2002 Hasz et al.
6,441,334 B1 8/2002 Aida et al.
6,582,126 B2 6/2003 North
6,608,286 B2 8/2003 Jiang
6,669,790 B1 12/2003 Gundlach et al.
6,689,234 B2 2/2004 Branagan
6,702,905 B1 3/2004 Qiao et al.
6,702,906 B2 3/2004 Ogawa et al.
6,750,430 B2 6/2004 Kelly
7,052,561 B2 5/2006 Lu et al.
7,219,727 B2 5/2007 Slack et al.
7,285,151 B2 10/2007 Sjodin et al.
7,361,411 B2 4/2008 Daemen et al.
7,491,910 B2 2/2009 Kapoor et al.
7,553,382 B2 6/2009 Branagan et al.
7,569,286 B2 8/2009 Daemen et al.
7,776,451 B2 8/2010 Jiang et al.
7,935,198 B2 5/2011 Branagan et al.
8,070,894 B2 12/2011 Branagan
8,097,095 B2 1/2012 Branagan
8,153,935 B2 4/2012 Jang et al.
8,187,529 B2 5/2012 Powell
8,187,725 B2 5/2012 Kiser et al.
8,268,453 B2 9/2012 Dallaire
8,474,541 B2 7/2013 Branagan et al.
8,562,759 B2 10/2013 Cheney et al.
8,562,760 B2 10/2013 Cheney et al.
8,640,941 B2 2/2014 Cheney
8,647,449 B2 2/2014 Cheney et al.
8,658,934 B2 2/2014 Branagan et al.
8,662,143 B1 3/2014 Foster
8,702,835 B2 4/2014 Yu et al.
8,703,046 B2 4/2014 Hanejko et al.
8,704,134 B2 4/2014 Branagan et al.
8,777,090 B2 7/2014 Miller et al.
8,801,872 B2 8/2014 Wright et al.
8,808,471 B2 8/2014 Wright et al.
8,858,675 B2 10/2014 Larsson
8,870,997 B2 10/2014 Klekovkin et al.
8,911,662 B2 12/2014 Larsson
8,920,938 B2 12/2014 Hesse et al.
8,973,806 B2 3/2015 Cheney
8,992,659 B2 3/2015 Larsson et al.
9,051,635 B2 6/2015 Jou
9,095,932 B2 8/2015 Miller et al.
9,145,598 B2 9/2015 Oshchepkov
9,174,293 B2 11/2015 Lee
9,193,011 B2 11/2015 Mars et al.
9,233,419 B2 1/2016 Gries
9,255,309 B2 2/2016 Aimone
9,309,585 B2 4/2016 Cheney et al.
9,314,848 B2 4/2016 Larsson
9,340,855 B2 5/2016 Schade et al.
9,394,591 B2 7/2016 Deodeshmukh et al.
9,399,907 B2 7/2016 Mo et al.
9,469,890 B2 10/2016 Bengtsson
2001/0019781 A1 9/2001 Hasz
2002/0054972 A1 5/2002 Charpentier et al.
2002/0098298 A1* 7/2002 Bolton ..... C23C 24/08 427/596
2002/0148533 A1 10/2002 Kim et al.
2004/0062677 A1 4/2004 Chabenat et al.
2004/0079742 A1 4/2004 Kelly
2004/0115086 A1 6/2004 Chabenat et al.
2004/0206726 A1 10/2004 Daemen et al.
2005/0047952 A1 3/2005 Coleman
2005/0109431 A1 5/2005 Kernan et al.
2006/0063020 A1* 3/2006 Barbezat ..... F16C 33/24 428/570
2006/0093752 A1 5/2006 Darolia et al.
2006/0165552 A1* 7/2006 Kapoor ..... B23K 35/0261 420/70
2006/0191606 A1 8/2006 Ogawa et al.
2006/0260583 A1 11/2006 Abi-Akar et al.
2007/0026159 A1* 2/2007 Deem ..... H01J 37/32477 427/446
2007/0029295 A1 2/2007 Branagan
2007/0090167 A1 4/2007 Arjakine et al.
2007/0187369 A1 8/2007 Menon et al.
2007/0253856 A1 11/2007 Vecchio et al.
2007/0284018 A1 12/2007 Hamano et al.
2008/0001115 A1 1/2008 Qiao et al.
2008/0031769 A1 2/2008 Yeh
2008/0149397 A1 6/2008 Branagan
2008/0241580 A1 10/2008 Kiser et al.
2008/0241584 A1 10/2008 Daemen et al.

(56) References Cited

U.S. PATENT DOCUMENTS

2009/0017328 A1 1/2009 Katoh et al.
2009/0123765 A1 5/2009 Branagan
2009/0258250 A1 10/2009 Daemen et al.
2009/0285715 A1 11/2009 Arjakine et al.
2010/0009089 A1 1/2010 Junod et al.
2010/0028706 A1 2/2010 Hornschu et al.
2010/0044348 A1 2/2010 Buchmann
2010/0055495 A1* 3/2010 Sjodin ..... B23K 35/3053 428/682
2010/0101780 A1 4/2010 Ballew et al.
2010/0136361 A1* 6/2010 Osuki ..... C22C 19/05 428/576
2010/0155236 A1 6/2010 Lee et al.
2010/0166594 A1 7/2010 Hirata et al.
2010/0189588 A1 7/2010 Kawatsu et al.
2010/0258217 A1 10/2010 Kuehmann
2011/0004069 A1 1/2011 Ochs et al.
2011/0064963 A1* 3/2011 Cheney ..... C23C 4/08 428/576
2011/0139761 A1 6/2011 Sugahara et al.
2011/0142713 A1 6/2011 Kawasaki et al.
2011/0162612 A1 7/2011 Qiao et al.
2011/0171485 A1 7/2011 Kawamoto et al.
2011/0220415 A1 9/2011 Jin et al.
2012/0055903 A1 3/2012 Izutani et al.
2012/0103456 A1 5/2012 Smith et al.
2012/0156020 A1 6/2012 Kottilingam et al.
2012/0160363 A1 6/2012 Jin et al.
2012/0288400 A1 11/2012 Hirata et al.
2013/0094900 A1 4/2013 Folkmann et al.
2013/0167965 A1 4/2013 Cheney et al.
2013/0216722 A1* 8/2013 Kusinski ..... C23C 4/08 427/456
2013/0224516 A1 8/2013 Kusinski et al.
2013/0260177 A1 10/2013 Wallin et al.
2013/0266798 A1 10/2013 Cheney
2013/0294962 A1 11/2013 Wallin et al.
2014/0044587 A1 2/2014 Crook et al.
2014/0044617 A1 2/2014 Dreisinger
2014/0060707 A1 3/2014 Wright et al.
2014/0065316 A1 3/2014 Cheney et al.
2014/0066851 A1* 3/2014 Cheney, II ..... H01M 2/1055 604/151
2014/0105780 A1 4/2014 Cheney
2014/0131338 A1 5/2014 Postle
2014/0171367 A1 6/2014 Murthy et al.
2014/0219859 A1 8/2014 Cheney
2014/0234154 A1 8/2014 Cheney et al.
2014/0248509 A1 9/2014 Cheney
2014/0263248 A1 9/2014 Postle
2014/0295194 A1 10/2014 Yoshitaka et al.
2014/0322064 A1 10/2014 Gerk et al.
2014/0356223 A1 12/2014 Nilsson et al.
2015/0004337 A1 1/2015 Zimmermann et al.
2015/0075681 A1 3/2015 Wright et al.
2015/0086413 A1 3/2015 Wolverton et al.
2015/0106035 A1 4/2015 Vecchio et al.
2015/0147591 A1 5/2015 Cheney
2015/0152994 A1 6/2015 Bondil et al.
2015/0252631 A1 9/2015 Miller
2015/0275341 A1 10/2015 Cheney
2015/0284817 A1 10/2015 Snyder et al.
2015/0284829 A1 10/2015 Cheney
2015/0298986 A1 10/2015 Billieres et al.
2015/0307968 A1 10/2015 Mars et al.
2015/0367454 A1 12/2015 Cheney
2016/0001368 A1 1/2016 Gries et al.
2016/0002752 A1 1/2016 Srivastava et al.
2016/0002764 A1 1/2016 Gries et al.
2016/0017463 A1 1/2016 Cheney
2016/0024621 A1 1/2016 Cheney
2016/0024624 A1 1/2016 Cheney
2016/0024628 A1 1/2016 Cheney
2016/0040262 A1 2/2016 Snyder et al.
2016/0083830 A1 3/2016 Cheney
2016/0114392 A1 4/2016 Berg et al.
2016/0138144 A1 5/2016 Olsérius
2016/0144463 A1* 5/2016 Hellsten ..... B23K 35/30 420/54
2016/0168670 A1 6/2016 Cheney
2016/0195216 A1 7/2016 Bondil et al.
2016/0201169 A1 7/2016 Vecchio
2016/0201170 A1 7/2016 Vecchio
2016/0215374 A1 7/2016 Schade et al.
2016/0222490 A1 8/2016 Wright et al.
2016/0243616 A1 8/2016 Gries
2016/0258044 A1 9/2016 Litström et al.
2016/0271736 A1* 9/2016 Han, II ..... B23K 35/24
2016/0289001 A1 10/2016 Shibata et al.
2016/0289798 A1 10/2016 Deodeshmukh et al.
2016/0289799 A1 10/2016 Crook et al.
2016/0289803 A1 10/2016 Cheney

FOREIGN PATENT DOCUMENTS

CN 103628017 3/2014
CN 104625473 5/2015
CN 104694840 6/2015
DE 27 54 437 7/1979
DE 33 20 513 12/1983
DE 42 02 828 8/1993
DE 4411296 7/1995
DE 4411296 A1 * 7/1995 ..... B23K 38/3086
EP 0 740 591 3/1988
EP 0 365 884 5/1990
EP 0740591 3/1999
EP 1 270 755 1/2003
EP 1 338 663 8/2003
EP 2 305 415 8/2003
EP 1 857 204 11/2007
EP 2 064 359 6/2009
EP 2 388 345 11/2011
EP 2 660 342 11/2013
EP 2 072 627 4/2014
EP 2 730 355 5/2014
EP 2 743 361 6/2014
EP 2 104 753 7/2014
EP 2 778 247 9/2014
EP 2 563 942 10/2015
EP 3 034 637 6/2016
EP 2 235 225 10/2016
GB 2 153 846 A 8/1985
IN MUMNP-2003-00842 4/2005
JP 58-132393 8/1983
JP 60-133996 A 7/1985
JP 63-026205 A 2/1988
JP 03-133593 A 6/1991
JP 2012-000616 1/2012
KR 10-0935816 B1 1/2010
TW 200806801 A 2/2008
WO WO 1984/000385 2/1984
WO WO 1984/004760 12/1984
WO WO 2006/086350 8/2006
WO WO 08/060226 5/2008
WO WO 2008/011448 5/2008
WO WO 2008/060226 5/2008
WO WO 2008/082353 7/2008
WO WO 2010/044740 4/2010
WO WO 2010/046224 4/2010
WO WO 2010/074634 7/2010
WO WO 2011/021751 2/2011
WO WO 2011/071054 6/2011
WO WO 2011/158706 12/2011
WO WO 2012/021186 2/2012
WO WO 2012/022874 2/2012
WO WO 2012/112844 8/2012
WO WO 2013/055652 4/2013
WO WO 2013/060839 5/2013
WO WO 2013/101561 7/2013
WO WO 2013/102650 7/2013
WO WO 2013/126134 8/2013
WO WO 2014/001544 1/2014
WO WO 2014/023646 2/2014

(56) References Cited

FOREIGN PATENT DOCUMENTS

| | | |
|---|---|---|
| WO | WO 2014/081491 | 5/2014 |
| WO | WO 2014/083544 | 6/2014 |
| WO | WO 2014/085319 | 6/2014 |
| WO | WO 2014/090922 | 6/2014 |
| WO | WO 2014/114714 | 7/2014 |
| WO | WO 2014/114715 | 7/2014 |
| WO | WO 2014/187867 | 11/2014 |
| WO | WO 2014/197088 | 12/2014 |
| WO | WO 2014/201239 | 12/2014 |
| WO | WO 2014/202488 | 12/2014 |
| WO | WO 2015/028358 | 3/2015 |
| WO | WO 2015/049309 | 4/2015 |
| WO | WO 2015/075122 | 5/2015 |
| WO | WO 2015/183955 | 12/2015 |
| WO | WO 2016/003520 | 1/2016 |
| WO | WO 2016/010599 | 1/2016 |
| WO | WO 2016/124532 | 8/2016 |
| WO | WO 2016/131702 | 8/2016 |

OTHER PUBLICATIONS

Mo—C Phase Diagram [online], [retrieved on Jan. 27, 2015]. Retrieved from the internet:< URL: http://factsage.cn/fact/documentation/SGTE/C-Mo.jpg.*

Nb—C Phase Diagram [online], retrieved on Jan. 27, 2015]. Retrieved from the internet: <URL: http://www.crct.poly,ti.ca/fact/documentation/BINARY/C-Nb.jpg.*

Branagan, et al.: Developing extreme hardness (>15GPa) in iron based nanocomosites, Composites Part A: Applied Science and Manufacturing, Elsevier Science Publishers B.V., Amsterdam, NL, vol. 33, No. 6, Jun. 1, 2002, pp. 855-859.

Chen et al.: "Characterization of Microstructure and Mechanical Properties of High Chromium Cast Irons Using SEM and Nanoindentation," JMEPEG 2015 (published online Oct. 30, 2014). vol. 24(1), pp. 98-105.

Cheney, et al.: "Development of quaternary Fe-based bulk metallic glasses," Materials Science and Engineering, vol. 492, No. 1-2, Sep. 25, 2008, pp. 230-235.

Cheney: Modeling the Glass Forming Ability of Metals. A Dissertation submitted in partial satisfaction of the Requirements for the degree of Doctor of Philosophy. University of California, San Diego. Dec. 2007.

Cr—C Phase Diagram [online], [retrieved on Jan. 27, 2015]. Retrieved from the Internet: http://www.azom.com/work/3ud2quvLOU9g4VBMjVEh_files/image002.gif.

International Search Report and Written Opinion re PCT Application No. PCT/US16/61183, dated Jan. 19, 2017.

Iron-Carbon (Fe—C) Phase diagram [online], [retrieved on Jan. 27, 2014]. Retrieved from the internet: <URL:http://www.calphad.com/iron-carbon.html>.

Khalifa, et al.: "Effect of Mo—Fe substitution on glass forming ability, thermal stability, and hardness of Fe—C—B—Mo—Cr—W bulk amorphous allows," Materials Science and Engineering, vol. 490, No. 1-2, Aug. 25, 2008, pp. 221-228.

Miracle, D.B.: The efficient cluster packing model—An atomic structural model for metallic glasses, Acta Materialia vol. 54, Issue 16, Sep. 2006, pp. 4317-4336.

Tillack, et al.: "Selection of Nickel, Nickel-Copper, Nickel-Cromium, and Nickel-Chromlum-Iron Allows", ASM Handbook, Welding, Brazing and Soldering, vol. 6, Dec. 1, 1993 (Dec. 1, 1993) pp. 586-592, XP008097120, p. 589.

Titanium-Boron (TiB) Phase Diagram [online], [retrieved on Jan. 27, 2015]. Retrieved from the internet:<URL:http://www.calphad.com/titaniumboron.html>.

European Extended Search Report for Application No. 16864934.1 dated Feb. 20, 2019.

* cited by examiner

OXIDATION CONTROLLED TWIN WIRE ARC SPRAY MATERIALS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

Embodiments of the disclosure generally relate to thermal spray feedstock materials, such as twin wire arc spray feedstock materials, and the resultant spray coating.

Description of the Related Art

Arc spray coatings are produced via an electric arc produced across two wires which causes the wires to melt. A gas supply then atomizes the molten metal and propels it onto the surface, forming a coating. Arc spray coatings are used for many purposes and thus many different materials are used in the arc spray process. Arc spray coatings are composed of many small metallic droplets which build up on the substrate and one another to form a desired coating thickness. Arc spray processes can form coatings with a certain degree of porosity as well as oxides within the coating structure.

Metal cored wires are a common feedstock in the twin wire arc spray process. In a metal cored wire, a metal sheath is rolled into a cylinder which is filled with metallic powder. In the arc spray process, the sheath and the metal powder melt together to create a relatively homogenous mixture.

In the specific application of hard coatings, chromium is a common element used in a metallic powder for thermal spray applications. However, it can be advantageous to avoid the use of chromium in the alloy to avoid the production of hexavalent Cr which can occur during the arc spray process when the feedstock alloy is melted. There is existing art in the development of chromium free hardfacing coatings used in both welding and arc spraying. Common alloying elements used in chromium free hardfacing are the refractory elements which can include Ti, Zr, Nb, Mo, Hf, Ta, V, and W. These alloys are known to be effective in increasing the hardness of Fe-based coatings and thus have been demonstrated to be effective in producing Cr-free hardfacing alloys.

U.S. Pat. No. 4,673,550, hereby incorporated by reference in its entirety, details a Cr-free hardfacing alloy which utilizes $TiB_2$ crystals dispersed in a metallic matrix. In addition to relaying on Ti, this alloy utilizes specific heat treatment and processing to produce the $TiB_2$ crystals, which is not relevant to the arc spray process. Specific processing conditions can be used to deliver hard, wear resistant particles and this produce a hard, wear resistant coating.

U.S. Pat. No. 7,569,286, hereby incorporated by reference in its entirety, details a Cr-free hardfacing alloy which utilizes 4.5 to 6.5 wt. % Nb again to produce a specific crystal structure via a welding process. U.S. Pat. No. 8,268,453, hereby incorporated by reference in its entirety, teaches the use of Mo from 5.63% to 10.38 wt. % again to produce a hardfacing via the welding process. U.S. Pat. Pub. No. 2012/0097658, hereby incorporated by reference in its entirety, teaches the use of between 1% and 6% niobium and at least 0.1% W to produce a hardfacing gain via the welding process. Each of the examples in this case utilize refractory elements to produce a Cr-free hard coating. Also, each of these examples details the welding process which produces a fundamentally different microstructure and cannot be used to understand the microstructure or performance of an arc spray coating.

U.S. Pat. Pub. No. 2016/0024628, hereby incorporated by reference in its entirety, does teach a Cr-free hard coating which has relevance to arc spray coatings. This patent teaches the use of Mo in the range of 5 wt. % to 23 wt. %. This application specifically teaches the use of a minimum quantity of large atomic radius elemental species, which comprise primarily the refractory elements.

Metal cored wires can also be used as the feedstock in the arc spray process to produce soft coatings. In this disclosure 'soft' refers to a low hardness as opposed to specific magnetic properties. Soft coatings can be advantageous because they can be machined easily and rapidly. Soft coatings are used in dimensional restoration applications. Conventionally, Ni—Al is used as a dimensional restoration alloy. Ni—Al is very effective due to high adherence, but is expensive because it is a Ni-based alloy. Also used are solid wires of standard steel alloys such as mild steel, 400 series stainless steel, and 300 series stainless steel. The common steel solid wires are very inexpensive, but do not have the high adherence necessary to function in most applications.

SUMMARY

Disclosed herein are embodiments of a metal alloy composition manufactured into a cored wire which possesses a weighted solute feedstock concentration of greater than 2 weight % and a weighted solute coating concentration of less than 2 weight %.

In some embodiments, the weighted solute feedstock concentration can be greater than 10 weight %. In some embodiments, the weighted solute coating concentration can be below 1 weight %.

In some embodiments, the composition can be given in weight percent comprising one of the following with the balance Fe: Al about 1.5, C about 1, Mn about 1, Si about 3.25 or Al about 4, C about 1, Mn about 1.

In some embodiments, a coating formed from the metal alloy can comprise a coating adhesion of 5,000 psi or above, a microhardness of 500 Vickers or below, and a weighted mole fraction of solid solution strengthening elements in the coatings of above 20 weight %.

In some embodiments, the metal alloy composition after oxidation can further comprise an austenite to ferrite temperature below 1000 K.

In some embodiments, the composition can be given in weight percent comprising one of the following with the balance Fe Al about 1.5, B about 4, C about 4, Mn about 1, Ni about 1, Si about 3.25, or B about 1.85, C about 2.15, Mo about 15.7, V about 11.

Also disclosed herein are embodiments of a metal alloy composition given in weight percent comprising one of the following with the balance Fe and Al about 1.5, C about 5, Mn about 1, Si about 8, Al about 1.5, C about 5, Mn about 1, Si about 3.25, Al about 1.5, C about 1, Mn about 1, Si about 3.25, Al about 1.5, C about 1.5, Mn about 1, Ni about 12, Al about 4, C about 1, Mn about 1, Al about 1.5, B about 4, C about 4, Mn about 1, Ni about 1, Si about 3.25, and B about 1.85, C about 2.15, Mo about 15.7, V about 11.

In some embodiments, the metal alloy composition can further comprise a weighted solute feedstock concentration of greater than 2 weight %, and an austenite to ferrite temperature below 1000 K. In some embodiments, the metal alloy composition can form a coating comprising a coating adhesion of 5,000 psi or above, a microhardness of 500 Vickers or below, a weighted solute concentration of less than 2 weight %, and a weighted mole fraction of solid solution strengthening elements of above 20 weight %. In some embodiments, the composition can be the composition of a cored wire including both a powder and a sheath surrounding the powder.

Also disclosed herein are embodiments of a soft metallic coating for applying to a substrate, the soft metallic coating comprising a coating adhesion of 5,000 psi or above, a microhardness of 500 Vickers or below, a weighted mole fraction of solid solution strengthening elements of above 20 weight %, and a weighted solute concentration of less than 2 weight %, wherein a powder and/or powder and sheath combination forming the coating comprises a weighted solute feedstock concentration of greater than 2 weight %, and wherein the powder and/or powder and sheath combination after oxidation comprises an austenite to ferrite temperature below 1000 K.

In some embodiments, a composition of the powder and/or powder and sheath combination can comprise, in weight percent with the balance being Fe, one of the following: Al about 1.5, C about 5, Mn about 1, Si about 8, Al about 1.5, C about 5, Mn about 1, Si about 3.25, Al about 1.5, C about 1, Mn about 1, Si about 3.25, Al about 1.5, C about 1.5, Mn about 1, Ni about 12, Al about 4, C about 1, Mn about 1, Al about 1.5, B about 4, C about 4, Mn about 1, Ni about 1, Si about 3.25, and B about 1.85, C about 2.15, Mo about 15.7, V about 11.

Also disclosed herein are embodiments of a method of thermal spraying a coating onto a substrate, the method comprising providing a metal alloy composition given in weight percent comprising one of the following with the balance Fe: Al about 1.5, C about 5, Mn about 1, Si about 8, Al about 1.5, C about 5, Mn about 1, Si about 3.25, Al about 1.5, C about 1, Mn about 1, Si about 3.25, Al about 1.5, C about 1.5, Mn about 1, Ni about 12, Al about 4, C about 1, Mn about 1, Al about 1.5, B about 4, C about 4, Mn about 1, Ni about 1, Si about 3.25, and B about 1.85, C about 2.15, Mo about 15.7, V about 11, and thermally spraying the metal alloy composition onto a substrate to form a coating.

In some embodiments, the coating can comprise a coating adhesion of 5,000 psi or above, a microhardness of 500 Vickers or below, a weighted mole fraction of solid solution strengthening elements of above 20 weight %, and a weighted solute concentration of less than 2 weight %.

In some embodiments, a powder and/or powder and sheath combination for forming the coating can comprise a weighted solute feedstock concentration of greater than 2 weight %. In some embodiments, the powder and/or powder and sheath combination after oxidation can comprise an austenite to ferrite temperature below 1000 K. In some embodiments, the metal alloy composition is provided as one or more cored wires.

Disclosed herein are embodiments of a metal alloy composition given in weight percent comprising Fe and one of the following:

Al about 2.5, C about 5, Mn about 1, Si about 8;
Al about 1.5, C about 5, Mn about 1, Si about 3.25;
Al about 1.5, C about 1, Mn about 1, Si about 3.25;
Al about 1.5, C about 1.5, Mn about 1, Ni about 12;
Al about 4, C about 1, Mn about 1;
Al about 1.5, B about 4, C about 4, Mn about 1, Ni about 1, Si about 3.25;
B about 1.85, C about 2.15, Mo about 15.7, V about 11;
Al about 1.5, B about 5, C about 4, Mn about 1, Si about 3.3; or
Al about 1.5, Cr about 11.27, Mn about 1.03, Ni about 20, and Si about 3.3.

Additionally disclosed herein are embodiments of a soft metallic alloy for applying to a substrate, the soft metallic alloy configured to form a coating comprising a coating adhesion of 7,000 psi or above, a microhardness of 300 Vickers or below, and a weighted solute fraction in the coating chemistry of the alloy of less than 10 wt. % at a melting temperature of the alloy.

In some embodiments, the soft metallic coating can form from a powder and/or a powder and sheath combination, wherein a composition of the powder and/or powder and sheath combination comprises, Fe and in wt. %, one of the following:

Al about 1.5, C about 1, Mn about 1, Si about 3.25;
Al about 1.5, C about 1.5, Mn about 1, Ni about 12; or
Al about 1.5, Cr about 11.27, Mn about 1.03, Ni about 20, and Si about 3.3.

Further disclosed herein are embodiments of a hard metallic alloy for applying to a substrate, the hard metallic configured to form a coating comprising a coating adhesion of 7,000 psi or above, a microhardness of 1,000 Vickers or below, <1 wt. % Cr, and a weighted solute fraction in a chemistry of the hard metallic alloy being greater than 50 wt. % at a melting temperature of the hard metallic alloy.

In some embodiments, the coating can be formed from a powder and/or powder and sheath composition, wherein a composition of the powder and/or powder and sheath combination comprises, Fe and in wt. %, one of the following:

Al about 2.5, C about 5, Mn about 1, Si about 8;
Al about 1.5, C about 5, Mn about 1, Si about 3.25;
Al about 1.5, B about 4, C about 4, Mn about 1, Ni about 1, Si about 3.25;
B about 1.85, C about 2.15, Mo about 15.7, V about 11; or
Al about 1.5, B about 5, C about 4, Mn about 1, Si about 3.3.

Also disclosed herein are embodiments of a method of producing a coating, the method comprising spraying a first Fe-based metal cored wire capable of producing 1,000 Vickers or greater hardness particles and spraying a second Fe-based metal cored wire capable of producing 200 Vickers of lower hardness particles, wherein the first wire and the second wire are sprayed together, and wherein the coating is configured to be polished to a finish of 2 microns Ra or better.

In some embodiments, the first wire can comprise one of the following chemistries comprising Fe and, in wt. %:

Al about 2, B about 4, Cr about 13, Nb about 6;
Al about 2.5, C about 5, Mn about 1, Si about 8;
Al about 1.5, C about 5, Mn about 1, Si about 3.25;
Al about 1.5, B about 4, C about 4, Mn about 1, Ni about 1, Si about 3.25;
B about 1.85, C about 2.15, Mo about 15.7, V about 11; or
Al about 1.5, B about 5, C about 4, Mn about 1, Si about 3.3.

In some embodiments, the second wire can comprise one of the following chemistries comprising Fe and, in wt. %:

Al about 1.5, C about 1, Mn about 1, Si about 3.25;
Al about 1.5, C about 1.5, Mn about 1, Ni about 12; or Al about 1.5, Cr about 11.27, Mn about 1.03, Ni about 20, and Si about 3.3.

Also disclosed herein are embodiments of a method of producing a coating, the method comprising spraying a first wire containing 1 wt. % or less Cr and spraying a second wire comprising aluminum and/or zinc, wherein the first wire and the second wire are sprayed together, and wherein the coating does not rust.

In some embodiments, the first wire can comprise, in wt. %, Fe, Al: about 1.5, C: about 1, Mn: about 1, and Si: about 3.25.

In some embodiments, the coating can contain 1 wt. % or less Cr.

In some embodiments, the coating can contain no Cr.

Further disclosed herein are embodiments of an iron-based cored wire alloy feedstock configured for twin wire arc thermal spray applications, the cored wire alloy feedstock comprising a powder and a sheath, wherein the powder and sheath combination have a composition comprising Fe and, in wt. %: Al: about 0-2.5; Cr: about 10-15; Mn: about 0-2; Ni: about 15-25; and Si: about 0-5, wherein the cored wire alloy feedstock is configured to form an iron-based soft metallic coating from a twin wire arc thermal spray, the coating comprising a coating adhesion of 7,000 psi or above, a microhardness of 400 Vickers or below, a weighted solute fraction in a coating chemistry of the alloy of less than 10 wt. % at a melting temperature of the alloy, and a ferrite to austenite transition temperature of 1000K or below. In some embodiments, the iron-based cored wire alloy feedstock can be configured to form the coating after oxidation in a twin wire arc thermal spray application.

In some embodiments, the sheath can have a diameter of 1/16" and a ratio of the powder to the sheath can be about 20-40% by weight.

In some embodiments, the microhardness of the coating can be 300 Vickers or below. In some embodiments, the microhardness of the coating can be 200 Vickers or below. In some embodiments, the microhardness of the coating can be 100 Vickers or below. In some embodiments, the weighted solute fraction of the coating can be less than 6 wt. % at a melting temperature of the alloy. In some embodiments, the weighted solute fraction of the coating can be less than 2 wt. % at a melting temperature of the alloy.

In some embodiments, the composition can comprise Fe and, in wt. %: Al: about 1.5; Cr: about 11.27; Mn: about 1.03; Ni: about 20; and Si: about 3.3. In some embodiments, the composition can comprise Fe and, in wt. %: Al about 1.5, C about 1, Mn about 1, Si about 3.25; Al about 1.5, C about 1.5, Mn about 1, Ni about 12; or Al about 1.5, Cr about 11.27, Mn about 1.03, Ni about 20, and Si about 3.3. In some embodiments, the austenite ferrite transition temperature can be below about 950K.

Further disclosed herein are embodiments of an iron-based cored wire alloy feedstock configured for twin wire arc thermal spray applications, the cored wire alloy feedstock comprising a powder and a sheath, wherein the powder and sheath combination have a composition comprising Fe and, in wt. %: Al: about 0-2.5; B: about 3-6; C: about 3-5; Mn: about 0-2; Ni: about 0-2; and Si: about 0-5, wherein the cored wire alloy feedstock is configured to form an iron-based hard metallic coating from a twin wire arc thermal spray, the coating comprising a coating adhesion of 7,000 psi or above, a microhardness of 1,000 Vickers or above, <1 wt. % Cr, and a weighted solute fraction in a chemistry of the hard metallic alloy being greater than 50 wt. % at a melting temperature of the hard metallic alloy.

In some embodiments, the weighted solute fraction of the coating can be greater than 70 wt. % at a melting temperature of the hard metallic alloy. In some embodiments, the composition can comprise Fe and, in wt. %: Al: about 1.5; B: about 5; C: about 4; Mn: about 1; and Si: about 3.3. In some embodiments, the composition can comprise Fe and, in wt. %: Al about 2.5, C about 5, Mn about 1, Si about 8; Al about 1.5, C about 5, Mn about 1, Si about 3.25; Al about 1.5, B about 4, C about 4, Mn about 1, Ni about 1, Si about 3.25; B about 1.85, C about 2.15, Mo about 15.7, V about 11; or Al about 1.5, B about 5, C about 4, Mn about 1, Si about 3.3.

Also disclosed herein are embodiments of an iron-based cored wire alloy feedstock configured for twin wire arc thermal spray applications, the cored wire alloy feedstock comprising a powder and a sheath, wherein the powder and sheath combination have a composition comprising Fe and, in wt. %: Al: about 0-2.5; Cr: about 10-15; Mn: about 0-2; Ni: about 15-25; and Si: about 0-5. In some embodiments, the sheath can have a diameter of 1/16" and a ratio of the powder to the sheath is about 20-40% by weight.

Further disclosed herein are embodiments of an iron-based cored wire alloy feedstock configured for twin wire arc thermal spray applications, the cored wire alloy feedstock comprising a powder and a sheath, wherein the powder and sheath combination have a composition comprising Fe and, in wt. %: Al: about 0-2.5; B: about 3-6; C: about 3-5; Mn: about 0-2; Ni: about 0-2; and Si: about 0-5. In some embodiments, the sheath can have a diameter of 1/16" and a ratio of the powder to the sheath is about 20-40% by weight.

Also disclosed herein are embodiments of a method of twin wire arc thermal spraying a coating onto a substrate using a cored wire having a feedstock alloy composition, wherein the method comprises thermally spraying the cored wire onto a substrate to form a coating having an adhesion of at least 7,000 psi, wherein the coating is a soft coating comprising a microhardness of 400 Vickers or below, a weighted solute fraction in a coating chemistry of the alloy of less than 10 wt. % at a melting temperature of the alloy, and a ferrite to austenite transition temperature of 1000K or below, or a hard coating comprising a microhardness of 1,000 Vickers or above, <1 wt. % Cr, and a weighted solute fraction in a chemistry of the hard metallic alloy being greater than 50 wt. % at a melting temperature of the hard metallic alloy.

In some embodiments, the feedstock alloy composition can comprise Fe and, in wt. %: Al: about 0-2.5; Cr: about 10-15; Mn: about 0-2; Ni: about 15-25; and Si: about 0-5; wherein the cored wire is configured to form the soft coating. In some embodiments, the feedstock alloy composition can comprise Fe and, in wt. %: Al: about 1.5; Cr: about 11.27; Mn: about 1.03; Ni: about 20; and Si: about 3.3, wherein the cored wire is configured to form the soft coating. In some embodiments, the feedstock alloy composition can comprise Fe and, in wt. %: Al: about 0-2.5; B: about 3-6; C: about 3-5; Mn: about 0-2; Ni: about 0-2; and Si: about 0-5, wherein the cored wire is configured to form the hard coating.

In some embodiments, the feedstock alloy composition can comprise Fe and, in wt. %: Al: about 1.5; B: about 5; C: about 4; Mn: about 1; and Si: about 3.3, wherein the cored wire is configured to form the hard coating. In some embodiments, two cored wires can be sprayed and have the same composition. In some embodiments, only one of the soft coating or the hard coating is formed.

Further disclosed are embodiments of coatings formed using any of the above or below disclosed feedstock alloy compositions. Further disclosed are embodiments of a twin wire arc spray process using the cored wire alloy feedstock disclosed herein. Additionally disclosed are embodiments of a pulp and paper roll, a power generation boiler, and a hydraulic cylinder, each of which can have the coating disclosed herein or a coating formed from the feedstock disclosed herein.

DETAILED DESCRIPTION

Figure 1:
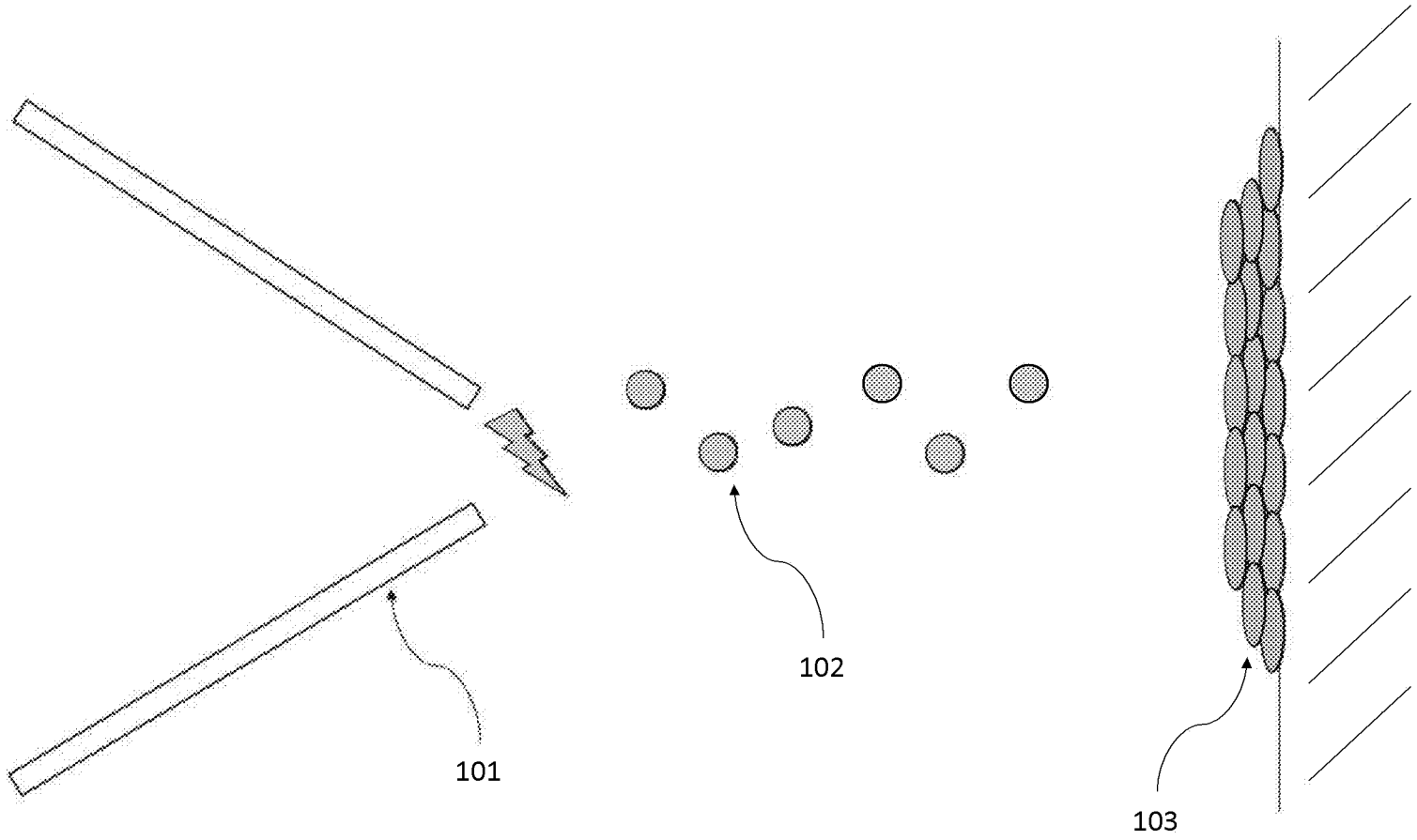
FIG. 1 shows an embodiment of a dual wire thermal spray application process.

Disclosed herein are embodiments of arc spray coatings in which the coating chemistry is specifically engineered based on the oxidation thermodynamics of the arc spray process. Specifically, disclosed herein are embodiments of soft alloys and hard alloys, each of which can be applied as a coating using a thermal spray process, such as a twin arc thermal spray process. Both alloys can have high adhesion properties making them advantageous as coatings. Embodiments of the hard alloys can be mostly or fully chrome free, which has been difficult to incorporate into a thermal spray process.

In this disclosure, techniques are disclosed which model the change in chemistry from the feedstock alloy to the coating alloy. This chemistry change can occur due to preferential oxidation of certain species in the feedstock alloy. As disclosed herein, this preferential oxidation can be utilized in an alloy design to achieve high performance alloy coatings.

Preferential oxidation can occur when the feedstock material is a cored wire. Cored wires are composed of a metallic sheath containing a physical mixture of metallic alloy powders. This specific article of manufacture can allow the individual species of the cored wire to preferentially oxidize according to embodiments of the design processes disclosed herein. In contrast, a solid wire is composed of a pre-alloyed homogenous feedstock chemistry and thus will oxidize as single component. In sum, the thermodynamic design criteria, reaction of the alloy to the arc spray process, and the ultimate performance of the alloys described herein cannot be achieved using a solid wire.

Cored wires can also be used for welding applications. However, the oxidation phenomenon is not as prevalent due to the use of shielding gases and de-oxidizers.

An example of a wire for thermal spray is 1/16" diameter wire. However, other dimensions can be used as well such as 3/16", 1/8", 3/32", and 1/15", and the particular dimensions are not limiting. The powder to wire ratio for this blend is 30-45% by weight depending on the specific powder used in the fill, though the particular composition is not limiting. For example, the powder to wire ratio could be 20-40% by weight. In some embodiments, it could be about 30% by weight. In some embodiments, the sheath can be a mild steel, 420 SS, or 304 SS strip, though other types of sheaths can be used.

In a thermal spray process, the thermal spray device can be used at 29-32 volts (or about 29-about 32 volts), 100-250 amps (or about 100-about 250 amps), and an air pressure of 60-100 psi (or about 60-about 100 psi). Changes in voltage or amperage likely does not affect the final coating parameters as discussed herein. Changes in air pressure can adjust the size of the coating particles, but does not affect the chemistry of that particle. Other variables for thermal spray applications include spray distance (4"-8") and coating thickness per pass (2-3 mils). Neither of these parameters affect chemistry but can affect the macroscopic integrity of the coating. Thus, it can be advantageous to keep these parameters within a reasonable range for the process to work.

Embodiments of the disclosure can be particularly advantageous for the twin wire arc spray process. The compositions can be effective under the rapid solidification inherent to the twin wire arc spray process. However, a weld produced with these alloys may produce a material outside of the disclosure that is too brittle to be practically useful. However, embodiments of the disclosure can be used with other thermal spray processes, such as plasma spraying which would not use a sheath but instead only include the powder. Other spraying techniques may also be used which may include a powder/sheath combination or just a powder. Thus, the feedstock compositions discussed herein may cover just a powder, such as for applications which do not use a sheath, or a combination of powder and sheath.

Further, embodiments of the disclosure can limit or avoid the use of both Cr and/or refractory elements (Ti, Zr, Nb, Mo, Hf, Ta, V, and W). It can be advantageous to avoid these elements which are expensive and drive up the raw material cost of the alloy. On the other hand, Cr is a relatively inexpensive alloying element used to produce hard coatings. When designing Cr-free it can be advantageous to maintain an equivalent or similar raw material cost to the incumbent Cr-containing alloys used commonly by industry.

One common application of arc spay coatings is the surface reclamation using a soft alloy. In embodiments of this disclosure, the arc spray coating can be applied to a component in order to restore the component to a desired dimension. Typically, it can be advantageous for arc spray coatings of the disclosure to be both machinable and highly adherent. The most widely used material for surface restoration is a nickel-aluminum alloy.

A second common application of arc spray coatings is the deposition of a hard surface to act as a wear resistant coating. In this disclosure it can be advantageous for the coating to be as hard as possible, and to be highly adherent. There are a variety of Cr-bearing materials which are now used for this application including 420 SS, Fe—Cr—B, and Fe—Cr—C type alloys.

As disclosed herein, the term alloy can refer to the chemical composition forming the powder, the powder itself, the combination of powder and sheath, and the composition of the metal component (e.g., coating) formed by the heating and/or deposition of the powder.

Thermodynamic, microstructural, and compositional criteria could be used to produce such an alloy. In some embodiments, only one of the criteria can be used to form the alloy, and in some embodiments multiple criteria can be used to form the alloy.

Metal Alloy Composition

In some embodiments, the alloy (powder or powder/sheath) and/or the final coating can be described by the nominal composition of elements which exhibit the thermodynamic and performance traits described herein. The chemistries in Table 1 show feedstock chemistries (e.g., the alloy compositions of the cored wires as they are manufactured, including both the metallic sheath and the metallic alloy powders). After being subject to the arc spray process and the inherent preferential oxidation described herein, each alloy will form a different coating chemistry. The alloys shown in Table 1 can be configured to, for example, form hard coatings.

TABLE 1

Experimental Alloy Chemistries in weight % Manufactured into Cored Wire, Fe is the balance in all cases configured to form hard coatings

| Alloy | Al | B | C | Cr | Mn | Mo | Ni | Si | V |
|---|---|---|---|---|---|---|---|---|---|
| X1 | 2.5 | 0 | 5 | 0 | 1 | 0 | 0 | 8 | 0 |
| X2 | 1.5 | 0 | 5 | 0 | 1 | 0 | 0 | 3.25 | 0 |
| X6 | 1.5 | 4 | 4 | 0 | 1 | 0 | 1 | 3.25 | 0 |
| X7 | 0 | 1.85 | 2.15 | 0 | 0 | 15.7 | 0 | 0 | 11 |
| X8 | 1.5 | 5 | 4 | 0 | 1 | 0 | 0 | 3.3 | 0 |

As can be gleaned from Table 1, there is no chromium or substantially no chromium in the alloy compositions of these embodiments. In some embodiments, chromium may be specifically avoided. Chromium produces hexavalent chromium fumes when subject to any arc process. Hexavalent chromium is carcinogenic and it is desirable to avoid its production. The hardest and most wear resistant arc spray coatings belong to the Fe—Cr—B and Fe—Cr—C families, and therefore contain chromium.

It is further advantageous to reduce or eliminate the alloy content of expensive transition/refractory elements: Nb, Ti, Mo, V, Zr, and W. It is commonplace to utilize these elements in place of Cr, as these elements are known carbide and/or boride forming elements. In some embodiments, the transition metal alloy content (Nb+Ti+Mo+V+Mo) is at or below 5 wt. % (or at or below about 5 wt. %). In some embodiments, the transition metal alloy content (Nb+Ti+Mo+V+Mo) can be at or below 3 wt. % (or at or below about 3 wt. %). In some embodiments, the transition metal alloy content (Nb+Ti+Mo+V+Mo) can be at or below about 1 wt. % (or at or below about 1 wt. %).

The chemistries in Table 1 show feedstock chemistries (e.g., the alloy compositions of the cored wires as they are manufactured, including both the metallic sheath and the metallic alloy powders). After being subject to the arc spray process and the oxidation described herein, each alloy will form a different coating chemistry.

The feedstock alloys shown in Table 2 are configured to form, for example, soft coatings using a thermal spray technique.

TABLE 2

Experimental Alloy Chemistries in weight % Manufactured into Cored Wire, Fe is the balance in all cases configured to form soft coatings

| Alloy | Al | C | Cr | Mn | Ni | Si |
|---|---|---|---|---|---|---|
| X3 | 1.5 | 1 | 0 | 1 | 0 | 3.25 |
| X4 | 1.5 | 1.5 | 0 | 1 | 12 | 3.25 |
| X5 | 4 | 1 | 0 | 1 | 0 | 0 |
| X9 | 1.5 | 0 | 11.27 | 1.03 | 20 | 3.3 |

For either the soft or hard coatings, in some embodiments the chromium content of the alloy is below 1 weight % (or below about 1 weight %). In some embodiments, the chromium content of the alloy is below 0.5 weight % (or below about 0.5 weight %). In some embodiments, the chromium content of the alloy is below 0.1 weight % (or below about 0.1 weight %). In some embodiments, the chromium content of the alloy is 0 weight % (or about 0 weight %).

In some embodiments, the alloy can be described by at least the below compositional ranges:

Al: 0 to 5, B: 0 to 4, C: 0 to 5, Mn: 0 to 3, Ni: 0 to 15, Si: 0 to 5; or

Al: about 0 to about 5, B: about 0 to about 4, C: about 0 to about 5, Mn: about 0 to about 3, Ni: about 0 to about 15, Si: about 0 to about 5

In some embodiments, the alloy can be described by specific compositions which comprise the following elements in weight percent, with Fe making the balance:

1. Al 1.5, C 5, Mn 1, Si 8 (or Al about 1.5, C about 5, Mn about 1, Si about 8)
2. Al 1.5, C 5, Mn 1, Si 3.25 (or Al about 1.5, C about 5, Mn about 1, Si about 3.25)
3. Al 1.5, C 1, Mn 1, Si 3.25 (or Al about 1.5, C about 1, Mn about 1, Si about 3.25)
4. Al 1.5, C 1.5, Mn 1, Ni 12 (or Al about 1.5, C about 1.5, Mn about 1, Ni about 12)
5. Al 4, C 1, Mn 1 (or Al about 4, C about 1, Mn about 1)
6. Al 1.5, B 4, C 4, Mn 1, Ni 1, Si 3.25 (or Al about 1.5, B about 4, C about 4, Mn about 1, Ni about 1, Si about 3.25)
7. B 1.85, C 2.15, Mo 15.7, V 11 (or B about 1.85, C about 2.15, Mo about 15.7, V about 11)
8. Al 1.5, B 5, C 4, Mn 1, Si 3.3 (or Al about 1.85, B about 5, C about 4, Mn about 1, Si about 3.3)
9. Al 1.5, Cr 11.27, Mn 1.03, Ni 20, Si 3.3 (or Al about 1.5, Cr about 11.27, Mn about 1.03, Ni about 20, Si about 3.3)
10. Al 2.5, C 5, Mn 1, Si 8 (or Al about 2.5, C about 5, Mn about 1, Si about 8)

Alloy X9 represents an exemplary embodiment in the formation of a highly adherent machinable soft alloy coating. Several alloying adjustments can be made to further reduce alloy cost, through the reduction of nickel, or to reduce or eliminate hexavalent fume emissions through the reduction or elimination of Cr. Modifications of this specifically include the following:

11. Al 1.5, Cr 11.27, Mn 1.03, Ni 18, Si 3.3 (or Al about 1.5, Cr about 11.27, Mn about 1.03, Ni about 18, Si about 3.3)
12. Al 1.5, Cr 11.27, Mn 1.03, Ni 15, Si 3.3 (or Al about 1.5, Cr about 11.27, Mn about 1.03, Ni about 15, Si about 3.3)
13. Al 1.5, Cr 11.27, Mn 1.03, Ni 12, Si 3.3 (or Al about 1.5, Cr about 11.27, Mn about 1.03, Ni about 12, Si about 3.3)
14. Al 1.5, Cr 11.27, Mn 1.03, Ni 10, Si 3.3 (or Al about 1.5, Cr about 11.27, Mn about 1.03, Ni about 10, Si about 3.3)
15. Al 1.5, Cr 0, Mn 1.03, Ni 20, Si 3.3 (or Al about 1.5, Cr about 0, Mn about 1.03, Ni about 20, Si about 3.3)
16. Al 1.5, Cr 0, Mn 1.03, Ni 18, Si 3.3 (or Al about 1.5, Cr about 0, Mn about 1.03, Ni about 18, Si about 3.3)
17. Al 1.5, Cr 0, Mn 1.03, Ni 15, Si 3.3 (or Al about 1.5, Cr about 0, Mn about 1.03, Ni about 15, Si about 3.3)
18. Al 1.5, Cr 0, Mn 1.03, Ni 12, Si 3.3 (or Al about 1.5, Cr about 0, Mn about 1.03, Ni about 12, Si about 3.3)

19. Al 1.5, Cr 0, Mn 1.03, Ni 10, Si 3.3 (or Al about 1.5, Cr about 0, Mn about 1.03, Ni about 10, Si about 3.3)

As described, one of the most widely used arc spray material used for 'surface reclamation' is a nickel-aluminum alloy. However, this is a very expensive alloy to produce. Thus, the materials presented in this disclosure are Fe-based and meet the combination of economic and performance criteria. While many Fe-based alloys exist for the arc spray process, they have yet to meet the performance characteristics of Ni—Al for the surface reclamation application. Previous Fe-based alloys suffer from high oxide content and undesirable oxide morphology, and thus do not achieve the high adhesion requirements of the surface reclamation application.

Ni—Al Alloys, the most conventional being 80 wt. % Ni/20 wt. % Al and 95 wt. % Ni/5 wt. % Al, have very high adhesion (being characterized as >7,000 psi bond strength). Because of this high adhesion, they are often referred to as bond coats because they bond to the substrate very well. Bond coats are used in a variety of applications specifically because they adhere to the substrate very well. Most arc spray alloys, including the less expensive steel wires, have bond strengths in the realm of 3,000 psi to 5,000 psi. Thus, the 'soft alloys' of this disclosure can create a suitable Fe-based bond coat to replace the more expensive nickel alloys.

The disclosed alloys can incorporate the above elemental constituents to a total of 100 wt. %. In some embodiments, the alloy may include, may be limited to, or may consist essentially of the above named elements. In some embodiments, the alloy may include 2 wt. % or less of impurities. Impurities may be understood as elements or compositions that may be included in the alloys due to inclusion in the feedstock components, through introduction in the manufacturing process.

In some embodiments, the alloys may be iron-based. In some embodiments, iron-based means the alloy is at least 50 wt. % iron. In some embodiments, iron-based means that there is more iron than any other element in the alloy.

Further, the Fe content identified in all of the compositions described in the above paragraphs may be the balance of the composition as indicated above, or alternatively, the balance of the composition may comprise Fe and other elements. In some embodiments, the balance may consist essentially of Fe and may include incidental impurities. Further, all iron in the alloy can be from a sheath surrounding a powder, or can include both iron in the sheath and iron in the powder in combination.

Thermodynamic Criteria:

In some embodiments, an alloy can be described fully by thermodynamic criteria. As mentioned, it can be advantageous for the preferential oxidation behavior to be controlled and understood. This level of understanding is a result of extensive experimentation and inventive process.

In some embodiments, a method for designing high performance arc spray materials is described. In some embodiments, the thermal spray alloy can be modelled using a formula which incorporates oxygen into the modelled chemistry in order to predict the oxidation behavior of the alloy. The formula is as follows:

$$(\text{Feedstock Alloy Composition})_{92}O_8$$

This model is used to predict the behavior of a potential feedstock alloy in the arc spray process. In order to effectively use this technique high throughput computational metallurgy is used in order to effectively identify exemplary alloys from the millions of potential candidates. Thus, embodiments of the disclosure allow for the selection of a composition pre-oxidation that will give specific properties, discussed below, post-oxidation in the form of a coating.

This thermodynamic model is predicting the coating process illustrated in FIG. 1. One embodiment of the alloys in this disclosure is a cored wire used in the twin wire arc spray process [101]. The cored wire [101] is manufactured per an alloy specification, and is referred to in this disclosure as the feedstock chemistry. The cored wire [101] is the feedstock for the twin wire arc spray process. During the arc spray process, the cored wire [101] is melted and sprayed onto a substrate. The spray process involves atomizing the feedstock cored wire [101] into tiny molten particles [102] which travel through the air. During this process, when using a cored wire as the feedstock, certain elemental species react with the air more than others. The result of this 'preferential oxidation' is that the chemistry of the molten particles [102] has been altered from the feedstock chemistry. As is the intent of this process, the molten particles impact upon a substrate and form a coating. The chemistry of the particles which make up the coating [103] are equivalent to the chemistry of the molten particles [102] which is different from the chemistry of the feedstock wire [101]. The modelling techniques described in this disclosure predict the chemistry evolution from feedstock chemistry to coating chemistry inherent to the twin wire arc spray process such that an appropriate feedstock chemistry can be designed to produce the desired coating chemistry.

Figure 2:
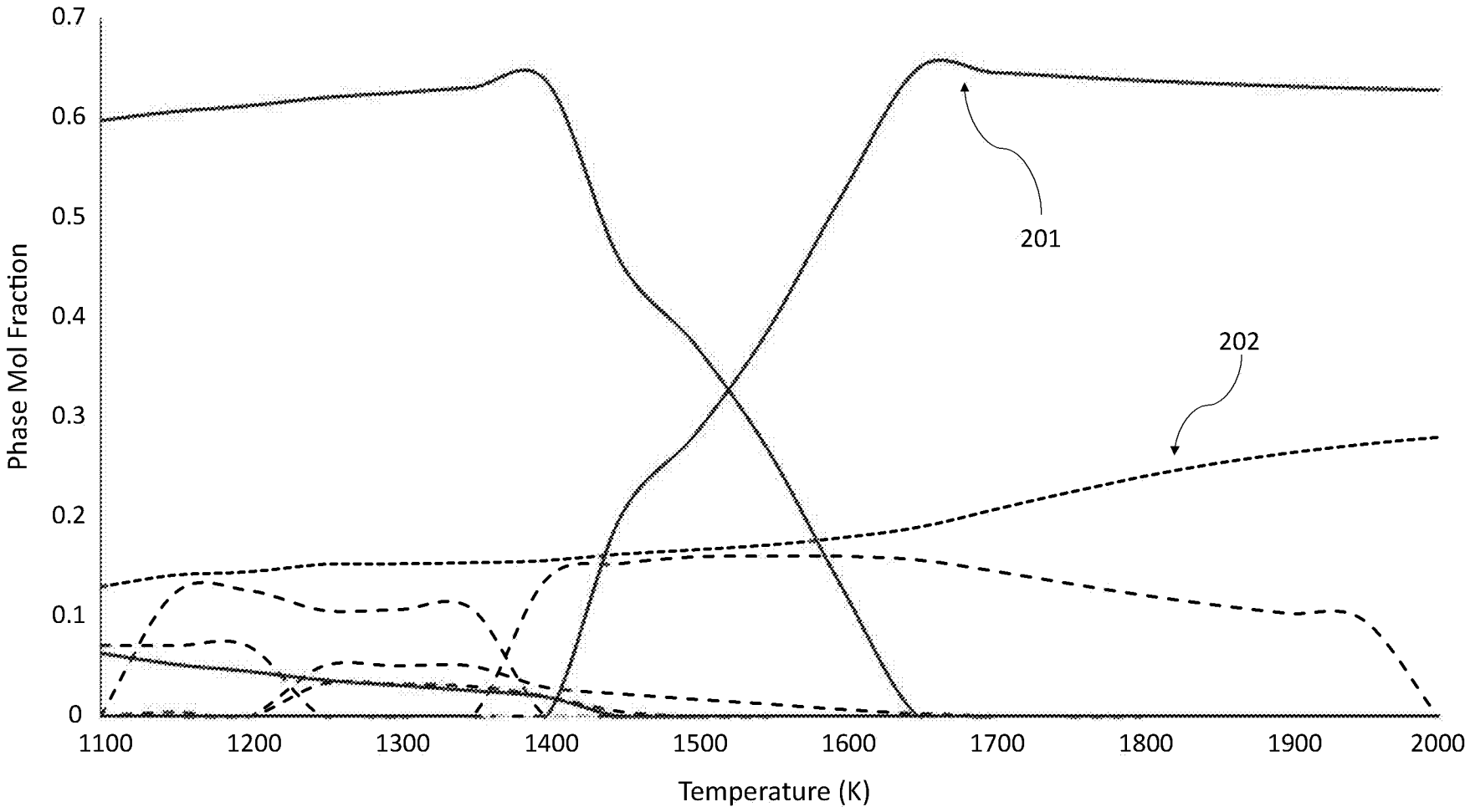
FIG. 2 shows an embodiment of a solidification diagram of Alloy X1.

FIG. 2 shows a solidification diagram of Alloy X1, e.g. a hard alloy, subject to the preferential oxidation model. When modelling the arc spraying of Alloy X1 we use the formula above and calculate the simulation diagram of the following composition (which is not the composition of the X1 wire feedstock chemistry):

$$(\text{Alloy X1Feedstock Composition})_{92}O_8 = \text{Al:1.4\%,C:4.6\%,Mn:0.9\%,O:8\%,Si:7.4\%}$$

The diagram of FIG. 2 contains many phases which have been separated into oxide species as dotted lines (202) and metallic species (201). In this embodiment, oxide species include $CO_2$ gas, FeO liquid, corundum, rhodonite, spinel, and tridymite. In this embodiment, metallic species shown are Fe-based liquid, graphite, and austenite. For the purposes of calculating the coating chemistry, the specific phases are relevant only for the categorization of them as either oxide or metallic. The coating chemistry is calculated as a rule of mixtures between the metallic species only based on the mole fraction of each and elemental chemistry of each phase.

In some embodiments, the coating chemistry is calculated at 1300K. In some embodiments, the coating chemistry is calculated at the melting temperature of the alloy, defined as the lowest temperature at which the metallic component of the alloy is 100% liquid. In some embodiments, the coating chemistry is the chemistry of the metallic liquid at the melting temperature.

In this fashion, the coating chemistry formed from each experimental wire composition was calculated and is shown in Table 3-4, which includes both hard and soft alloys. It should be evident by comparison with Table 1 that the coating chemistry of the alloy is not the same as the feedstock chemistry discussed above. This is due to the principle of preferential oxidation. For example, the Al in the feedstock of Alloy X1 oxidizes completely and is not present in the coating chemistry. Preferential oxidation can decrease the elemental concentration of some species and increase the elemental concentration of other species.

TABLE 3

| Coating Chemistry of Alloys as Calculated at 1300 K excluding graphite or diamond formation | | | | | | | | | |
|---|---|---|---|---|---|---|---|---|---|
| Alloy | Al | B | C | Cr | Mn | Mo | Ni | Si | V |
| X1 | 0.0% | 0.0% | 5.5% | 0.0% | 1.1% | 0.0% | 0.0% | 2.4% | 0.0% |
| X2 | 0.0% | 0.0% | 2.8% | 0.0% | 0.0% | 0.0% | 0.0% | 0.0% | 0.0% |
| X3 | 0.0% | 0.0% | 0.1% | 0.0% | 0.0% | 0.0% | 0.0% | 0.0% | 0.0% |
| X4 | 0.0% | 0.0% | 0.1% | 0.0% | 0.0% | 0.0% | 13.5% | 0.0% | 0.0% |
| X5 | 0.0% | 0.0% | 0.0% | 0.0% | 0.0% | 0.0% | 0.0% | 0.0% | 0.0% |
| X6 | 0.0% | 4.8% | 1.5% | 0.0% | 0.0% | 0.0% | 1.0% | 0.0% | 0.0% |
| X7 | 0.0% | 1.9% | 0.0% | 0.0% | 0.0% | 15.8% | 0.0% | 0.0% | 17.1% |
| X8 | 0.0% | 5.8% | 1.6% | 0.0% | 0.0% | 0.0% | 0.0% | 0.0% | 0.0% |
| X9 | 0.0% | 0.0% | 0.0% | 4.5% | 0.1% | 0.0% | 23.0% | 0.1% | 0.0% |

TABLE 4

| Coating Chemistry, in wt. % of Alloys as Calculated at Alloy Melting Temperature | | | | | | | | | | | |
|---|---|---|---|---|---|---|---|---|---|---|---|
| Alloy | Melting temp (K) | Al | B | Cr | C | Mn | Mo | Ni | O | Si | V |
| X1 | 1450 | 0.0 | 0.0 | 0.0 | 5.5 | 1.1 | 0.0 | 0.0 | 0.0 | 2.5 | 0.0 |
| X2 | 1650 | 0.0 | 0.0 | 0.0 | 1.9 | 1.1 | 0.0 | 0.0 | 0.0 | 0.6 | 0.0 |
| X3 | 1850 | 0.0 | 0.0 | 0.0 | 0.0 | 0.0 | 0.0 | 0.0 | 0.1 | 0.0 | 0.0 |
| X4 | 1800 | 0.0 | 0.0 | 0.0 | 0.0 | 0.1 | 0.0 | 13.6 | 0.0 | 0.0 | 0.0 |
| X5 | 1850 | 0.0 | 0.0 | 0.0 | 0.0 | 0.0 | 0.0 | 0.0 | 0.2 | 0.0 | 0.0 |
| X6 | 1500 | 0.0 | 4.4 | 0.0 | 1.6 | 0.2 | 0.0 | 1.1 | 0.0 | 0.0 | 0.0 |
| X7 | 1550 | 0.0 | 2.3 | 0.0 | 0.0 | 0.0 | 19.7 | 0.0% | 0.0 | 0.0 | 0.2 |
| X8 | 1550 | 0.0 | 5.4 | 0.0 | 1.6 | 0.4 | 0.0 | 0.0 | 0.0 | 0.0 | 0.0 |
| X9 | 1750 | 0.0 | 0.0 | 5.3 | 0.0 | 0.1 | 0.0 | 23.1 | 0.0 | 0.1 | 0.0 |

Once the coating chemistry of an alloy has been determined, the alloy can be evaluated as a single homogenous solid solution material. Ignoring the phases generated in the solidification diagram and considering every arc spray alloy candidate as a single phase solid solution is the result of extensive experimentation and inventive process.

In some embodiments, for soft coatings it can be advantageous for the alloy to have very little solid solution strengthening. Solid solution strengthening increases the hardness of the coating and makes it more difficult to machine. Nevertheless, it can be advantageous to maximize the amount of de-oxidizing elements in the feedstock wire in order to produce a high quality clean coating free of oxide inclusions. Oxide inclusions reduce the adhesion of the coating and are themselves hard and difficult to machine.

The solid solution strengthening effect of carbon and boron and other non-metals can be relatively impactful in comparison to metallic elements. Thus, it is more accurate to apply a 10× multiplier to the concentration of non-metals when evaluating the mole fraction of the alloy for the purposes of predicting the solid solution strengthening effect. Performing this calculation transforms the mole fraction of solutes to a weighted mole fraction of solutes. The solid solution strengthening effect of Ni is effectively 0 considering the similar atomic radius with Fe and the tendency of Ni to encourage austenite, a softer form of steel. Thus, Ni is not considered in the weighted solid solution strengthening for the purposes of this disclosure. However, Ni does affect the FCC-BCC transition temperature which is a component in determining optimum soft arc spray coatings.

In some embodiments, in particular for soft alloys, the weighted mole fraction of solute elements in the coating can be below 20 weight % (or below about 20 weight %). In some embodiments, the weighted mole fraction of solute elements in the coating can be below 10 weight % (or below about 10 weight %). In some embodiments, the weighted mole fraction of solute elements in the coating is below 2 weight % (or below about 2 weight %). In some embodiments, the weighted mole fraction of solute elements in the coating is below 1 weight % (or below about 1 weight %). In some embodiments, the weighted mole fraction of solute elements in the coating is below 0.5 weight % (or below about 0.5 weight %).

In some embodiments, the weighted mole fraction of solute elements in the coating is above 2 weight % (or above about 2 weight %). In some embodiments, the weighted mole fraction of solute elements in the coating is above 5 weight % (or above about 5 weight %). In some embodiments, the weighted mole fraction of solute elements in the coating is above 10 weight % (or above about 10 weight %). In some embodiments, the weighted mole fraction of solute elements in the coating is above 15 weight % (or above about 15 weight %). In some embodiments, the weighted mole fraction of solute elements in the coating is above 20 weight % (or above about 20 weight %). The inclusion of some solute elements can improve some of the properties of a soft alloy.

Alloys X3 and X5 were produced under the intent of manufacturing a soft arc spray wire which could be machined. The weighted mole fractions of the feedstock and coating chemistry for the alloy has been calculated for both alloys and presented in Table 5. As shown, while the weighted mole fraction of solutes in the feedstock is above 15 wt. % for both alloys, the weighted mole fraction of solutes in the coating chemistry is below 1 wt. %. These alloys strike the balance between introducing alloying elements to create a clean low oxide spray environment and the producing a coating which has little hardening agents. In order to find the specific alloys which simultaneously exhibit both these thermodynamic characteristic, it is necessary to use high throughput computation metallurgy to evaluate large compositional ranges containing thousands of alloy candidates.

TABLE 5

| Weighted mole fractions in coatings (coating chemistry is calculated at melting temperature) | |
|---|---|
| Alloy | Weighted Solute Mole Fraction in Coating |
| X3 | 0.2% |
| X4 | 0.3% |
| X5 | 0.1% |
| X9 | 5.5% |

In some embodiments, it can be advantageous for the alloy to be austenitic, in particular for soft alloys. The austenite phase of steel is the softest form, and thus it also advantageous for alloys of this type to be used in surface reclamation applications. In order to model alloys of this type, the coating chemistry can be used in order to predict the austenite to ferrite transition temperature. Alloy X4 is intended to form an austenitic coating alloy in order to achieve low hardness in the coating. As shown in Table 3, the coating chemistry contains 13.53% Nickel, and 0.05% C, both austenite stabilizing elements. These alloying elements drive the austenite to ferrite temperature down to below 1000K (or below about 1000K). As the austenite to ferrite transition temperature is driven lower, the coating is increasingly likely to form an austenite structure.

In some embodiments, the soft alloy can have an austenite phase fraction of at or above 90 volume % (or at or above about 90 volume %). In some embodiments, the soft alloy can have an austenite phase fraction of at or above 95 volume % (or above about 95 volume %). In some embodiments, the soft alloy can have an austenite phase fraction of at or above 99 volume % (or at or above 99 volume %). In some embodiments, the soft alloy can have an austenite phase fraction of 100 volume % (or about 100 volume %).

Figure 3:
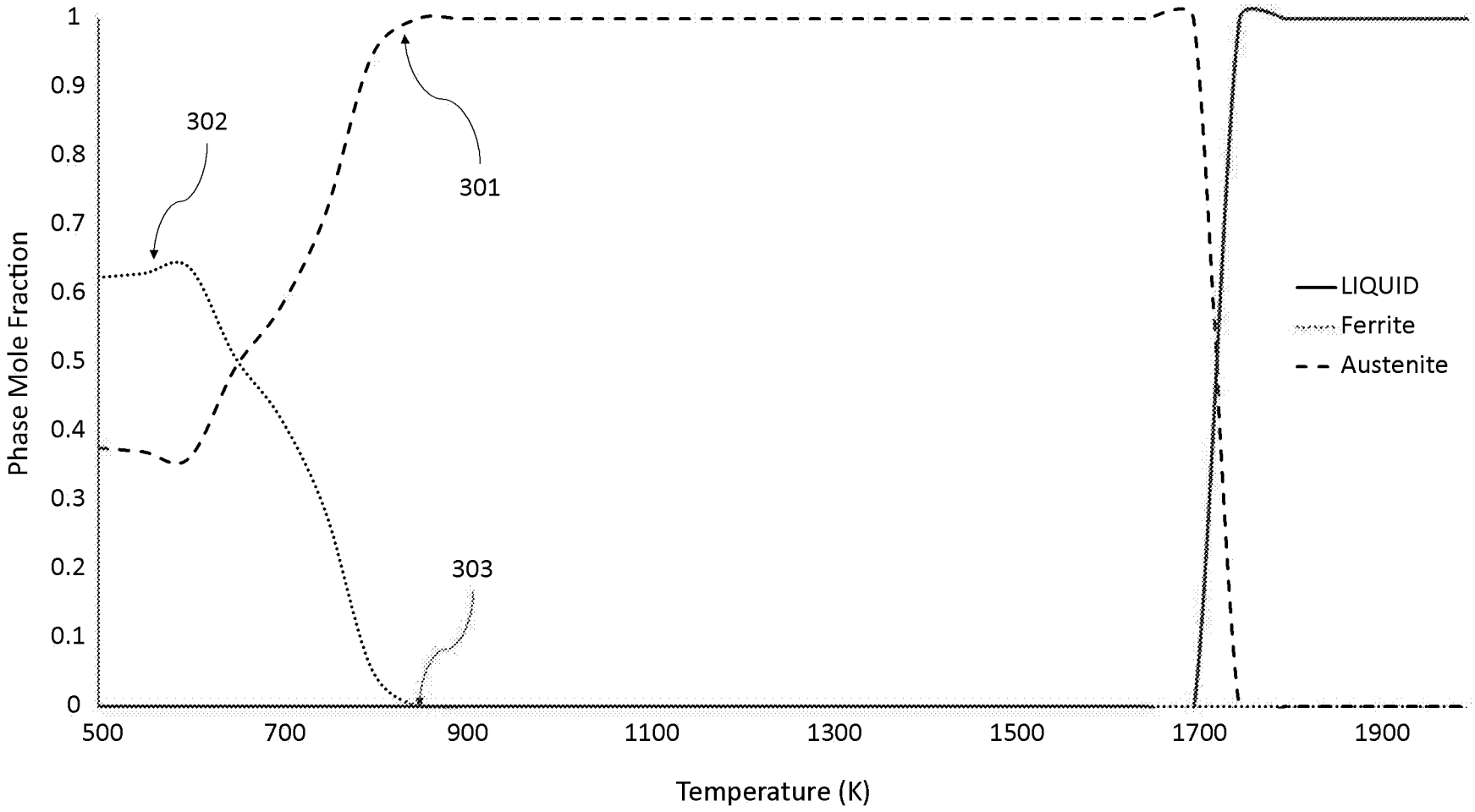
FIG. 3 shows an embodiment of a solidification diagram of Alloy X9.

Alloy X9 can be configured to form an austenitic coating in order to achieve low hardness in the coating. As shown in Table 3 above, the Ni content of the coating chemistry in Alloy X9 computed at 1300K is 23%. As shown in Table 4, the Ni content of the coating chemistry of Alloy X9 computed at the melting temperature is 23.1%. In order to predict how Alloy X9 behaves as a coating, the coating chemistry as computed via the melting temperature technique is shown in FIG. 3. As shown in FIG. 3, the phase diagram contains three phases, liquid, austenite [301] and ferrite [302]. The transition temperature at which austenite transforms to ferrite [303] can be used to determine the final phase of the coating in as-sprayed form. A lower transition temperature indicates increased likelihood for the coating to comprise mostly austenite. The transition temperature of Alloy X9 [303] is 850 K, which indicates a strong likelihood for a fully austenitic coating structure. In some embodiments, the disclosed material can form 90-100% (or about 90 to about 100%) austenite.

In some embodiments, the austenite to ferrite temperature of the alloy is below 1000 K (or below about 1000 K). In some embodiments, the austenite to ferrite temperature is below 950 K (or below about 950 K). In some embodiments, the austenite to ferrite temperature is below 900 K (or below about 900 K).

In some embodiments, it can be advantageous for the alloy to have a very high degree of solid solution strengthening for the purposes of forming a wear resistant coating. In some embodiments, it can be advantageous to achieve this high degree of solid solution strengthening without the use of chromium as an alloying element. In some embodiments, it can be advantageous to achieve this high degree of solid solution strengthening without the use of expensive transition metals such as Nb, Ti, Mo, V, and Mo as alloying elements.

In some embodiments, such as with hard alloys, the weighted mole fraction of solid solution strengthening elements in the coating is above 20 weight % (or above about 20 weight %). In some embodiments, the weighted mole fraction of solid solution strengthening elements in the coating is above 30 weight % (or above about 30 weight %). In some embodiments, the weighted mole fraction of solid solution strengthening elements in the coating is above 50 weight % (or above about 50 weight %). In some embodiments, the weighted mole fraction of solid solution strengthening elements in the coating is above 60 weight % (or above about 60 weight %). In some embodiments, the weighted mole fraction of solid solution strengthening elements in the coating is above 70 weight % (or above about 70 weight %). Table 6 shows the weighted solute mole fraction in the coatings of certain hard alloys.

TABLE 6

Weighted coating mole fraction for coatings (coating chemistry is calculated at melting temperature)

| Alloy | Weighted Solute Mole Fraction in Coating |
|---|---|
| X1 | 58.1% |
| X2 | 21.1% |
| X6 | 59.4% |
| X7 | 43.4% |
| X8 | 70.5% |

In some embodiments, the microstructure of the hard alloys can be 60-90% (or about 60-about 90%) nanocrystalline or amorphous iron. In some embodiments, the microstructure of the hard alloys can contain 10-40% (or about 10-about 40%) carbide, boride or borocarbide precipitates.

Table 7 shows alloys which meet the thermodynamic criteria of alloys intended to form a soft coating. Table 7 shows the feedstock chemistry of the alloy in addition to coating chemistry of the alloy and the corresponding weighted solid mole fraction (denoted as WSS) and FCC-BCC transition temperature (denoted as TransT).

TABLE 7

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M1 | 1.5 | 0.00 | 1.03 | 14.00 | 3.30 | 0.00 | 0.00 | 0.04 | 16.79 | 0.00 | 0.04 | 900 |
| M2 | 1.5 | 0.00 | 1.03 | 16.50 | 3.30 | 0.00 | 0.00 | 0.04 | 19.79 | 0.00 | 0.04 | 900 |
| M3 | 1.5 | 0.00 | 1.03 | 19.00 | 3.30 | 0.00 | 0.00 | 0.04 | 22.79 | 0.00 | 0.04 | 850 |
| M4 | 1.5 | 0.50 | 1.03 | 20.50 | 3.30 | 0.00 | 0.01 | 0.03 | 24.57 | 0.00 | 0.04 | 800 |
| M5 | 1.5 | 0.50 | 1.03 | 21.00 | 3.30 | 0.00 | 0.01 | 0.03 | 25.17 | 0.00 | 0.04 | 800 |
| M6 | 1.5 | 0.50 | 1.03 | 21.50 | 3.30 | 0.00 | 0.01 | 0.03 | 25.77 | 0.00 | 0.04 | 800 |
| M7 | 1.5 | 1.00 | 1.03 | 20.50 | 3.30 | 0.00 | 0.01 | 0.03 | 24.50 | 0.00 | 0.04 | 800 |
| M8 | 1.5 | 1.00 | 1.03 | 19.50 | 3.30 | 0.00 | 0.01 | 0.03 | 23.30 | 0.00 | 0.04 | 800 |
| M9 | 1.5 | 1.00 | 1.03 | 21.50 | 3.30 | 0.00 | 0.01 | 0.03 | 25.70 | 0.00 | 0.04 | 800 |
| M10 | 1.5 | 0.50 | 1.03 | 19.50 | 3.30 | 0.00 | 0.01 | 0.03 | 23.37 | 0.00 | 0.04 | 800 |
| M11 | 1.5 | 1.00 | 1.03 | 20.00 | 3.30 | 0.00 | 0.01 | 0.03 | 23.90 | 0.00 | 0.04 | 800 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M12 | 1.5 | 1.00 | 1.03 | 21.00 | 3.30 | 0.00 | 0.01 | 0.03 | 25.10 | 0.00 | 0.04 | 800 |
| M13 | 1.5 | 0.50 | 1.03 | 20.00 | 3.30 | 0.00 | 0.01 | 0.03 | 23.97 | 0.00 | 0.04 | 800 |
| M14 | 1.5 | 0.50 | 1.03 | 13.50 | 3.30 | 0.00 | 0.01 | 0.03 | 16.18 | 0.00 | 0.04 | 850 |
| M15 | 1.5 | 0.50 | 1.03 | 17.50 | 3.30 | 0.00 | 0.01 | 0.03 | 20.97 | 0.00 | 0.04 | 850 |
| M16 | 1.5 | 0.50 | 1.03 | 18.00 | 3.30 | 0.00 | 0.01 | 0.03 | 21.58 | 0.00 | 0.04 | 800 |
| M17 | 1.5 | 0.50 | 1.03 | 17.00 | 3.30 | 0.00 | 0.01 | 0.03 | 20.37 | 0.00 | 0.04 | 850 |
| M18 | 1.5 | 0.50 | 1.03 | 10.50 | 3.30 | 0.00 | 0.01 | 0.03 | 12.58 | 0.00 | 0.04 | 900 |
| M19 | 1.5 | 0.50 | 1.03 | 11.00 | 3.30 | 0.00 | 0.01 | 0.03 | 13.18 | 0.00 | 0.04 | 900 |
| M20 | 1.5 | 0.50 | 1.03 | 14.50 | 3.30 | 0.00 | 0.01 | 0.03 | 17.37 | 0.00 | 0.04 | 850 |
| M21 | 1.5 | 0.50 | 1.03 | 16.00 | 3.30 | 0.00 | 0.01 | 0.03 | 19.18 | 0.00 | 0.04 | 850 |
| M22 | 1.5 | 0.50 | 1.03 | 18.50 | 3.30 | 0.00 | 0.01 | 0.03 | 22.17 | 0.00 | 0.04 | 800 |
| M23 | 1.5 | 0.50 | 1.03 | 19.00 | 3.30 | 0.00 | 0.01 | 0.03 | 22.77 | 0.00 | 0.04 | 800 |
| M24 | 1.5 | 0.50 | 1.03 | 10.00 | 3.30 | 0.00 | 0.01 | 0.03 | 11.98 | 0.00 | 0.04 | 900 |
| M25 | 1.5 | 0.50 | 1.03 | 11.50 | 3.30 | 0.00 | 0.01 | 0.03 | 13.78 | 0.00 | 0.04 | 900 |
| M26 | 1.5 | 0.50 | 1.03 | 13.00 | 3.30 | 0.00 | 0.01 | 0.03 | 15.58 | 0.00 | 0.04 | 850 |
| M27 | 1.5 | 0.50 | 1.03 | 14.00 | 3.30 | 0.00 | 0.01 | 0.03 | 16.77 | 0.00 | 0.04 | 850 |
| M28 | 1.5 | 0.50 | 1.03 | 15.50 | 3.30 | 0.00 | 0.01 | 0.03 | 18.57 | 0.00 | 0.04 | 850 |
| M29 | 1.5 | 0.50 | 1.03 | 16.50 | 3.30 | 0.00 | 0.01 | 0.03 | 19.78 | 0.00 | 0.04 | 850 |
| M30 | 1.5 | 0.50 | 1.03 | 12.00 | 3.30 | 0.00 | 0.01 | 0.03 | 14.38 | 0.00 | 0.04 | 900 |
| M31 | 1.5 | 0.50 | 1.03 | 12.50 | 3.30 | 0.00 | 0.01 | 0.03 | 14.98 | 0.00 | 0.04 | 900 |
| M32 | 1.5 | 0.50 | 1.03 | 15.00 | 3.30 | 0.00 | 0.01 | 0.03 | 17.97 | 0.00 | 0.04 | 850 |
| M33 | 1.5 | 0.50 | 1.03 | 9.50 | 3.30 | 0.00 | 0.01 | 0.03 | 11.38 | 0.00 | 0.04 | 900 |
| M34 | 1.5 | 1.50 | 1.03 | 19.50 | 3.30 | 0.00 | 0.02 | 0.03 | 23.23 | 0.00 | 0.05 | 800 |
| M35 | 1.5 | 1.50 | 1.03 | 20.50 | 3.30 | 0.00 | 0.02 | 0.03 | 24.42 | 0.00 | 0.05 | 800 |
| M36 | 1.5 | 1.50 | 1.03 | 20.00 | 3.30 | 0.00 | 0.02 | 0.03 | 23.82 | 0.00 | 0.05 | 800 |
| M37 | 1.5 | 1.50 | 1.03 | 21.50 | 3.30 | 0.00 | 0.02 | 0.03 | 25.61 | 0.00 | 0.05 | 800 |
| M38 | 1.5 | 1.50 | 1.03 | 21.00 | 3.30 | 0.00 | 0.02 | 0.03 | 25.02 | 0.00 | 0.05 | 800 |
| M39 | 1.5 | 1.00 | 1.03 | 18.00 | 3.30 | 0.00 | 0.02 | 0.03 | 21.51 | 0.00 | 0.05 | 800 |
| M40 | 1.5 | 1.00 | 1.03 | 15.00 | 3.30 | 0.00 | 0.02 | 0.03 | 17.92 | 0.00 | 0.05 | 850 |
| M41 | 1.5 | 1.00 | 1.03 | 13.50 | 3.30 | 0.00 | 0.02 | 0.03 | 16.13 | 0.00 | 0.05 | 850 |
| M42 | 1.5 | 1.00 | 1.03 | 16.50 | 3.30 | 0.00 | 0.02 | 0.03 | 19.71 | 0.00 | 0.05 | 850 |
| M43 | 1.5 | 1.00 | 1.03 | 17.00 | 3.30 | 0.00 | 0.02 | 0.03 | 20.31 | 0.00 | 0.05 | 850 |
| M44 | 1.5 | 1.00 | 1.03 | 18.50 | 3.30 | 0.00 | 0.02 | 0.03 | 22.11 | 0.00 | 0.05 | 800 |
| M45 | 1.5 | 1.00 | 1.03 | 14.00 | 3.30 | 0.00 | 0.02 | 0.03 | 16.72 | 0.00 | 0.05 | 850 |
| M46 | 1.5 | 1.00 | 1.03 | 14.50 | 3.30 | 0.00 | 0.02 | 0.03 | 17.32 | 0.00 | 0.05 | 850 |
| M47 | 1.5 | 1.00 | 1.03 | 16.00 | 3.30 | 0.00 | 0.02 | 0.03 | 19.12 | 0.00 | 0.05 | 850 |
| M48 | 1.5 | 1.00 | 1.03 | 17.50 | 3.30 | 0.00 | 0.02 | 0.03 | 20.91 | 0.00 | 0.05 | 800 |
| M49 | 1.5 | 1.00 | 1.03 | 19.00 | 3.30 | 0.00 | 0.02 | 0.03 | 22.70 | 0.00 | 0.05 | 800 |
| M50 | 1.5 | 1.00 | 1.03 | 9.50 | 3.30 | 0.00 | 0.02 | 0.03 | 11.35 | 0.00 | 0.05 | 900 |
| M51 | 1.5 | 1.00 | 1.03 | 10.50 | 3.30 | 0.00 | 0.02 | 0.03 | 12.54 | 0.00 | 0.05 | 900 |
| M52 | 1.5 | 1.00 | 1.03 | 11.50 | 3.30 | 0.00 | 0.02 | 0.03 | 13.74 | 0.00 | 0.05 | 900 |
| M53 | 1.5 | 1.00 | 1.03 | 13.00 | 3.30 | 0.00 | 0.02 | 0.03 | 15.53 | 0.00 | 0.05 | 850 |
| M54 | 1.5 | 1.00 | 1.03 | 10.00 | 3.30 | 0.00 | 0.02 | 0.03 | 11.95 | 0.00 | 0.05 | 900 |
| M55 | 1.5 | 1.00 | 1.03 | 11.00 | 3.30 | 0.00 | 0.02 | 0.03 | 13.14 | 0.00 | 0.05 | 900 |
| M56 | 1.5 | 1.00 | 1.03 | 12.00 | 3.30 | 0.00 | 0.02 | 0.03 | 14.33 | 0.00 | 0.05 | 900 |
| M57 | 1.5 | 1.00 | 1.03 | 12.50 | 3.30 | 0.00 | 0.02 | 0.03 | 14.93 | 0.00 | 0.05 | 900 |
| M58 | 1.5 | 1.00 | 1.03 | 15.50 | 3.30 | 0.00 | 0.02 | 0.03 | 18.51 | 0.00 | 0.05 | 850 |
| M59 | 1.5 | 2.00 | 1.03 | 21.00 | 3.30 | 0.00 | 0.03 | 0.03 | 24.94 | 0.00 | 0.06 | 800 |
| M60 | 1.5 | 2.00 | 1.03 | 21.50 | 3.30 | 0.00 | 0.03 | 0.03 | 25.53 | 0.00 | 0.06 | 800 |
| M61 | 1.5 | 2.50 | 1.03 | 21.50 | 3.30 | 0.00 | 0.03 | 0.03 | 25.45 | 0.00 | 0.06 | 800 |
| M62 | 1.5 | 2.00 | 1.03 | 20.50 | 3.30 | 0.00 | 0.03 | 0.03 | 24.34 | 0.00 | 0.06 | 800 |
| M63 | 1.5 | 2.00 | 1.03 | 20.00 | 3.30 | 0.00 | 0.03 | 0.03 | 23.75 | 0.00 | 0.06 | 800 |
| M64 | 1.5 | 2.50 | 1.03 | 21.00 | 3.30 | 0.00 | 0.03 | 0.03 | 24.86 | 0.00 | 0.06 | 800 |
| M65 | 1.5 | 1.50 | 1.03 | 14.50 | 3.30 | 0.00 | 0.03 | 0.03 | 17.27 | 0.00 | 0.06 | 850 |
| M66 | 1.5 | 1.50 | 1.03 | 16.50 | 3.30 | 0.00 | 0.03 | 0.03 | 19.65 | 0.00 | 0.06 | 850 |
| M67 | 1.5 | 1.50 | 1.03 | 17.50 | 3.30 | 0.00 | 0.03 | 0.03 | 20.84 | 0.00 | 0.06 | 800 |
| M68 | 1.5 | 1.50 | 1.03 | 18.50 | 3.30 | 0.00 | 0.03 | 0.03 | 22.04 | 0.00 | 0.06 | 800 |
| M69 | 1.5 | 1.50 | 1.03 | 13.50 | 3.30 | 0.00 | 0.03 | 0.03 | 16.08 | 0.00 | 0.06 | 850 |
| M70 | 1.5 | 1.50 | 1.03 | 15.50 | 3.30 | 0.00 | 0.03 | 0.03 | 18.46 | 0.00 | 0.06 | 850 |
| M71 | 1.5 | 1.50 | 1.03 | 12.50 | 3.30 | 0.00 | 0.03 | 0.03 | 14.89 | 0.00 | 0.06 | 900 |
| M72 | 1.5 | 1.50 | 1.03 | 12.00 | 3.30 | 0.00 | 0.03 | 0.03 | 14.29 | 0.00 | 0.06 | 900 |
| M73 | 1.5 | 1.50 | 1.03 | 13.00 | 3.30 | 0.00 | 0.03 | 0.03 | 15.48 | 0.00 | 0.06 | 850 |
| M74 | 1.5 | 1.50 | 1.03 | 14.00 | 3.30 | 0.00 | 0.03 | 0.03 | 16.67 | 0.00 | 0.06 | 850 |
| M75 | 1.5 | 1.50 | 1.03 | 15.00 | 3.30 | 0.00 | 0.03 | 0.03 | 17.86 | 0.00 | 0.06 | 850 |
| M76 | 1.5 | 1.50 | 1.03 | 16.00 | 3.30 | 0.00 | 0.03 | 0.03 | 19.06 | 0.00 | 0.06 | 850 |
| M77 | 1.5 | 1.50 | 1.03 | 17.00 | 3.30 | 0.00 | 0.03 | 0.03 | 20.25 | 0.00 | 0.06 | 850 |
| M78 | 1.5 | 1.50 | 1.03 | 18.00 | 3.30 | 0.00 | 0.03 | 0.03 | 21.44 | 0.00 | 0.06 | 800 |
| M79 | 1.5 | 1.50 | 1.03 | 19.00 | 3.30 | 0.00 | 0.03 | 0.03 | 22.63 | 0.00 | 0.06 | 800 |
| M80 | 1.5 | 2.50 | 1.03 | 20.00 | 3.30 | 0.00 | 0.04 | 0.03 | 23.68 | 0.00 | 0.07 | 800 |
| M81 | 1.5 | 2.50 | 1.03 | 20.50 | 3.30 | 0.00 | 0.04 | 0.03 | 24.27 | 0.00 | 0.07 | 800 |
| M82 | 1.5 | 1.50 | 1.03 | 9.50 | 3.30 | 0.00 | 0.04 | 0.03 | 11.32 | 0.00 | 0.07 | 900 |
| M83 | 1.5 | 1.50 | 1.03 | 10.50 | 3.30 | 0.00 | 0.04 | 0.03 | 12.51 | 0.00 | 0.07 | 900 |
| M84 | 1.5 | 1.50 | 1.03 | 11.50 | 3.30 | 0.00 | 0.04 | 0.03 | 13.70 | 0.00 | 0.07 | 900 |
| M85 | 1.5 | 1.50 | 1.03 | 10.00 | 3.30 | 0.00 | 0.04 | 0.03 | 11.91 | 0.00 | 0.07 | 900 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M86 | 1.5 | 1.50 | 1.03 | 11.00 | 3.30 | 0.00 | 0.04 | 0.03 | 13.10 | 0.00 | 0.07 | 900 |
| M87 | 1.5 | 2.00 | 1.03 | 16.50 | 3.30 | 0.00 | 0.04 | 0.03 | 19.59 | 0.00 | 0.07 | 850 |
| M88 | 1.5 | 2.00 | 1.03 | 17.00 | 3.30 | 0.00 | 0.04 | 0.03 | 20.18 | 0.00 | 0.07 | 850 |
| M89 | 1.5 | 2.00 | 1.03 | 17.50 | 3.30 | 0.00 | 0.04 | 0.03 | 20.78 | 0.00 | 0.07 | 800 |
| M90 | 1.5 | 2.00 | 1.03 | 18.00 | 3.30 | 0.00 | 0.04 | 0.03 | 21.37 | 0.00 | 0.07 | 800 |
| M91 | 1.5 | 2.00 | 1.03 | 15.50 | 3.30 | 0.00 | 0.04 | 0.03 | 18.40 | 0.00 | 0.07 | 850 |
| M92 | 1.5 | 2.00 | 1.03 | 16.00 | 3.30 | 0.00 | 0.04 | 0.03 | 19.00 | 0.00 | 0.07 | 850 |
| M93 | 1.5 | 3.00 | 1.03 | 20.00 | 3.30 | 0.00 | 0.05 | 0.03 | 23.61 | 0.00 | 0.08 | 800 |
| M94 | 1.5 | 3.00 | 1.03 | 20.50 | 3.30 | 0.00 | 0.05 | 0.03 | 24.20 | 0.00 | 0.08 | 800 |
| M95 | 1.5 | 3.00 | 1.03 | 21.00 | 3.30 | 0.00 | 0.05 | 0.03 | 24.79 | 0.00 | 0.08 | 800 |
| M96 | 1.5 | 3.00 | 1.03 | 21.50 | 3.30 | 0.00 | 0.05 | 0.03 | 25.38 | 0.00 | 0.08 | 800 |
| M97 | 1.5 | 2.00 | 1.03 | 13.50 | 3.30 | 0.00 | 0.05 | 0.03 | 16.03 | 0.00 | 0.08 | 850 |
| M98 | 1.5 | 2.00 | 1.03 | 12.00 | 3.30 | 0.00 | 0.05 | 0.03 | 14.25 | 0.00 | 0.08 | 900 |
| M99 | 1.5 | 2.00 | 1.03 | 18.50 | 3.30 | 0.00 | 0.04 | 0.04 | 21.96 | 0.00 | 0.08 | 800 |
| M100 | 1.5 | 2.00 | 1.03 | 15.00 | 3.30 | 0.00 | 0.05 | 0.03 | 17.81 | 0.00 | 0.08 | 850 |
| M101 | 1.5 | 2.00 | 1.03 | 19.00 | 3.30 | 0.00 | 0.04 | 0.04 | 22.56 | 0.00 | 0.08 | 800 |
| M102 | 1.5 | 2.00 | 1.03 | 19.50 | 3.30 | 0.00 | 0.04 | 0.04 | 23.15 | 0.00 | 0.08 | 800 |
| M103 | 1.5 | 2.00 | 1.03 | 9.50 | 3.30 | 0.00 | 0.05 | 0.03 | 11.28 | 0.00 | 0.08 | 900 |
| M104 | 1.5 | 2.00 | 1.03 | 13.00 | 3.30 | 0.00 | 0.05 | 0.03 | 15.43 | 0.00 | 0.08 | 850 |
| M105 | 1.5 | 2.00 | 1.03 | 10.50 | 3.30 | 0.00 | 0.05 | 0.03 | 12.47 | 0.00 | 0.08 | 900 |
| M106 | 1.5 | 2.00 | 1.03 | 11.00 | 3.30 | 0.00 | 0.05 | 0.03 | 13.06 | 0.00 | 0.08 | 900 |
| M107 | 1.5 | 2.00 | 1.03 | 11.50 | 3.30 | 0.00 | 0.05 | 0.03 | 13.65 | 0.00 | 0.08 | 900 |
| M108 | 1.5 | 2.00 | 1.03 | 12.50 | 3.30 | 0.00 | 0.05 | 0.03 | 14.84 | 0.00 | 0.08 | 900 |
| M109 | 1.5 | 2.00 | 1.03 | 14.00 | 3.30 | 0.00 | 0.05 | 0.03 | 16.62 | 0.00 | 0.08 | 850 |
| M110 | 1.5 | 2.00 | 1.03 | 14.50 | 3.30 | 0.00 | 0.05 | 0.03 | 17.21 | 0.00 | 0.08 | 850 |
| M111 | 1.5 | 2.00 | 1.03 | 10.00 | 3.30 | 0.00 | 0.05 | 0.03 | 11.87 | 0.00 | 0.08 | 900 |
| M112 | 1.5 | 2.50 | 1.03 | 16.00 | 3.30 | 0.00 | 0.06 | 0.03 | 18.94 | 0.00 | 0.09 | 850 |
| M113 | 1.5 | 2.50 | 1.03 | 12.00 | 3.30 | 0.00 | 0.06 | 0.03 | 14.21 | 0.00 | 0.09 | 900 |
| M114 | 1.5 | 2.50 | 1.03 | 15.00 | 3.30 | 0.00 | 0.06 | 0.03 | 17.76 | 0.00 | 0.09 | 850 |
| M115 | 1.5 | 2.50 | 1.03 | 15.50 | 3.30 | 0.00 | 0.06 | 0.03 | 18.35 | 0.00 | 0.09 | 850 |
| M116 | 1.5 | 2.50 | 1.03 | 12.50 | 3.30 | 0.00 | 0.06 | 0.03 | 14.80 | 0.00 | 0.09 | 900 |
| M117 | 1.5 | 2.50 | 1.03 | 11.50 | 3.30 | 0.00 | 0.06 | 0.03 | 13.61 | 0.00 | 0.09 | 900 |
| M118 | 1.5 | 2.50 | 1.03 | 13.00 | 3.30 | 0.00 | 0.06 | 0.03 | 15.39 | 0.00 | 0.09 | 900 |
| M119 | 1.5 | 2.50 | 1.03 | 14.50 | 3.30 | 0.00 | 0.06 | 0.03 | 17.16 | 0.00 | 0.09 | 850 |
| M120 | 1.5 | 2.50 | 1.03 | 11.00 | 3.30 | 0.00 | 0.06 | 0.03 | 13.02 | 0.00 | 0.09 | 900 |
| M121 | 1.5 | 2.50 | 1.03 | 13.50 | 3.30 | 0.00 | 0.06 | 0.03 | 15.98 | 0.00 | 0.09 | 850 |
| M122 | 1.5 | 2.50 | 1.03 | 14.00 | 3.30 | 0.00 | 0.06 | 0.03 | 16.57 | 0.00 | 0.09 | 850 |
| M123 | 1.5 | 3.50 | 1.03 | 21.00 | 3.30 | 0.00 | 0.07 | 0.03 | 24.72 | 0.00 | 0.10 | 800 |
| M124 | 1.5 | 3.50 | 1.03 | 20.50 | 3.30 | 0.00 | 0.07 | 0.03 | 24.13 | 0.00 | 0.10 | 800 |
| M125 | 1.5 | 3.50 | 1.03 | 21.50 | 3.30 | 0.00 | 0.07 | 0.03 | 25.30 | 0.00 | 0.10 | 800 |
| M126 | 1.5 | 2.50 | 1.03 | 16.50 | 3.30 | 0.00 | 0.06 | 0.04 | 19.53 | 0.00 | 0.10 | 850 |
| M127 | 1.5 | 2.50 | 1.03 | 17.00 | 3.30 | 0.00 | 0.06 | 0.04 | 20.12 | 0.00 | 0.10 | 850 |
| M128 | 1.5 | 2.50 | 1.03 | 18.50 | 3.30 | 0.00 | 0.06 | 0.04 | 21.90 | 0.00 | 0.10 | 800 |
| M129 | 1.5 | 2.50 | 1.03 | 19.00 | 3.30 | 0.00 | 0.06 | 0.04 | 22.49 | 0.00 | 0.10 | 800 |
| M130 | 1.5 | 2.50 | 1.03 | 19.50 | 3.30 | 0.00 | 0.06 | 0.04 | 23.08 | 0.00 | 0.10 | 800 |
| M131 | 1.5 | 2.50 | 1.03 | 10.50 | 3.30 | 0.00 | 0.07 | 0.03 | 12.43 | 0.00 | 0.10 | 900 |
| M132 | 1.5 | 2.50 | 1.03 | 9.50 | 3.30 | 0.00 | 0.07 | 0.03 | 11.25 | 0.00 | 0.10 | 900 |
| M133 | 1.5 | 2.50 | 1.03 | 10.00 | 3.30 | 0.00 | 0.07 | 0.03 | 11.84 | 0.00 | 0.10 | 900 |
| M134 | 1.5 | 2.50 | 1.03 | 17.50 | 3.30 | 0.00 | 0.06 | 0.04 | 20.71 | 0.00 | 0.10 | 850 |
| M135 | 1.5 | 2.50 | 1.03 | 18.00 | 3.30 | 0.00 | 0.06 | 0.04 | 21.30 | 0.00 | 0.10 | 800 |
| M136 | 1.5 | 3.00 | 1.03 | 12.50 | 3.30 | 0.00 | 0.08 | 0.03 | 14.75 | 0.00 | 0.11 | 900 |
| M137 | 1.5 | 3.00 | 1.03 | 13.00 | 3.30 | 0.00 | 0.08 | 0.03 | 15.34 | 0.00 | 0.11 | 900 |
| M138 | 1.5 | 3.00 | 1.03 | 13.50 | 3.30 | 0.00 | 0.08 | 0.03 | 15.93 | 0.00 | 0.11 | 850 |
| M139 | 1.5 | 3.00 | 1.03 | 14.00 | 3.30 | 0.00 | 0.08 | 0.03 | 16.52 | 0.00 | 0.11 | 850 |
| M140 | 1.5 | 3.00 | 1.03 | 10.00 | 3.30 | 0.00 | 0.09 | 0.03 | 11.81 | 0.00 | 0.12 | 900 |
| M141 | 1.5 | 3.00 | 1.03 | 9.50 | 3.30 | 0.00 | 0.09 | 0.03 | 11.22 | 0.00 | 0.12 | 900 |
| M142 | 1.5 | 3.00 | 1.03 | 15.00 | 3.30 | 0.00 | 0.08 | 0.04 | 17.70 | 0.00 | 0.12 | 850 |
| M143 | 1.5 | 3.00 | 1.03 | 17.00 | 3.30 | 0.00 | 0.08 | 0.04 | 20.06 | 0.00 | 0.12 | 850 |
| M144 | 1.5 | 3.00 | 1.03 | 17.50 | 3.30 | 0.00 | 0.08 | 0.04 | 20.65 | 0.00 | 0.12 | 850 |
| M145 | 1.5 | 3.00 | 1.03 | 18.50 | 3.30 | 0.00 | 0.08 | 0.04 | 21.83 | 0.00 | 0.12 | 800 |
| M146 | 1.5 | 3.00 | 1.03 | 19.00 | 3.30 | 0.00 | 0.08 | 0.04 | 22.42 | 0.00 | 0.12 | 800 |
| M147 | 1.5 | 3.00 | 1.03 | 19.50 | 3.30 | 0.00 | 0.08 | 0.04 | 23.01 | 0.00 | 0.12 | 800 |
| M148 | 1.5 | 3.00 | 1.03 | 15.50 | 3.30 | 0.00 | 0.08 | 0.04 | 18.29 | 0.00 | 0.12 | 850 |
| M149 | 1.5 | 3.00 | 1.03 | 16.00 | 3.30 | 0.00 | 0.08 | 0.04 | 18.88 | 0.00 | 0.12 | 850 |
| M150 | 1.5 | 3.00 | 1.03 | 16.50 | 3.30 | 0.00 | 0.08 | 0.04 | 19.47 | 0.00 | 0.12 | 850 |
| M151 | 1.5 | 3.00 | 1.03 | 18.00 | 3.30 | 0.00 | 0.08 | 0.04 | 21.24 | 0.00 | 0.12 | 800 |
| M152 | 1.5 | 3.00 | 1.03 | 10.50 | 3.30 | 0.00 | 0.09 | 0.03 | 12.39 | 0.00 | 0.12 | 900 |
| M153 | 1.5 | 3.00 | 1.03 | 11.00 | 3.30 | 0.00 | 0.09 | 0.03 | 12.98 | 0.00 | 0.12 | 900 |
| M154 | 1.5 | 3.00 | 1.03 | 11.50 | 3.30 | 0.00 | 0.09 | 0.03 | 13.57 | 0.00 | 0.12 | 900 |
| M155 | 1.5 | 3.00 | 1.03 | 12.00 | 3.30 | 0.00 | 0.09 | 0.03 | 14.16 | 0.00 | 0.12 | 900 |
| M156 | 1.5 | 3.00 | 1.03 | 14.50 | 3.30 | 0.00 | 0.08 | 0.04 | 17.11 | 0.00 | 0.12 | 850 |
| M157 | 1.5 | 4.00 | 1.03 | 21.00 | 3.30 | 0.00 | 0.10 | 0.03 | 24.65 | 0.00 | 0.13 | 800 |
| M158 | 1.5 | 4.00 | 1.03 | 21.50 | 3.30 | 0.00 | 0.10 | 0.03 | 25.23 | 0.00 | 0.13 | 800 |
| M159 | 1.5 | 4.00 | 1.03 | 22.00 | 3.30 | 0.00 | 0.10 | 0.03 | 25.82 | 0.00 | 0.13 | 800 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M160 | 1.5 | 4.00 | 1.03 | 20.50 | 3.30 | 0.00 | 0.10 | 0.03 | 24.06 | 0.00 | 0.13 | 800 |
| M161 | 1.5 | 3.50 | 1.03 | 20.00 | 3.30 | 0.00 | 0.10 | 0.04 | 23.54 | 0.00 | 0.14 | 800 |
| M162 | 1.5 | 0.00 | 1.03 | 22.50 | 3.30 | 0.00 | 0.00 | 0.04 | 26.99 | 0.11 | 0.15 | 800 |
| M163 | 1.5 | 3.50 | 1.03 | 14.50 | 3.30 | 0.00 | 0.11 | 0.04 | 17.07 | 0.00 | 0.15 | 850 |
| M164 | 1.5 | 3.50 | 1.03 | 16.50 | 3.30 | 0.00 | 0.11 | 0.04 | 19.42 | 0.00 | 0.15 | 850 |
| M165 | 1.5 | 3.50 | 1.03 | 17.00 | 3.30 | 0.00 | 0.11 | 0.04 | 20.01 | 0.00 | 0.15 | 850 |
| M166 | 1.5 | 3.50 | 1.03 | 17.50 | 3.30 | 0.00 | 0.11 | 0.04 | 20.60 | 0.00 | 0.15 | 850 |
| M167 | 1.5 | 3.50 | 1.03 | 18.50 | 3.30 | 0.00 | 0.11 | 0.04 | 21.77 | 0.00 | 0.15 | 800 |
| M168 | 1.5 | 3.50 | 1.03 | 19.00 | 3.30 | 0.00 | 0.11 | 0.04 | 22.36 | 0.00 | 0.15 | 800 |
| M169 | 1.5 | 3.50 | 1.03 | 19.50 | 3.30 | 0.00 | 0.11 | 0.04 | 22.95 | 0.00 | 0.15 | 800 |
| M170 | 1.5 | 3.50 | 1.03 | 14.00 | 3.30 | 0.00 | 0.11 | 0.04 | 16.48 | 0.00 | 0.15 | 850 |
| M171 | 1.5 | 3.50 | 1.03 | 11.00 | 3.30 | 0.00 | 0.12 | 0.03 | 12.95 | 0.00 | 0.15 | 900 |
| M172 | 1.5 | 3.50 | 1.03 | 11.50 | 3.30 | 0.00 | 0.12 | 0.03 | 13.54 | 0.00 | 0.15 | 900 |
| M173 | 1.5 | 3.50 | 1.03 | 15.00 | 3.30 | 0.00 | 0.11 | 0.04 | 17.65 | 0.00 | 0.15 | 850 |
| M174 | 1.5 | 3.50 | 1.03 | 15.50 | 3.30 | 0.00 | 0.11 | 0.04 | 18.24 | 0.00 | 0.15 | 850 |
| M175 | 1.5 | 3.50 | 1.03 | 18.00 | 3.30 | 0.00 | 0.11 | 0.04 | 21.18 | 0.00 | 0.15 | 800 |
| M176 | 1.5 | 3.50 | 1.03 | 16.00 | 3.30 | 0.00 | 0.11 | 0.04 | 18.83 | 0.00 | 0.15 | 850 |
| M177 | 1.5 | 3.50 | 1.03 | 9.50 | 3.30 | 0.00 | 0.12 | 0.03 | 11.18 | 0.00 | 0.15 | 900 |
| M178 | 1.5 | 3.50 | 1.03 | 10.50 | 3.30 | 0.00 | 0.12 | 0.03 | 12.36 | 0.00 | 0.15 | 900 |
| M179 | 1.5 | 3.50 | 1.03 | 12.00 | 3.30 | 0.00 | 0.12 | 0.03 | 14.12 | 0.00 | 0.15 | 900 |
| M180 | 1.5 | 3.50 | 1.03 | 12.50 | 3.30 | 0.00 | 0.12 | 0.03 | 14.71 | 0.00 | 0.15 | 900 |
| M181 | 1.5 | 3.50 | 1.03 | 10.00 | 3.30 | 0.00 | 0.12 | 0.03 | 11.77 | 0.00 | 0.15 | 900 |
| M182 | 1.5 | 3.50 | 1.03 | 13.00 | 3.30 | 0.00 | 0.12 | 0.04 | 15.30 | 0.00 | 0.16 | 900 |
| M183 | 1.5 | 3.50 | 1.03 | 13.50 | 3.30 | 0.00 | 0.12 | 0.04 | 15.89 | 0.00 | 0.16 | 850 |
| M184 | 1.5 | 4.00 | 1.03 | 19.50 | 3.30 | 0.00 | 0.15 | 0.04 | 22.89 | 0.00 | 0.19 | 800 |
| M185 | 1.5 | 4.00 | 1.03 | 20.00 | 3.30 | 0.00 | 0.15 | 0.04 | 23.47 | 0.00 | 0.19 | 800 |
| M186 | 1.5 | 4.50 | 1.03 | 20.50 | 3.30 | 0.00 | 0.17 | 0.03 | 24.00 | 0.00 | 0.20 | 800 |
| M187 | 1.5 | 4.50 | 1.03 | 21.50 | 3.30 | 0.00 | 0.17 | 0.03 | 25.17 | 0.00 | 0.20 | 800 |
| M188 | 1.5 | 4.50 | 1.03 | 21.00 | 3.30 | 0.00 | 0.17 | 0.03 | 24.59 | 0.00 | 0.20 | 800 |
| M189 | 1.5 | 4.00 | 1.03 | 16.50 | 3.30 | 0.00 | 0.16 | 0.04 | 19.37 | 0.00 | 0.20 | 850 |
| M190 | 1.5 | 4.00 | 1.03 | 17.00 | 3.30 | 0.00 | 0.16 | 0.04 | 19.95 | 0.00 | 0.20 | 850 |
| M191 | 1.5 | 4.00 | 1.03 | 19.00 | 3.30 | 0.00 | 0.16 | 0.04 | 22.30 | 0.00 | 0.20 | 800 |
| M192 | 1.5 | 4.00 | 1.03 | 15.00 | 3.30 | 0.00 | 0.16 | 0.04 | 17.61 | 0.00 | 0.20 | 850 |
| M193 | 1.5 | 4.00 | 1.03 | 18.50 | 3.30 | 0.00 | 0.16 | 0.04 | 21.71 | 0.00 | 0.20 | 800 |
| M194 | 1.5 | 4.00 | 1.03 | 16.00 | 3.30 | 0.00 | 0.16 | 0.04 | 18.78 | 0.00 | 0.20 | 850 |
| M195 | 1.5 | 4.00 | 1.03 | 17.50 | 3.30 | 0.00 | 0.16 | 0.04 | 20.54 | 0.00 | 0.20 | 850 |
| M196 | 1.5 | 4.00 | 1.03 | 18.00 | 3.30 | 0.00 | 0.16 | 0.04 | 21.13 | 0.00 | 0.20 | 800 |
| M197 | 1.5 | 4.00 | 1.03 | 15.50 | 3.30 | 0.00 | 0.16 | 0.04 | 18.19 | 0.00 | 0.20 | 850 |
| M198 | 1.5 | 4.50 | 1.03 | 22.00 | 3.30 | 0.00 | 0.17 | 0.04 | 25.76 | 0.00 | 0.21 | 800 |
| M199 | 1.5 | 4.00 | 1.03 | 13.00 | 3.30 | 0.00 | 0.17 | 0.04 | 15.26 | 0.00 | 0.21 | 900 |
| M200 | 1.5 | 4.00 | 1.03 | 9.50 | 3.30 | 0.00 | 0.18 | 0.03 | 11.15 | 0.00 | 0.21 | 900 |
| M201 | 1.5 | 4.00 | 1.03 | 13.50 | 3.30 | 0.00 | 0.17 | 0.04 | 15.85 | 0.00 | 0.21 | 850 |
| M202 | 1.5 | 4.00 | 1.03 | 10.50 | 3.30 | 0.00 | 0.18 | 0.03 | 12.32 | 0.00 | 0.21 | 900 |
| M203 | 1.5 | 4.00 | 1.03 | 11.50 | 3.30 | 0.00 | 0.17 | 0.04 | 13.50 | 0.00 | 0.21 | 900 |
| M204 | 1.5 | 4.00 | 1.03 | 12.00 | 3.30 | 0.00 | 0.17 | 0.04 | 14.09 | 0.00 | 0.21 | 900 |
| M205 | 1.5 | 4.00 | 1.03 | 14.00 | 3.30 | 0.00 | 0.17 | 0.04 | 16.43 | 0.00 | 0.21 | 850 |
| M206 | 1.5 | 4.00 | 1.03 | 14.50 | 3.30 | 0.00 | 0.17 | 0.04 | 17.02 | 0.00 | 0.21 | 850 |
| M207 | 1.5 | 4.00 | 1.03 | 12.50 | 3.30 | 0.00 | 0.17 | 0.04 | 14.67 | 0.00 | 0.21 | 900 |
| M208 | 1.5 | 4.00 | 1.03 | 10.00 | 3.30 | 0.00 | 0.18 | 0.03 | 11.74 | 0.00 | 0.21 | 900 |
| M209 | 1.5 | 4.00 | 1.03 | 11.00 | 3.30 | 0.00 | 0.17 | 0.04 | 12.91 | 0.00 | 0.21 | 900 |
| M210 | 1.5 | 4.50 | 1.03 | 19.00 | 3.30 | 0.00 | 0.24 | 0.04 | 22.25 | 0.00 | 0.28 | 800 |
| M211 | 1.5 | 4.50 | 1.03 | 19.50 | 3.30 | 0.00 | 0.24 | 0.04 | 22.83 | 0.00 | 0.28 | 800 |
| M212 | 1.5 | 4.50 | 1.03 | 20.00 | 3.30 | 0.00 | 0.24 | 0.04 | 23.42 | 0.00 | 0.28 | 800 |
| M213 | 1.5 | 4.50 | 1.03 | 17.00 | 3.30 | 0.00 | 0.25 | 0.04 | 19.91 | 0.00 | 0.29 | 850 |
| M214 | 1.5 | 4.50 | 1.03 | 18.00 | 3.30 | 0.00 | 0.25 | 0.04 | 21.08 | 0.00 | 0.29 | 800 |
| M215 | 1.5 | 4.50 | 1.03 | 18.50 | 3.30 | 0.00 | 0.25 | 0.04 | 21.66 | 0.00 | 0.29 | 800 |
| M216 | 1.5 | 4.50 | 1.03 | 16.00 | 3.30 | 0.00 | 0.25 | 0.04 | 18.74 | 0.00 | 0.29 | 850 |
| M217 | 1.5 | 4.50 | 1.03 | 16.50 | 3.30 | 0.00 | 0.25 | 0.04 | 19.32 | 0.00 | 0.29 | 850 |
| M218 | 1.5 | 4.50 | 1.03 | 17.50 | 3.30 | 0.00 | 0.25 | 0.04 | 20.49 | 0.00 | 0.29 | 850 |
| M219 | 1.5 | 4.50 | 1.03 | 13.00 | 3.30 | 0.00 | 0.26 | 0.04 | 15.22 | 0.00 | 0.30 | 900 |
| M220 | 1.5 | 4.50 | 1.03 | 14.00 | 3.30 | 0.00 | 0.26 | 0.04 | 16.39 | 0.00 | 0.30 | 850 |
| M221 | 1.5 | 4.50 | 1.03 | 15.00 | 3.30 | 0.00 | 0.26 | 0.04 | 17.57 | 0.00 | 0.30 | 850 |
| M222 | 1.5 | 4.50 | 1.03 | 15.50 | 3.30 | 0.00 | 0.26 | 0.04 | 18.15 | 0.00 | 0.30 | 850 |
| M223 | 1.5 | 4.50 | 1.03 | 13.50 | 3.30 | 0.00 | 0.26 | 0.04 | 15.81 | 0.00 | 0.30 | 850 |
| M224 | 1.5 | 4.50 | 1.03 | 14.50 | 3.30 | 0.00 | 0.26 | 0.04 | 16.98 | 0.00 | 0.30 | 850 |
| M225 | 1.5 | 4.50 | 1.03 | 11.50 | 3.30 | 0.00 | 0.27 | 0.04 | 13.46 | 0.00 | 0.31 | 900 |
| M226 | 1.5 | 4.50 | 1.03 | 12.00 | 3.30 | 0.00 | 0.27 | 0.04 | 14.05 | 0.00 | 0.31 | 900 |
| M227 | 1.5 | 4.50 | 1.03 | 12.50 | 3.30 | 0.00 | 0.27 | 0.04 | 14.63 | 0.00 | 0.31 | 900 |
| M228 | 1.5 | 4.50 | 1.03 | 11.00 | 3.30 | 0.00 | 0.27 | 0.04 | 12.88 | 0.00 | 0.31 | 900 |
| M229 | 1.5 | 4.50 | 1.03 | 10.50 | 3.30 | 0.00 | 0.27 | 0.04 | 12.29 | 0.00 | 0.31 | 900 |
| M230 | 1.5 | 4.50 | 1.03 | 10.00 | 3.30 | 0.00 | 0.28 | 0.04 | 11.70 | 0.00 | 0.32 | 900 |
| M231 | 1.5 | 4.50 | 1.03 | 9.50 | 3.30 | 0.00 | 0.28 | 0.04 | 11.12 | 0.00 | 0.32 | 900 |
| M232 | 1.5 | 5.00 | 1.03 | 22.00 | 3.30 | 0.00 | 0.31 | 0.04 | 25.70 | 0.00 | 0.35 | 800 |
| M233 | 1.5 | 5.00 | 1.03 | 21.50 | 3.30 | 0.00 | 0.31 | 0.04 | 25.12 | 0.00 | 0.35 | 800 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M234 | 1.5 | 5.00 | 1.03 | 21.00 | 3.30 | 0.00 | 0.32 | 0.04 | 24.52 | 0.00 | 0.36 | 800 |
| M235 | 1.5 | 5.00 | 1.03 | 20.50 | 3.30 | 0.00 | 0.39 | 0.05 | 23.94 | 0.01 | 0.45 | 800 |
| M236 | 1.5 | 5.00 | 1.03 | 19.50 | 3.30 | 0.00 | 0.40 | 0.04 | 22.78 | 0.01 | 0.45 | 800 |
| M237 | 1.5 | 5.00 | 1.03 | 19.00 | 3.30 | 0.00 | 0.40 | 0.04 | 22.20 | 0.01 | 0.45 | 800 |
| M238 | 1.5 | 5.00 | 1.03 | 18.00 | 3.30 | 0.00 | 0.40 | 0.04 | 21.03 | 0.01 | 0.45 | 800 |
| M239 | 1.5 | 5.00 | 1.03 | 18.50 | 3.30 | 0.00 | 0.40 | 0.04 | 21.62 | 0.01 | 0.45 | 800 |
| M240 | 1.5 | 5.00 | 1.03 | 20.00 | 3.30 | 0.00 | 0.40 | 0.05 | 23.36 | 0.01 | 0.46 | 800 |
| M241 | 1.5 | 5.00 | 1.03 | 17.50 | 3.30 | 0.00 | 0.41 | 0.04 | 20.44 | 0.01 | 0.46 | 850 |
| M242 | 1.5 | 5.00 | 1.03 | 17.00 | 3.30 | 0.00 | 0.41 | 0.04 | 19.86 | 0.01 | 0.46 | 850 |
| M243 | 1.5 | 5.00 | 1.03 | 16.00 | 3.30 | 0.00 | 0.41 | 0.04 | 18.70 | 0.01 | 0.46 | 850 |
| M244 | 1.5 | 5.00 | 1.03 | 16.50 | 3.30 | 0.00 | 0.41 | 0.04 | 19.28 | 0.01 | 0.46 | 850 |
| M245 | 1.5 | 5.00 | 1.03 | 15.50 | 3.30 | 0.00 | 0.42 | 0.04 | 18.11 | 0.01 | 0.47 | 850 |
| M246 | 1.5 | 5.00 | 1.03 | 14.50 | 3.30 | 0.00 | 0.42 | 0.04 | 16.94 | 0.01 | 0.47 | 850 |
| M247 | 1.5 | 5.00 | 1.03 | 15.00 | 3.30 | 0.00 | 0.42 | 0.04 | 17.52 | 0.01 | 0.47 | 850 |
| M248 | 1.5 | 5.00 | 1.03 | 14.00 | 3.30 | 0.00 | 0.42 | 0.04 | 16.35 | 0.01 | 0.47 | 850 |
| M249 | 1.5 | 5.00 | 1.03 | 13.50 | 3.30 | 0.00 | 0.43 | 0.04 | 15.77 | 0.01 | 0.48 | 850 |
| M250 | 1.5 | 5.00 | 1.03 | 13.00 | 3.30 | 0.00 | 0.43 | 0.04 | 15.19 | 0.01 | 0.48 | 900 |
| M251 | 1.5 | 5.00 | 1.03 | 12.00 | 3.30 | 0.00 | 0.43 | 0.04 | 14.02 | 0.01 | 0.48 | 900 |
| M252 | 1.5 | 5.00 | 1.03 | 12.50 | 3.30 | 0.00 | 0.43 | 0.04 | 14.60 | 0.01 | 0.48 | 900 |
| M253 | 1.5 | 5.00 | 1.03 | 11.50 | 3.30 | 0.00 | 0.43 | 0.04 | 13.43 | 0.01 | 0.48 | 900 |
| M254 | 1.5 | 5.00 | 1.03 | 9.50 | 3.30 | 0.00 | 0.44 | 0.04 | 11.10 | 0.00 | 0.48 | 900 |
| M255 | 1.5 | 5.00 | 1.03 | 11.00 | 3.30 | 0.00 | 0.44 | 0.04 | 12.85 | 0.01 | 0.49 | 900 |
| M256 | 1.5 | 5.00 | 1.03 | 10.00 | 3.30 | 0.00 | 0.44 | 0.04 | 11.68 | 0.01 | 0.49 | 900 |
| M257 | 1.5 | 5.00 | 1.03 | 10.50 | 3.30 | 0.00 | 0.44 | 0.04 | 12.27 | 0.01 | 0.49 | 900 |
| M258 | 1.5 | 5.50 | 1.03 | 21.00 | 3.30 | 0.00 | 0.56 | 0.04 | 24.49 | 0.01 | 0.61 | 800 |
| M259 | 1.5 | 5.50 | 1.03 | 21.50 | 3.30 | 0.00 | 0.56 | 0.04 | 25.07 | 0.01 | 0.61 | 800 |
| M260 | 1.5 | 5.50 | 1.03 | 22.00 | 3.30 | 0.00 | 0.56 | 0.04 | 25.65 | 0.01 | 0.61 | 800 |
| M261 | 1.5 | 5.50 | 1.03 | 20.50 | 3.30 | 0.00 | 0.56 | 0.04 | 23.90 | 0.01 | 0.61 | 800 |
| M262 | 1.5 | 5.50 | 1.03 | 18.50 | 3.30 | 0.00 | 0.64 | 0.05 | 21.58 | 0.01 | 0.70 | 800 |
| M263 | 1.5 | 5.50 | 1.03 | 19.00 | 3.30 | 0.00 | 0.64 | 0.05 | 22.16 | 0.01 | 0.70 | 800 |
| M264 | 1.5 | 5.50 | 1.03 | 17.00 | 3.30 | 0.00 | 0.65 | 0.04 | 19.83 | 0.01 | 0.70 | 850 |
| M265 | 1.5 | 5.50 | 1.03 | 20.00 | 3.30 | 0.00 | 0.64 | 0.05 | 23.32 | 0.01 | 0.70 | 800 |
| M266 | 1.5 | 5.50 | 1.03 | 19.50 | 3.30 | 0.00 | 0.64 | 0.05 | 22.74 | 0.01 | 0.70 | 800 |
| M267 | 1.5 | 5.50 | 1.03 | 17.50 | 3.30 | 0.00 | 0.65 | 0.05 | 20.41 | 0.01 | 0.71 | 850 |
| M268 | 1.5 | 5.50 | 1.03 | 15.50 | 3.30 | 0.00 | 0.66 | 0.04 | 18.08 | 0.01 | 0.71 | 850 |
| M269 | 1.5 | 5.50 | 1.03 | 16.00 | 3.30 | 0.00 | 0.66 | 0.04 | 18.66 | 0.01 | 0.71 | 850 |
| M270 | 1.5 | 5.50 | 1.03 | 16.50 | 3.30 | 0.00 | 0.66 | 0.04 | 19.24 | 0.01 | 0.71 | 850 |
| M271 | 1.5 | 5.50 | 1.03 | 18.00 | 3.30 | 0.00 | 0.65 | 0.05 | 20.99 | 0.01 | 0.71 | 800 |
| M272 | 1.5 | 5.50 | 1.03 | 15.00 | 3.30 | 0.00 | 0.66 | 0.04 | 17.50 | 0.01 | 0.71 | 850 |
| M273 | 1.5 | 5.50 | 1.03 | 14.00 | 3.30 | 0.00 | 0.67 | 0.04 | 16.33 | 0.01 | 0.72 | 850 |
| M274 | 1.5 | 5.50 | 1.03 | 13.50 | 3.30 | 0.00 | 0.67 | 0.04 | 15.75 | 0.01 | 0.72 | 850 |
| M275 | 1.5 | 5.50 | 1.03 | 14.50 | 3.30 | 0.00 | 0.67 | 0.04 | 16.91 | 0.01 | 0.72 | 850 |
| M276 | 1.5 | 5.50 | 1.03 | 12.00 | 3.30 | 0.00 | 0.68 | 0.04 | 14.00 | 0.01 | 0.73 | 900 |
| M277 | 1.5 | 5.50 | 1.03 | 12.50 | 3.30 | 0.00 | 0.68 | 0.04 | 14.58 | 0.01 | 0.73 | 900 |
| M278 | 1.5 | 5.50 | 1.03 | 13.00 | 3.30 | 0.00 | 0.68 | 0.04 | 15.16 | 0.01 | 0.73 | 850 |
| M279 | 1.5 | 5.50 | 1.03 | 11.50 | 3.30 | 0.00 | 0.68 | 0.04 | 13.41 | 0.01 | 0.73 | 900 |
| M280 | 1.5 | 5.50 | 1.03 | 10.50 | 3.30 | 0.00 | 0.69 | 0.04 | 12.25 | 0.01 | 0.74 | 900 |
| M281 | 1.5 | 5.50 | 1.03 | 11.00 | 3.30 | 0.00 | 0.69 | 0.04 | 12.83 | 0.01 | 0.74 | 900 |
| M282 | 1.5 | 5.50 | 1.03 | 10.00 | 3.30 | 0.00 | 0.69 | 0.04 | 11.66 | 0.01 | 0.74 | 900 |
| M283 | 1.5 | 5.50 | 1.03 | 9.00 | 3.30 | 0.00 | 0.70 | 0.04 | 10.50 | 0.01 | 0.75 | 900 |
| M284 | 1.5 | 5.50 | 1.03 | 9.50 | 3.30 | 0.00 | 0.70 | 0.04 | 11.08 | 0.01 | 0.75 | 900 |
| M285 | 1.5 | 6.00 | 1.03 | 22.00 | 3.30 | 0.00 | 0.88 | 0.04 | 25.63 | 0.01 | 0.93 | 800 |
| M286 | 1.5 | 6.00 | 1.03 | 20.50 | 3.30 | 0.00 | 0.89 | 0.04 | 23.88 | 0.01 | 0.94 | 800 |
| M287 | 1.5 | 6.00 | 1.03 | 21.00 | 3.30 | 0.00 | 0.89 | 0.04 | 24.46 | 0.01 | 0.94 | 800 |
| M288 | 1.5 | 6.00 | 1.03 | 21.50 | 3.30 | 0.00 | 0.89 | 0.04 | 25.04 | 0.01 | 0.94 | 800 |
| M289 | 1.5 | 6.00 | 1.03 | 19.50 | 3.30 | 0.00 | 0.95 | 0.05 | 22.72 | 0.01 | 1.01 | 800 |
| M290 | 1.5 | 6.00 | 1.03 | 20.00 | 3.30 | 0.00 | 0.95 | 0.05 | 23.30 | 0.02 | 1.02 | 800 |
| M291 | 1.5 | 6.00 | 1.03 | 18.00 | 3.30 | 0.00 | 0.96 | 0.05 | 20.97 | 0.01 | 1.02 | 800 |
| M292 | 1.5 | 6.00 | 1.03 | 18.50 | 3.30 | 0.00 | 0.96 | 0.05 | 21.55 | 0.01 | 1.02 | 800 |
| M293 | 1.5 | 6.00 | 1.03 | 19.00 | 3.30 | 0.00 | 0.96 | 0.05 | 22.13 | 0.01 | 1.02 | 800 |
| M294 | 1.5 | 6.00 | 1.03 | 17.50 | 3.30 | 0.00 | 0.97 | 0.05 | 20.39 | 0.01 | 1.03 | 800 |
| M295 | 1.5 | 6.00 | 1.03 | 17.00 | 3.30 | 0.00 | 0.97 | 0.05 | 19.80 | 0.01 | 1.03 | 850 |
| M296 | 1.5 | 6.00 | 1.03 | 16.50 | 3.30 | 0.00 | 0.97 | 0.05 | 19.22 | 0.01 | 1.03 | 850 |
| M297 | 1.5 | 6.00 | 1.03 | 15.00 | 3.30 | 0.00 | 0.98 | 0.04 | 17.48 | 0.01 | 1.03 | 850 |
| M298 | 1.5 | 6.00 | 1.03 | 15.50 | 3.30 | 0.00 | 0.98 | 0.05 | 18.06 | 0.01 | 1.04 | 850 |
| M299 | 1.5 | 6.00 | 1.03 | 16.00 | 3.30 | 0.00 | 0.98 | 0.05 | 18.64 | 0.01 | 1.04 | 850 |
| M300 | 1.5 | 6.00 | 1.03 | 14.50 | 3.30 | 0.00 | 0.99 | 0.04 | 16.89 | 0.01 | 1.04 | 850 |
| M301 | 1.5 | 6.00 | 1.03 | 13.50 | 3.30 | 0.00 | 0.99 | 0.04 | 15.73 | 0.01 | 1.04 | 850 |
| M302 | 1.5 | 6.00 | 1.03 | 14.00 | 3.30 | 0.00 | 0.99 | 0.04 | 16.31 | 0.01 | 1.04 | 850 |
| M303 | 1.5 | 6.00 | 1.03 | 13.00 | 3.30 | 0.00 | 1.00 | 0.04 | 15.15 | 0.01 | 1.05 | 850 |
| M304 | 1.5 | 6.00 | 1.03 | 12.00 | 3.30 | 0.00 | 1.00 | 0.04 | 13.98 | 0.01 | 1.05 | 900 |
| M305 | 1.5 | 6.00 | 1.03 | 12.50 | 3.30 | 0.00 | 1.00 | 0.04 | 14.56 | 0.01 | 1.05 | 900 |
| M306 | 1.5 | 6.00 | 1.03 | 11.50 | 3.30 | 0.00 | 1.01 | 0.04 | 13.40 | 0.01 | 1.06 | 900 |
| M307 | 1.5 | 6.00 | 1.03 | 11.00 | 3.30 | 0.00 | 1.01 | 0.04 | 12.82 | 0.01 | 1.06 | 900 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M308 | 1.5 | 6.00 | 1.03 | 10.50 | 3.30 | 0.00 | 1.01 | 0.04 | 12.23 | 0.01 | 1.06 | 900 |
| M309 | 1.5 | 6.00 | 1.03 | 10.00 | 3.30 | 0.00 | 1.02 | 0.04 | 11.65 | 0.01 | 1.07 | 900 |
| M310 | 1.5 | 6.00 | 1.03 | 9.00 | 3.30 | 0.00 | 1.02 | 0.04 | 10.49 | 0.01 | 1.07 | 900 |
| M311 | 1.5 | 6.00 | 1.03 | 9.50 | 3.30 | 0.00 | 1.02 | 0.04 | 11.07 | 0.01 | 1.07 | 900 |
| M312 | 1.5 | 6.50 | 1.03 | 22.00 | 3.30 | 0.00 | 1.26 | 0.04 | 25.60 | 0.02 | 1.32 | 800 |
| M313 | 1.5 | 6.50 | 1.03 | 21.50 | 3.30 | 0.00 | 1.26 | 0.04 | 25.03 | 0.02 | 1.32 | 800 |
| M314 | 1.5 | 6.50 | 1.03 | 20.50 | 3.30 | 0.00 | 1.27 | 0.04 | 23.86 | 0.02 | 1.33 | 800 |
| M315 | 1.5 | 6.50 | 1.03 | 21.00 | 3.30 | 0.00 | 1.27 | 0.04 | 24.44 | 0.02 | 1.33 | 800 |
| M316 | 1.5 | 6.50 | 1.03 | 20.00 | 3.30 | 0.00 | 1.31 | 0.05 | 23.28 | 0.02 | 1.38 | 800 |
| M317 | 1.5 | 6.50 | 1.03 | 19.00 | 3.30 | 0.00 | 1.32 | 0.05 | 22.11 | 0.02 | 1.39 | 800 |
| M318 | 1.5 | 6.50 | 1.03 | 18.50 | 3.30 | 0.00 | 1.32 | 0.05 | 21.53 | 0.02 | 1.39 | 800 |
| M319 | 1.5 | 6.50 | 1.03 | 19.50 | 3.30 | 0.00 | 1.32 | 0.05 | 22.69 | 0.02 | 1.39 | 800 |
| M320 | 1.5 | 6.50 | 1.03 | 17.50 | 3.30 | 0.00 | 1.33 | 0.05 | 20.37 | 0.02 | 1.40 | 800 |
| M321 | 1.5 | 6.50 | 1.03 | 18.00 | 3.30 | 0.00 | 1.33 | 0.05 | 20.95 | 0.02 | 1.40 | 800 |
| M322 | 1.5 | 6.50 | 1.03 | 17.00 | 3.30 | 0.00 | 1.33 | 0.05 | 19.79 | 0.02 | 1.40 | 850 |
| M323 | 1.5 | 6.50 | 1.03 | 16.00 | 3.30 | 0.00 | 1.34 | 0.05 | 18.62 | 0.02 | 1.41 | 850 |
| M324 | 1.5 | 6.50 | 1.03 | 16.50 | 3.30 | 0.00 | 1.34 | 0.05 | 19.20 | 0.02 | 1.41 | 850 |
| M325 | 1.5 | 6.50 | 1.03 | 14.50 | 3.30 | 0.00 | 1.35 | 0.05 | 16.88 | 0.02 | 1.42 | 850 |
| M326 | 1.5 | 6.50 | 1.03 | 15.00 | 3.30 | 0.00 | 1.35 | 0.05 | 17.46 | 0.02 | 1.42 | 850 |
| M327 | 1.5 | 6.50 | 1.03 | 15.50 | 3.30 | 0.00 | 1.35 | 0.05 | 18.04 | 0.02 | 1.42 | 850 |
| M328 | 1.5 | 6.50 | 1.03 | 14.00 | 3.30 | 0.00 | 1.36 | 0.05 | 16.30 | 0.02 | 1.43 | 850 |
| M329 | 1.5 | 6.50 | 1.03 | 13.50 | 3.30 | 0.00 | 1.36 | 0.05 | 15.71 | 0.02 | 1.43 | 850 |
| M330 | 1.5 | 6.50 | 1.03 | 12.00 | 3.30 | 0.00 | 1.37 | 0.04 | 13.97 | 0.02 | 1.43 | 900 |
| M331 | 1.5 | 6.50 | 1.03 | 12.50 | 3.30 | 0.00 | 1.37 | 0.04 | 14.55 | 0.02 | 1.43 | 900 |
| M332 | 1.5 | 6.50 | 1.03 | 11.50 | 3.30 | 0.00 | 1.38 | 0.04 | 13.39 | 0.02 | 1.44 | 900 |
| M333 | 1.5 | 6.50 | 1.03 | 13.00 | 3.30 | 0.00 | 1.37 | 0.05 | 15.13 | 0.02 | 1.44 | 850 |
| M334 | 1.5 | 6.50 | 1.03 | 11.00 | 3.30 | 0.00 | 1.38 | 0.04 | 12.80 | 0.02 | 1.44 | 900 |
| M335 | 1.5 | 6.50 | 1.03 | 9.50 | 3.30 | 0.00 | 1.39 | 0.04 | 11.06 | 0.02 | 1.45 | 900 |
| M336 | 1.5 | 6.50 | 1.03 | 10.00 | 3.30 | 0.00 | 1.39 | 0.04 | 11.64 | 0.02 | 1.45 | 900 |
| M337 | 1.5 | 6.50 | 1.03 | 10.50 | 3.30 | 0.00 | 1.39 | 0.04 | 12.22 | 0.02 | 1.45 | 900 |
| M338 | 1.5 | 6.50 | 1.03 | 9.00 | 3.30 | 0.00 | 1.40 | 0.04 | 10.48 | 0.02 | 1.46 | 900 |
| M339 | 1.5 | 7.00 | 1.03 | 22.50 | 3.30 | 0.00 | 1.66 | 0.04 | 26.17 | 0.03 | 1.73 | 750 |
| M340 | 1.5 | 7.00 | 1.03 | 22.00 | 3.30 | 0.00 | 1.67 | 0.04 | 25.59 | 0.03 | 1.74 | 800 |
| M341 | 1.5 | 7.00 | 1.03 | 21.50 | 3.30 | 0.00 | 1.67 | 0.04 | 25.00 | 0.03 | 1.74 | 800 |
| M342 | 1.5 | 7.00 | 1.03 | 21.00 | 3.30 | 0.00 | 1.67 | 0.04 | 24.42 | 0.03 | 1.74 | 800 |
| M343 | 1.5 | 7.00 | 1.03 | 20.00 | 3.30 | 0.00 | 1.68 | 0.04 | 23.26 | 0.03 | 1.75 | 800 |
| M344 | 1.5 | 7.00 | 1.03 | 20.50 | 3.30 | 0.00 | 1.68 | 0.04 | 23.84 | 0.03 | 1.75 | 800 |
| M345 | 1.5 | 7.00 | 1.03 | 19.50 | 3.30 | 0.00 | 1.71 | 0.05 | 22.68 | 0.03 | 1.79 | 800 |
| M346 | 1.5 | 7.00 | 1.03 | 18.50 | 3.30 | 0.00 | 1.72 | 0.05 | 21.52 | 0.03 | 1.80 | 800 |
| M347 | 1.5 | 7.00 | 1.03 | 19.00 | 3.30 | 0.00 | 1.72 | 0.05 | 22.10 | 0.03 | 1.80 | 800 |
| M348 | 1.5 | 7.00 | 1.03 | 18.00 | 3.30 | 0.00 | 1.72 | 0.05 | 20.93 | 0.03 | 1.80 | 800 |
| M349 | 1.5 | 7.00 | 1.03 | 17.50 | 3.30 | 0.00 | 1.73 | 0.05 | 20.35 | 0.03 | 1.81 | 800 |
| M350 | 1.5 | 7.00 | 1.03 | 17.00 | 3.30 | 0.00 | 1.73 | 0.05 | 19.77 | 0.03 | 1.81 | 850 |
| M351 | 1.5 | 7.00 | 1.03 | 15.50 | 3.30 | 0.00 | 1.75 | 0.05 | 18.03 | 0.02 | 1.82 | 850 |
| M352 | 1.5 | 7.00 | 1.03 | 16.00 | 3.30 | 0.00 | 1.74 | 0.05 | 18.61 | 0.03 | 1.82 | 850 |
| M353 | 1.5 | 7.00 | 1.03 | 16.50 | 3.30 | 0.00 | 1.74 | 0.05 | 19.19 | 0.03 | 1.82 | 850 |
| M354 | 1.5 | 7.00 | 1.03 | 15.00 | 3.30 | 0.00 | 1.75 | 0.05 | 17.45 | 0.02 | 1.82 | 850 |
| M355 | 1.5 | 7.00 | 1.03 | 14.50 | 3.30 | 0.00 | 1.76 | 0.05 | 16.87 | 0.02 | 1.83 | 850 |
| M356 | 1.5 | 7.00 | 1.03 | 13.50 | 3.30 | 0.00 | 1.76 | 0.05 | 15.70 | 0.02 | 1.83 | 850 |
| M357 | 1.5 | 7.00 | 1.03 | 14.00 | 3.30 | 0.00 | 1.76 | 0.05 | 16.28 | 0.02 | 1.83 | 850 |
| M358 | 1.5 | 7.00 | 1.03 | 12.50 | 3.30 | 0.00 | 1.77 | 0.05 | 14.54 | 0.02 | 1.84 | 900 |
| M359 | 1.5 | 7.00 | 1.03 | 13.00 | 3.30 | 0.00 | 1.77 | 0.05 | 15.12 | 0.02 | 1.84 | 850 |
| M360 | 1.5 | 7.00 | 1.03 | 11.50 | 3.30 | 0.00 | 1.78 | 0.05 | 13.38 | 0.02 | 1.85 | 900 |
| M361 | 1.5 | 7.00 | 1.03 | 12.00 | 3.30 | 0.00 | 1.78 | 0.05 | 13.96 | 0.02 | 1.85 | 900 |
| M362 | 1.5 | 7.00 | 1.03 | 10.50 | 3.30 | 0.00 | 1.79 | 0.04 | 12.21 | 0.02 | 1.85 | 900 |
| M363 | 1.5 | 7.00 | 1.03 | 11.00 | 3.30 | 0.00 | 1.79 | 0.05 | 12.80 | 0.02 | 1.86 | 900 |
| M364 | 1.5 | 7.00 | 1.03 | 9.50 | 3.30 | 0.00 | 1.80 | 0.04 | 11.05 | 0.02 | 1.86 | 900 |
| M365 | 1.5 | 7.00 | 1.03 | 10.00 | 3.30 | 0.00 | 1.80 | 0.04 | 11.63 | 0.02 | 1.86 | 900 |
| M366 | 1.5 | 7.00 | 1.03 | 9.00 | 3.30 | 0.00 | 1.80 | 0.04 | 10.47 | 0.02 | 1.86 | 900 |
| M367 | 1.5 | 7.50 | 1.03 | 22.50 | 3.30 | 0.00 | 2.09 | 0.05 | 26.15 | 0.03 | 2.17 | 750 |
| M368 | 1.5 | 7.50 | 1.03 | 22.00 | 3.30 | 0.00 | 2.09 | 0.05 | 25.58 | 0.03 | 2.17 | 800 |
| M369 | 1.5 | 7.50 | 1.03 | 20.50 | 3.30 | 0.00 | 2.11 | 0.04 | 23.83 | 0.03 | 2.18 | 800 |
| M370 | 1.5 | 7.50 | 1.03 | 21.00 | 3.30 | 0.00 | 2.10 | 0.05 | 24.41 | 0.03 | 2.18 | 800 |
| M371 | 1.5 | 7.50 | 1.03 | 21.50 | 3.30 | 0.00 | 2.10 | 0.05 | 24.99 | 0.03 | 2.18 | 800 |
| M372 | 1.5 | 7.50 | 1.03 | 20.00 | 3.30 | 0.00 | 2.11 | 0.04 | 23.25 | 0.03 | 2.18 | 800 |
| M373 | 1.5 | 7.50 | 1.03 | 19.50 | 3.30 | 0.00 | 2.13 | 0.06 | 22.67 | 0.03 | 2.22 | 800 |
| M374 | 1.5 | 7.50 | 1.03 | 19.00 | 3.30 | 0.00 | 2.13 | 0.06 | 22.08 | 0.03 | 2.22 | 800 |
| M375 | 1.5 | 7.50 | 1.03 | 18.50 | 3.30 | 0.00 | 2.14 | 0.06 | 21.50 | 0.03 | 2.23 | 800 |
| M376 | 1.5 | 7.50 | 1.03 | 17.00 | 3.30 | 0.00 | 2.15 | 0.05 | 19.76 | 0.03 | 2.23 | 800 |
| M377 | 1.5 | 7.50 | 1.03 | 17.50 | 3.30 | 0.00 | 2.15 | 0.05 | 20.34 | 0.03 | 2.23 | 800 |
| M378 | 1.5 | 7.50 | 1.03 | 18.00 | 3.30 | 0.00 | 2.14 | 0.06 | 20.92 | 0.03 | 2.23 | 800 |
| M379 | 1.5 | 7.50 | 1.03 | 16.00 | 3.30 | 0.00 | 2.16 | 0.05 | 18.60 | 0.03 | 2.24 | 850 |
| M380 | 1.5 | 7.50 | 1.03 | 16.50 | 3.30 | 0.00 | 2.16 | 0.05 | 19.18 | 0.03 | 2.24 | 850 |
| M381 | 1.5 | 7.50 | 1.03 | 15.50 | 3.30 | 0.00 | 2.17 | 0.05 | 18.02 | 0.03 | 2.25 | 850 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M382 | 1.5 | 7.50 | 1.03 | 15.00 | 3.30 | 0.00 | 2.17 | 0.05 | 17.44 | 0.03 | 2.25 | 850 |
| M383 | 1.5 | 7.50 | 1.03 | 14.50 | 3.30 | 0.00 | 2.18 | 0.05 | 16.86 | 0.03 | 2.26 | 850 |
| M384 | 1.5 | 7.50 | 1.03 | 14.00 | 3.30 | 0.00 | 2.18 | 0.05 | 16.27 | 0.03 | 2.26 | 850 |
| M385 | 1.5 | 7.50 | 1.03 | 13.00 | 3.30 | 0.00 | 2.19 | 0.05 | 15.11 | 0.03 | 2.27 | 850 |
| M386 | 1.5 | 7.50 | 1.03 | 13.50 | 3.30 | 0.00 | 2.19 | 0.05 | 15.69 | 0.03 | 2.27 | 850 |
| M387 | 1.5 | 7.50 | 1.03 | 12.00 | 3.30 | 0.00 | 2.20 | 0.05 | 13.95 | 0.03 | 2.28 | 900 |
| M388 | 1.5 | 7.50 | 1.03 | 12.50 | 3.30 | 0.00 | 2.20 | 0.05 | 14.53 | 0.03 | 2.28 | 850 |
| M389 | 1.5 | 7.50 | 1.03 | 11.00 | 3.30 | 0.00 | 2.21 | 0.05 | 12.79 | 0.03 | 2.29 | 900 |
| M390 | 1.5 | 7.50 | 1.03 | 11.50 | 3.30 | 0.00 | 2.21 | 0.05 | 13.37 | 0.03 | 2.29 | 900 |
| M391 | 1.5 | 7.50 | 1.03 | 10.50 | 3.30 | 0.00 | 2.22 | 0.05 | 12.21 | 0.03 | 2.30 | 900 |
| M392 | 1.5 | 7.50 | 1.03 | 10.00 | 3.30 | 0.00 | 2.22 | 0.05 | 11.63 | 0.03 | 2.30 | 900 |
| M393 | 1.5 | 7.50 | 1.03 | 9.00 | 3.30 | 0.00 | 2.23 | 0.05 | 10.46 | 0.03 | 2.31 | 900 |
| M394 | 1.5 | 7.50 | 1.03 | 9.50 | 3.30 | 0.00 | 2.23 | 0.05 | 11.04 | 0.03 | 2.31 | 900 |
| M395 | 1.5 | 7.50 | 1.03 | 8.50 | 3.30 | 0.00 | 2.24 | 0.04 | 9.88 | 0.03 | 2.31 | 900 |
| M396 | 1.5 | 8.00 | 1.03 | 22.50 | 3.30 | 0.00 | 2.53 | 0.05 | 26.14 | 0.04 | 2.62 | 750 |
| M397 | 1.5 | 8.00 | 1.03 | 21.50 | 3.30 | 0.00 | 2.54 | 0.05 | 24.98 | 0.04 | 2.63 | 800 |
| M398 | 1.5 | 8.00 | 1.03 | 22.00 | 3.30 | 0.00 | 2.54 | 0.05 | 25.56 | 0.04 | 2.63 | 750 |
| M399 | 1.5 | 8.00 | 1.03 | 21.00 | 3.30 | 0.00 | 2.55 | 0.05 | 24.40 | 0.04 | 2.64 | 800 |
| M400 | 1.5 | 8.00 | 1.03 | 20.50 | 3.30 | 0.00 | 2.55 | 0.05 | 23.82 | 0.04 | 2.64 | 800 |
| M401 | 1.5 | 8.00 | 1.03 | 19.50 | 3.30 | 0.00 | 2.56 | 0.05 | 22.66 | 0.04 | 2.65 | 800 |
| M402 | 1.5 | 8.00 | 1.03 | 20.00 | 3.30 | 0.00 | 2.56 | 0.05 | 23.24 | 0.04 | 2.65 | 800 |
| M403 | 1.5 | 8.00 | 1.03 | 19.00 | 3.30 | 0.00 | 2.57 | 0.06 | 22.07 | 0.04 | 2.67 | 800 |
| M404 | 1.5 | 8.00 | 1.03 | 18.00 | 3.30 | 0.00 | 2.58 | 0.06 | 20.91 | 0.04 | 2.68 | 800 |
| M405 | 1.5 | 8.00 | 1.03 | 18.50 | 3.30 | 0.00 | 2.58 | 0.06 | 21.49 | 0.04 | 2.68 | 800 |
| M406 | 1.5 | 8.00 | 1.03 | 17.00 | 3.30 | 0.00 | 2.59 | 0.06 | 19.75 | 0.04 | 2.69 | 800 |
| M407 | 1.5 | 8.00 | 1.03 | 17.50 | 3.30 | 0.00 | 2.59 | 0.06 | 20.33 | 0.04 | 2.69 | 800 |
| M408 | 1.5 | 8.00 | 1.03 | 16.50 | 3.30 | 0.00 | 2.60 | 0.06 | 19.17 | 0.04 | 2.70 | 850 |
| M409 | 1.5 | 8.00 | 1.03 | 15.00 | 3.30 | 0.00 | 2.61 | 0.05 | 17.43 | 0.04 | 2.70 | 850 |
| M410 | 1.5 | 8.00 | 1.03 | 16.00 | 3.30 | 0.00 | 2.60 | 0.06 | 18.59 | 0.04 | 2.70 | 850 |
| M411 | 1.5 | 8.00 | 1.03 | 15.50 | 3.30 | 0.00 | 2.61 | 0.05 | 18.01 | 0.04 | 2.70 | 850 |
| M412 | 1.5 | 8.00 | 1.03 | 14.50 | 3.30 | 0.00 | 2.62 | 0.05 | 16.85 | 0.04 | 2.71 | 850 |
| M413 | 1.5 | 8.00 | 1.03 | 14.00 | 3.30 | 0.00 | 2.62 | 0.05 | 16.27 | 0.04 | 2.71 | 850 |
| M414 | 1.5 | 8.00 | 1.03 | 13.00 | 3.30 | 0.00 | 2.63 | 0.05 | 15.11 | 0.04 | 2.72 | 850 |
| M415 | 1.5 | 8.00 | 1.03 | 13.50 | 3.30 | 0.00 | 2.63 | 0.05 | 15.69 | 0.04 | 2.72 | 850 |
| M416 | 1.5 | 8.00 | 1.03 | 12.00 | 3.30 | 0.00 | 2.64 | 0.05 | 13.94 | 0.03 | 2.72 | 900 |
| M417 | 1.5 | 8.00 | 1.03 | 12.50 | 3.30 | 0.00 | 2.64 | 0.05 | 14.52 | 0.04 | 2.73 | 850 |
| M418 | 1.5 | 8.00 | 1.03 | 11.00 | 3.30 | 0.00 | 2.65 | 0.05 | 12.78 | 0.03 | 2.73 | 900 |
| M419 | 1.5 | 8.00 | 1.03 | 11.50 | 3.30 | 0.00 | 2.65 | 0.05 | 13.36 | 0.03 | 2.73 | 900 |
| M420 | 1.5 | 8.00 | 1.03 | 10.50 | 3.30 | 0.00 | 2.66 | 0.05 | 12.20 | 0.03 | 2.74 | 900 |
| M421 | 1.5 | 8.00 | 1.03 | 10.00 | 3.30 | 0.00 | 2.67 | 0.05 | 11.62 | 0.03 | 2.75 | 900 |
| M422 | 1.5 | 8.00 | 1.03 | 9.50 | 3.30 | 0.00 | 2.67 | 0.05 | 11.04 | 0.03 | 2.75 | 900 |
| M423 | 1.5 | 8.00 | 1.03 | 8.50 | 3.30 | 0.00 | 2.68 | 0.05 | 9.88 | 0.03 | 2.76 | 900 |
| M424 | 1.5 | 8.00 | 1.03 | 9.00 | 3.30 | 0.00 | 2.68 | 0.05 | 10.46 | 0.03 | 2.76 | 900 |
| M425 | 1.5 | 8.50 | 1.03 | 22.50 | 3.30 | 0.00 | 2.99 | 0.05 | 26.13 | 0.05 | 3.09 | 750 |
| M426 | 1.5 | 8.50 | 1.03 | 22.00 | 3.30 | 0.00 | 2.99 | 0.05 | 25.55 | 0.05 | 3.09 | 750 |
| M427 | 1.5 | 8.50 | 1.03 | 21.50 | 3.30 | 0.00 | 3.00 | 0.05 | 24.97 | 0.05 | 3.10 | 800 |
| M428 | 1.5 | 8.50 | 1.03 | 21.00 | 3.30 | 0.00 | 3.00 | 0.05 | 24.39 | 0.05 | 3.10 | 800 |
| M429 | 1.5 | 8.50 | 1.03 | 20.50 | 3.30 | 0.00 | 3.01 | 0.05 | 23.81 | 0.05 | 3.11 | 800 |
| M430 | 1.5 | 8.50 | 1.03 | 20.00 | 3.30 | 0.00 | 3.01 | 0.05 | 23.23 | 0.05 | 3.11 | 800 |
| M431 | 1.5 | 8.50 | 1.03 | 19.50 | 3.30 | 0.00 | 3.02 | 0.05 | 22.65 | 0.05 | 3.12 | 800 |
| M432 | 1.5 | 8.50 | 1.03 | 19.00 | 3.30 | 0.00 | 3.02 | 0.06 | 22.06 | 0.05 | 3.13 | 800 |
| M433 | 1.5 | 8.50 | 1.03 | 18.50 | 3.30 | 0.00 | 3.02 | 0.06 | 21.48 | 0.05 | 3.13 | 800 |
| M434 | 1.5 | 8.50 | 1.03 | 18.00 | 3.30 | 0.00 | 3.03 | 0.06 | 20.90 | 0.05 | 3.14 | 800 |
| M435 | 1.5 | 8.50 | 1.03 | 17.00 | 3.30 | 0.00 | 3.04 | 0.06 | 19.74 | 0.05 | 3.15 | 800 |
| M436 | 1.5 | 8.50 | 1.03 | 17.50 | 3.30 | 0.00 | 3.04 | 0.06 | 20.32 | 0.05 | 3.15 | 800 |
| M437 | 1.5 | 8.50 | 1.03 | 16.00 | 3.30 | 0.00 | 3.05 | 0.06 | 18.58 | 0.04 | 3.15 | 850 |
| M438 | 1.5 | 8.50 | 1.03 | 16.50 | 3.30 | 0.00 | 3.05 | 0.06 | 19.16 | 0.05 | 3.16 | 850 |
| M439 | 1.5 | 8.50 | 1.03 | 15.50 | 3.30 | 0.00 | 3.06 | 0.06 | 18.00 | 0.04 | 3.16 | 850 |
| M440 | 1.5 | 8.50 | 1.03 | 15.00 | 3.30 | 0.00 | 3.06 | 0.06 | 17.42 | 0.04 | 3.16 | 850 |
| M441 | 1.5 | 8.50 | 1.03 | 14.50 | 3.30 | 0.00 | 3.07 | 0.06 | 16.84 | 0.04 | 3.17 | 850 |
| M442 | 1.5 | 8.50 | 1.03 | 13.50 | 3.30 | 0.00 | 3.08 | 0.05 | 15.68 | 0.04 | 3.17 | 850 |
| M443 | 1.5 | 8.50 | 1.03 | 14.00 | 3.30 | 0.00 | 3.08 | 0.06 | 16.26 | 0.04 | 3.18 | 850 |
| M444 | 1.5 | 8.50 | 1.03 | 13.00 | 3.30 | 0.00 | 3.09 | 0.05 | 15.10 | 0.04 | 3.18 | 850 |
| M445 | 1.5 | 8.50 | 1.03 | 12.50 | 3.30 | 0.00 | 3.09 | 0.05 | 14.52 | 0.04 | 3.18 | 850 |
| M446 | 1.5 | 8.50 | 1.03 | 12.00 | 3.30 | 0.00 | 3.10 | 0.05 | 13.94 | 0.04 | 3.19 | 900 |
| M447 | 1.5 | 8.50 | 1.03 | 11.50 | 3.30 | 0.00 | 3.10 | 0.05 | 13.36 | 0.04 | 3.19 | 900 |
| M448 | 1.5 | 8.50 | 1.03 | 11.00 | 3.30 | 0.00 | 3.11 | 0.05 | 12.78 | 0.04 | 3.20 | 900 |
| M449 | 1.5 | 8.50 | 1.03 | 10.00 | 3.30 | 0.00 | 3.12 | 0.05 | 11.62 | 0.04 | 3.21 | 900 |
| M450 | 1.5 | 8.50 | 1.03 | 10.50 | 3.30 | 0.00 | 3.12 | 0.05 | 12.20 | 0.04 | 3.21 | 900 |
| M451 | 1.5 | 8.50 | 1.03 | 9.50 | 3.30 | 0.00 | 3.13 | 0.05 | 11.03 | 0.04 | 3.22 | 900 |
| M452 | 1.5 | 8.50 | 1.03 | 9.00 | 3.30 | 0.00 | 3.13 | 0.05 | 10.45 | 0.04 | 3.22 | 850 |
| M453 | 1.5 | 8.50 | 1.03 | 8.50 | 3.30 | 0.00 | 3.14 | 0.05 | 9.87 | 0.04 | 3.23 | 900 |
| M454 | 1.5 | 9.00 | 1.03 | 22.50 | 3.30 | 0.00 | 3.45 | 0.05 | 26.12 | 0.06 | 3.56 | 750 |
| M455 | 1.5 | 9.00 | 1.03 | 22.00 | 3.30 | 0.00 | 3.45 | 0.05 | 25.55 | 0.06 | 3.56 | 750 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M456 | 1.5 | 9.00 | 1.03 | 21.50 | 3.30 | 0.00 | 3.46 | 0.05 | 24.96 | 0.06 | 3.57 | 800 |
| M457 | 1.5 | 9.00 | 1.03 | 21.00 | 3.30 | 0.00 | 3.47 | 0.05 | 24.38 | 0.06 | 3.58 | 800 |
| M458 | 1.5 | 9.00 | 1.03 | 20.50 | 3.30 | 0.00 | 3.47 | 0.05 | 23.80 | 0.06 | 3.58 | 800 |
| M459 | 1.5 | 9.00 | 1.03 | 19.50 | 3.30 | 0.00 | 3.48 | 0.05 | 22.64 | 0.05 | 3.58 | 800 |
| M460 | 1.5 | 9.00 | 1.03 | 20.00 | 3.30 | 0.00 | 3.48 | 0.05 | 23.22 | 0.06 | 3.59 | 800 |
| M461 | 1.5 | 9.00 | 1.03 | 19.00 | 3.30 | 0.00 | 3.49 | 0.05 | 22.06 | 0.05 | 3.59 | 800 |
| M462 | 1.5 | 9.00 | 1.03 | 18.50 | 3.30 | 0.00 | 3.48 | 0.06 | 21.48 | 0.06 | 3.60 | 800 |
| M463 | 1.5 | 9.00 | 1.03 | 18.00 | 3.30 | 0.00 | 3.49 | 0.06 | 20.90 | 0.05 | 3.60 | 800 |
| M464 | 1.5 | 9.00 | 1.03 | 17.00 | 3.30 | 0.00 | 3.50 | 0.06 | 19.74 | 0.05 | 3.61 | 800 |
| M465 | 1.5 | 9.00 | 1.03 | 17.50 | 3.30 | 0.00 | 3.50 | 0.06 | 20.32 | 0.05 | 3.61 | 800 |
| M466 | 1.5 | 9.00 | 1.03 | 16.50 | 3.30 | 0.00 | 3.51 | 0.06 | 19.16 | 0.05 | 3.62 | 800 |
| M467 | 1.5 | 9.00 | 1.03 | 16.00 | 3.30 | 0.00 | 3.51 | 0.06 | 18.58 | 0.05 | 3.62 | 850 |
| M468 | 1.5 | 9.00 | 1.03 | 15.50 | 3.30 | 0.00 | 3.52 | 0.06 | 18.00 | 0.05 | 3.63 | 850 |
| M469 | 1.5 | 9.00 | 1.03 | 15.00 | 3.30 | 0.00 | 3.53 | 0.06 | 17.41 | 0.05 | 3.64 | 850 |
| M470 | 1.5 | 9.00 | 1.03 | 14.50 | 3.30 | 0.00 | 3.53 | 0.06 | 16.83 | 0.05 | 3.64 | 850 |
| M471 | 1.5 | 9.00 | 1.03 | 14.00 | 3.30 | 0.00 | 3.54 | 0.06 | 16.25 | 0.05 | 3.65 | 850 |
| M472 | 1.5 | 9.00 | 1.03 | 13.50 | 3.30 | 0.00 | 3.54 | 0.06 | 15.67 | 0.05 | 3.65 | 850 |
| M473 | 1.5 | 9.00 | 1.03 | 13.00 | 3.30 | 0.00 | 3.55 | 0.06 | 15.09 | 0.05 | 3.66 | 850 |
| M474 | 1.5 | 9.00 | 1.03 | 12.00 | 3.30 | 0.00 | 3.56 | 0.05 | 13.93 | 0.05 | 3.66 | 850 |
| M475 | 1.5 | 9.00 | 1.03 | 12.50 | 3.30 | 0.00 | 3.56 | 0.06 | 14.51 | 0.05 | 3.67 | 850 |
| M476 | 1.5 | 9.00 | 1.03 | 11.00 | 3.30 | 0.00 | 3.57 | 0.05 | 12.77 | 0.05 | 3.67 | 900 |
| M477 | 1.5 | 9.00 | 1.03 | 11.50 | 3.30 | 0.00 | 3.57 | 0.05 | 13.35 | 0.05 | 3.67 | 900 |
| M478 | 1.5 | 9.00 | 1.03 | 10.50 | 3.30 | 0.00 | 3.58 | 0.05 | 12.19 | 0.05 | 3.68 | 900 |
| M479 | 1.5 | 9.00 | 1.03 | 10.00 | 3.30 | 0.00 | 3.59 | 0.05 | 11.61 | 0.05 | 3.69 | 900 |
| M480 | 1.5 | 9.00 | 1.03 | 9.50 | 3.30 | 0.00 | 3.59 | 0.05 | 11.03 | 0.05 | 3.69 | 900 |
| M481 | 1.5 | 9.00 | 1.03 | 9.00 | 3.30 | 0.00 | 3.60 | 0.05 | 10.45 | 0.04 | 3.69 | 850 |
| M482 | 1.5 | 9.00 | 1.03 | 8.50 | 3.30 | 0.00 | 3.61 | 0.05 | 9.87 | 0.04 | 3.70 | 900 |
| M483 | 1.5 | 9.00 | 1.03 | 8.00 | 3.30 | 0.00 | 3.61 | 0.05 | 9.29 | 0.04 | 3.70 | 900 |
| M484 | 1.5 | 9.50 | 1.03 | 22.50 | 3.30 | 0.00 | 3.92 | 0.05 | 26.12 | 0.07 | 4.04 | 750 |
| M485 | 1.5 | 9.50 | 1.03 | 22.00 | 3.30 | 0.00 | 3.93 | 0.05 | 25.54 | 0.07 | 4.05 | 750 |
| M486 | 1.5 | 9.50 | 1.03 | 21.50 | 3.30 | 0.00 | 3.93 | 0.05 | 24.96 | 0.07 | 4.05 | 750 |
| M487 | 1.5 | 9.50 | 1.03 | 20.50 | 3.30 | 0.00 | 3.94 | 0.05 | 23.80 | 0.06 | 4.05 | 800 |
| M488 | 1.5 | 9.50 | 1.03 | 21.00 | 3.30 | 0.00 | 3.94 | 0.05 | 24.38 | 0.06 | 4.05 | 800 |
| M489 | 1.5 | 9.50 | 1.03 | 20.00 | 3.30 | 0.00 | 3.95 | 0.05 | 23.22 | 0.06 | 4.06 | 800 |
| M490 | 1.5 | 9.50 | 1.03 | 19.50 | 3.30 | 0.00 | 3.96 | 0.05 | 22.64 | 0.06 | 4.07 | 800 |
| M491 | 1.5 | 9.50 | 1.03 | 19.00 | 3.30 | 0.00 | 3.96 | 0.05 | 22.06 | 0.06 | 4.07 | 800 |
| M492 | 1.5 | 9.50 | 1.03 | 18.50 | 3.30 | 0.00 | 3.97 | 0.05 | 21.48 | 0.06 | 4.08 | 800 |
| M493 | 1.5 | 9.50 | 1.03 | 18.00 | 3.30 | 0.00 | 3.96 | 0.06 | 20.89 | 0.06 | 4.08 | 800 |
| M494 | 1.5 | 9.50 | 1.03 | 17.50 | 3.30 | 0.00 | 3.96 | 0.06 | 20.31 | 0.06 | 4.08 | 800 |
| M495 | 1.5 | 9.50 | 1.03 | 17.00 | 3.30 | 0.00 | 3.97 | 0.06 | 19.73 | 0.06 | 4.09 | 800 |
| M496 | 1.5 | 9.50 | 1.03 | 16.50 | 3.30 | 0.00 | 3.98 | 0.06 | 19.15 | 0.06 | 4.10 | 800 |
| M497 | 1.5 | 9.50 | 1.03 | 16.00 | 3.30 | 0.00 | 3.98 | 0.06 | 18.57 | 0.06 | 4.10 | 850 |
| M498 | 1.5 | 9.50 | 1.03 | 15.50 | 3.30 | 0.00 | 3.99 | 0.06 | 17.99 | 0.06 | 4.11 | 850 |
| M499 | 1.5 | 9.50 | 1.03 | 14.50 | 3.30 | 0.00 | 4.00 | 0.06 | 16.83 | 0.06 | 4.12 | 850 |
| M500 | 1.5 | 9.50 | 1.03 | 15.00 | 3.30 | 0.00 | 4.00 | 0.06 | 17.41 | 0.06 | 4.12 | 850 |
| M501 | 1.5 | 9.50 | 1.03 | 13.50 | 3.30 | 0.00 | 4.01 | 0.06 | 15.67 | 0.06 | 4.13 | 850 |
| M502 | 1.5 | 9.50 | 1.03 | 14.00 | 3.30 | 0.00 | 4.01 | 0.06 | 16.25 | 0.06 | 4.13 | 850 |
| M503 | 1.5 | 9.50 | 1.03 | 13.00 | 3.30 | 0.00 | 4.02 | 0.06 | 15.09 | 0.06 | 4.14 | 850 |
| M504 | 1.5 | 9.50 | 1.03 | 12.00 | 3.30 | 0.00 | 4.03 | 0.06 | 13.93 | 0.05 | 4.14 | 850 |
| M505 | 1.5 | 9.50 | 1.03 | 12.50 | 3.30 | 0.00 | 4.03 | 0.06 | 14.51 | 0.06 | 4.15 | 850 |
| M506 | 1.5 | 9.50 | 1.03 | 11.50 | 3.30 | 0.00 | 4.04 | 0.06 | 13.35 | 0.05 | 4.15 | 900 |
| M507 | 1.5 | 9.50 | 1.03 | 10.50 | 3.30 | 0.00 | 4.05 | 0.05 | 12.19 | 0.05 | 4.15 | 900 |
| M508 | 1.5 | 9.50 | 1.03 | 11.00 | 3.30 | 0.00 | 4.05 | 0.06 | 12.77 | 0.05 | 4.16 | 900 |
| M509 | 1.5 | 9.50 | 1.03 | 10.00 | 3.30 | 0.00 | 4.06 | 0.05 | 11.61 | 0.05 | 4.16 | 900 |
| M510 | 1.5 | 9.50 | 1.03 | 9.50 | 3.30 | 0.00 | 4.07 | 0.05 | 11.03 | 0.05 | 4.17 | 900 |
| M511 | 1.5 | 9.50 | 1.03 | 9.00 | 3.30 | 0.00 | 4.07 | 0.05 | 10.45 | 0.05 | 4.17 | 900 |
| M512 | 1.5 | 9.50 | 1.03 | 8.50 | 3.30 | 0.00 | 4.08 | 0.05 | 9.87 | 0.05 | 4.18 | 900 |
| M513 | 1.5 | 10.00 | 1.03 | 22.00 | 3.30 | 0.00 | 4.40 | 0.06 | 25.53 | 0.07 | 4.53 | 750 |
| M514 | 1.5 | 10.00 | 1.03 | 22.50 | 3.30 | 0.00 | 4.40 | 0.06 | 26.11 | 0.08 | 4.54 | 750 |
| M515 | 1.5 | 10.00 | 1.03 | 21.00 | 3.30 | 0.00 | 4.42 | 0.05 | 24.37 | 0.07 | 4.54 | 800 |
| M516 | 1.5 | 10.00 | 1.03 | 21.50 | 3.30 | 0.00 | 4.41 | 0.06 | 24.95 | 0.07 | 4.54 | 750 |
| M517 | 1.5 | 10.00 | 1.03 | 20.50 | 3.30 | 0.00 | 4.42 | 0.05 | 23.79 | 0.07 | 4.54 | 800 |
| M518 | 1.5 | 10.00 | 1.03 | 20.00 | 3.30 | 0.00 | 4.43 | 0.05 | 23.21 | 0.07 | 4.55 | 800 |
| M519 | 1.5 | 10.00 | 1.03 | 19.00 | 3.30 | 0.00 | 4.44 | 0.05 | 22.05 | 0.07 | 4.56 | 800 |
| M520 | 1.5 | 10.00 | 1.03 | 19.50 | 3.30 | 0.00 | 4.44 | 0.05 | 22.63 | 0.07 | 4.56 | 800 |
| M521 | 1.5 | 10.00 | 1.03 | 18.00 | 3.30 | 0.00 | 4.43 | 0.07 | 20.89 | 0.07 | 4.57 | 800 |
| M522 | 1.5 | 10.00 | 1.03 | 18.50 | 3.30 | 0.00 | 4.45 | 0.05 | 21.47 | 0.07 | 4.57 | 800 |
| M523 | 1.5 | 10.00 | 1.03 | 17.50 | 3.30 | 0.00 | 4.44 | 0.07 | 20.31 | 0.07 | 4.58 | 800 |
| M524 | 1.5 | 10.00 | 1.03 | 17.00 | 3.30 | 0.00 | 4.45 | 0.07 | 19.73 | 0.07 | 4.59 | 800 |
| M525 | 1.5 | 10.00 | 1.03 | 16.50 | 3.30 | 0.00 | 4.45 | 0.07 | 19.15 | 0.07 | 4.59 | 800 |
| M526 | 1.5 | 10.00 | 1.03 | 16.00 | 3.30 | 0.00 | 4.46 | 0.06 | 18.57 | 0.07 | 4.59 | 850 |
| M527 | 1.5 | 10.00 | 1.03 | 15.50 | 3.30 | 0.00 | 4.47 | 0.06 | 17.99 | 0.07 | 4.60 | 850 |
| M528 | 1.5 | 10.00 | 1.03 | 15.00 | 3.30 | 0.00 | 4.47 | 0.06 | 17.41 | 0.07 | 4.60 | 850 |
| M529 | 1.5 | 10.00 | 1.03 | 14.50 | 3.30 | 0.00 | 4.48 | 0.06 | 16.83 | 0.07 | 4.61 | 850 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M530 | 1.5 | 10.00 | 1.03 | 14.00 | 3.30 | 0.00 | 4.49 | 0.06 | 16.25 | 0.06 | 4.61 | 850 |
| M531 | 1.5 | 10.00 | 1.03 | 13.50 | 3.30 | 0.00 | 4.49 | 0.06 | 15.67 | 0.06 | 4.61 | 850 |
| M532 | 1.5 | 10.00 | 1.03 | 13.00 | 3.30 | 0.00 | 4.50 | 0.06 | 15.09 | 0.06 | 4.62 | 850 |
| M533 | 1.5 | 10.00 | 1.03 | 12.00 | 3.30 | 0.00 | 4.51 | 0.06 | 13.93 | 0.06 | 4.63 | 850 |
| M534 | 1.5 | 10.00 | 1.03 | 12.50 | 3.30 | 0.00 | 4.51 | 0.06 | 14.51 | 0.06 | 4.63 | 850 |
| M535 | 1.5 | 10.00 | 1.03 | 11.50 | 3.30 | 0.00 | 4.52 | 0.06 | 13.35 | 0.06 | 4.64 | 900 |
| M536 | 1.5 | 10.00 | 1.03 | 11.00 | 3.30 | 0.00 | 4.53 | 0.06 | 12.77 | 0.06 | 4.65 | 900 |
| M537 | 1.5 | 10.00 | 1.03 | 10.50 | 3.30 | 0.00 | 4.53 | 0.06 | 12.18 | 0.06 | 4.65 | 900 |
| M538 | 1.5 | 10.00 | 1.03 | 10.00 | 3.30 | 0.00 | 4.54 | 0.06 | 11.60 | 0.06 | 4.66 | 900 |
| M539 | 1.5 | 10.00 | 1.03 | 9.00 | 3.30 | 0.00 | 4.55 | 0.05 | 10.44 | 0.06 | 4.66 | 900 |
| M540 | 1.5 | 10.00 | 1.03 | 9.50 | 3.30 | 0.00 | 4.55 | 0.06 | 11.02 | 0.06 | 4.67 | 900 |
| M541 | 1.5 | 10.00 | 1.03 | 8.50 | 3.30 | 0.00 | 4.56 | 0.05 | 9.86 | 0.06 | 4.67 | 900 |
| M542 | 1.5 | 10.00 | 1.03 | 8.00 | 3.30 | 0.00 | 4.57 | 0.05 | 9.28 | 0.06 | 4.68 | 900 |
| M543 | 1.5 | 10.50 | 1.03 | 22.50 | 3.30 | 0.00 | 4.87 | 0.06 | 26.10 | 0.08 | 5.01 | 750 |
| M544 | 1.5 | 10.50 | 1.03 | 22.00 | 3.30 | 0.00 | 4.88 | 0.06 | 25.53 | 0.08 | 5.02 | 750 |
| M545 | 1.5 | 10.50 | 1.03 | 21.50 | 3.30 | 0.00 | 4.89 | 0.06 | 24.95 | 0.08 | 5.03 | 750 |
| M546 | 1.5 | 10.50 | 1.03 | 21.00 | 3.30 | 0.00 | 4.90 | 0.06 | 24.37 | 0.08 | 5.04 | 750 |
| M547 | 1.5 | 10.50 | 1.03 | 20.00 | 3.30 | 0.00 | 4.91 | 0.06 | 23.21 | 0.08 | 5.05 | 800 |
| M548 | 1.5 | 10.50 | 1.03 | 20.50 | 3.30 | 0.00 | 4.91 | 0.06 | 23.79 | 0.08 | 5.05 | 800 |
| M549 | 1.5 | 10.50 | 1.03 | 19.50 | 3.30 | 0.00 | 4.92 | 0.05 | 22.63 | 0.08 | 5.05 | 800 |
| M550 | 1.5 | 10.50 | 1.03 | 19.00 | 3.30 | 0.00 | 4.93 | 0.05 | 22.05 | 0.08 | 5.06 | 800 |
| M551 | 1.5 | 10.50 | 1.03 | 18.50 | 3.30 | 0.00 | 4.93 | 0.05 | 21.47 | 0.08 | 5.06 | 800 |
| M552 | 1.5 | 10.50 | 1.03 | 18.00 | 3.30 | 0.00 | 4.94 | 0.05 | 20.89 | 0.08 | 5.07 | 800 |
| M553 | 1.5 | 10.50 | 1.03 | 17.50 | 3.30 | 0.00 | 4.92 | 0.07 | 20.30 | 0.08 | 5.07 | 800 |
| M554 | 1.5 | 10.50 | 1.03 | 16.50 | 3.30 | 0.00 | 4.93 | 0.07 | 19.14 | 0.08 | 5.08 | 800 |
| M555 | 1.5 | 10.50 | 1.03 | 17.00 | 3.30 | 0.00 | 4.93 | 0.07 | 19.72 | 0.08 | 5.08 | 800 |
| M556 | 1.5 | 10.50 | 1.03 | 16.00 | 3.30 | 0.00 | 4.94 | 0.07 | 18.56 | 0.08 | 5.09 | 800 |
| M557 | 1.5 | 10.50 | 1.03 | 14.50 | 3.30 | 0.00 | 4.96 | 0.06 | 16.82 | 0.07 | 5.09 | 850 |
| M558 | 1.5 | 10.50 | 1.03 | 15.50 | 3.30 | 0.00 | 4.95 | 0.07 | 17.98 | 0.08 | 5.10 | 850 |
| M559 | 1.5 | 10.50 | 1.03 | 15.00 | 3.30 | 0.00 | 4.96 | 0.07 | 17.40 | 0.07 | 5.10 | 850 |
| M560 | 1.5 | 10.50 | 1.03 | 14.00 | 3.30 | 0.00 | 4.97 | 0.06 | 16.24 | 0.07 | 5.10 | 850 |
| M561 | 1.5 | 10.50 | 1.03 | 13.50 | 3.30 | 0.00 | 4.98 | 0.06 | 15.66 | 0.07 | 5.11 | 850 |
| M562 | 1.5 | 10.50 | 1.03 | 13.00 | 3.30 | 0.00 | 4.98 | 0.06 | 15.08 | 0.07 | 5.11 | 850 |
| M563 | 1.5 | 10.50 | 1.03 | 12.50 | 3.30 | 0.00 | 4.99 | 0.06 | 14.50 | 0.07 | 5.12 | 850 |
| M564 | 1.5 | 10.50 | 1.03 | 12.00 | 3.30 | 0.00 | 5.00 | 0.06 | 13.92 | 0.07 | 5.13 | 850 |
| M565 | 1.5 | 10.50 | 1.03 | 11.50 | 3.30 | 0.00 | 5.00 | 0.06 | 13.34 | 0.07 | 5.13 | 850 |
| M566 | 1.5 | 10.50 | 1.03 | 11.00 | 3.30 | 0.00 | 5.01 | 0.06 | 12.76 | 0.07 | 5.14 | 900 |
| M567 | 1.5 | 10.50 | 1.03 | 10.50 | 3.30 | 0.00 | 5.02 | 0.06 | 12.18 | 0.07 | 5.15 | 900 |
| M568 | 1.5 | 10.50 | 1.03 | 9.50 | 3.30 | 0.00 | 5.03 | 0.06 | 11.02 | 0.07 | 5.16 | 900 |
| M569 | 1.5 | 10.50 | 1.03 | 10.00 | 3.30 | 0.00 | 5.03 | 0.06 | 11.60 | 0.07 | 5.16 | 900 |
| M570 | 1.5 | 10.50 | 1.03 | 8.50 | 3.30 | 0.00 | 5.05 | 0.06 | 9.86 | 0.06 | 5.17 | 900 |
| M571 | 1.5 | 10.50 | 1.03 | 9.00 | 3.30 | 0.00 | 5.04 | 0.06 | 10.44 | 0.07 | 5.17 | 900 |
| M572 | 1.5 | 10.50 | 1.03 | 7.50 | 3.30 | 0.00 | 5.06 | 0.05 | 8.70 | 0.06 | 5.17 | 900 |
| M573 | 1.5 | 10.50 | 1.03 | 8.00 | 3.30 | 0.00 | 5.06 | 0.06 | 9.28 | 0.06 | 5.18 | 900 |
| M574 | 1.5 | 11.00 | 1.03 | 22.50 | 3.30 | 0.00 | 5.26 | 0.07 | 26.08 | 0.09 | 5.42 | 750 |
| M575 | 1.5 | 11.00 | 1.03 | 22.00 | 3.30 | 0.00 | 5.28 | 0.07 | 25.51 | 0.09 | 5.44 | 750 |
| M576 | 1.5 | 11.00 | 1.03 | 21.50 | 3.30 | 0.00 | 5.29 | 0.06 | 24.93 | 0.09 | 5.44 | 750 |
| M577 | 1.5 | 11.00 | 1.03 | 21.00 | 3.30 | 0.00 | 5.31 | 0.06 | 24.35 | 0.09 | 5.46 | 750 |
| M578 | 1.5 | 11.00 | 1.03 | 20.50 | 3.30 | 0.00 | 5.32 | 0.06 | 23.77 | 0.09 | 5.47 | 800 |
| M579 | 1.5 | 11.00 | 1.03 | 20.00 | 3.30 | 0.00 | 5.34 | 0.06 | 23.19 | 0.09 | 5.49 | 800 |
| M580 | 1.5 | 11.00 | 1.03 | 19.50 | 3.30 | 0.00 | 5.36 | 0.06 | 22.62 | 0.09 | 5.51 | 800 |
| M581 | 1.5 | 11.00 | 1.03 | 19.00 | 3.30 | 0.00 | 5.37 | 0.06 | 22.04 | 0.09 | 5.52 | 800 |
| M582 | 1.5 | 11.00 | 1.03 | 18.50 | 3.30 | 0.00 | 5.39 | 0.06 | 21.46 | 0.09 | 5.54 | 800 |
| M583 | 1.5 | 11.00 | 1.03 | 18.00 | 3.30 | 0.00 | 5.40 | 0.06 | 20.88 | 0.09 | 5.55 | 800 |
| M584 | 1.5 | 11.00 | 1.03 | 17.50 | 3.30 | 0.00 | 5.42 | 0.05 | 20.30 | 0.08 | 5.55 | 800 |
| M585 | 1.5 | 11.00 | 1.03 | 17.00 | 3.30 | 0.00 | 5.41 | 0.07 | 19.72 | 0.09 | 5.57 | 800 |
| M586 | 1.5 | 11.00 | 1.03 | 16.00 | 3.30 | 0.00 | 5.43 | 0.07 | 18.56 | 0.08 | 5.58 | 800 |
| M587 | 1.5 | 11.00 | 1.03 | 16.50 | 3.30 | 0.00 | 5.42 | 0.07 | 19.14 | 0.09 | 5.58 | 800 |
| M588 | 1.5 | 11.00 | 1.03 | 15.00 | 3.30 | 0.00 | 5.44 | 0.07 | 17.40 | 0.08 | 5.59 | 850 |
| M589 | 1.5 | 11.00 | 1.03 | 15.50 | 3.30 | 0.00 | 5.44 | 0.07 | 17.98 | 0.08 | 5.59 | 850 |
| M590 | 1.5 | 11.00 | 1.03 | 14.50 | 3.30 | 0.00 | 5.45 | 0.07 | 16.82 | 0.08 | 5.60 | 850 |
| M591 | 1.5 | 11.00 | 1.03 | 14.00 | 3.30 | 0.00 | 5.46 | 0.07 | 16.24 | 0.08 | 5.61 | 850 |
| M592 | 1.5 | 11.00 | 1.03 | 13.00 | 3.30 | 0.00 | 5.47 | 0.06 | 15.08 | 0.08 | 5.61 | 850 |
| M593 | 1.5 | 11.00 | 1.03 | 13.50 | 3.30 | 0.00 | 5.47 | 0.07 | 15.66 | 0.08 | 5.62 | 850 |
| M594 | 1.5 | 11.00 | 1.03 | 12.50 | 3.30 | 0.00 | 5.48 | 0.06 | 14.50 | 0.08 | 5.62 | 850 |
| M595 | 1.5 | 11.00 | 1.03 | 12.00 | 3.30 | 0.00 | 5.49 | 0.06 | 13.92 | 0.08 | 5.63 | 850 |
| M596 | 1.5 | 11.00 | 1.03 | 11.50 | 3.30 | 0.00 | 5.49 | 0.06 | 13.34 | 0.08 | 5.63 | 850 |
| M597 | 1.5 | 11.00 | 1.03 | 11.00 | 3.30 | 0.00 | 5.50 | 0.06 | 12.76 | 0.08 | 5.64 | 900 |
| M598 | 1.5 | 11.00 | 1.03 | 10.00 | 3.30 | 0.00 | 5.52 | 0.06 | 11.60 | 0.07 | 5.65 | 900 |
| M599 | 1.5 | 11.00 | 1.03 | 10.50 | 3.30 | 0.00 | 5.51 | 0.06 | 12.18 | 0.08 | 5.65 | 900 |
| M600 | 1.5 | 11.00 | 1.03 | 9.50 | 3.30 | 0.00 | 5.52 | 0.06 | 11.02 | 0.07 | 5.65 | 900 |
| M601 | 1.5 | 11.00 | 1.03 | 9.00 | 3.30 | 0.00 | 5.53 | 0.06 | 10.44 | 0.07 | 5.66 | 900 |
| M602 | 1.5 | 11.00 | 1.03 | 8.50 | 3.30 | 0.00 | 5.54 | 0.06 | 9.86 | 0.07 | 5.67 | 900 |
| M603 | 1.5 | 11.00 | 1.03 | 8.00 | 3.30 | 0.00 | 5.55 | 0.06 | 9.28 | 0.07 | 5.68 | 900 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M604 | 1.5 | 11.00 | 1.03 | 7.50 | 3.30 | 0.00 | 5.55 | 0.06 | 8.70 | 0.07 | 5.68 | 900 |
| M605 | 1.5 | 11.27 | 1.03 | 20.00 | 3.30 | 0.00 | 5.56 | 0.06 | 23.18 | 0.09 | 5.71 | 800 |
| M606 | 1.5 | 11.50 | 1.03 | 22.50 | 3.30 | 0.00 | 5.68 | 0.07 | 26.08 | 0.10 | 5.85 | 750 |
| M607 | 1.5 | 11.50 | 1.03 | 22.00 | 3.30 | 0.00 | 5.70 | 0.07 | 25.49 | 0.10 | 5.87 | 750 |
| M608 | 1.5 | 11.50 | 1.03 | 21.50 | 3.30 | 0.00 | 5.71 | 0.07 | 24.91 | 0.10 | 5.88 | 750 |
| M609 | 1.5 | 11.50 | 1.03 | 21.00 | 3.30 | 0.00 | 5.73 | 0.07 | 24.33 | 0.10 | 5.90 | 750 |
| M610 | 1.5 | 11.50 | 1.03 | 20.50 | 3.30 | 0.00 | 5.74 | 0.07 | 23.76 | 0.10 | 5.91 | 800 |
| M611 | 1.5 | 11.50 | 1.03 | 20.00 | 3.30 | 0.00 | 5.76 | 0.07 | 23.18 | 0.10 | 5.93 | 800 |
| M612 | 1.5 | 11.50 | 1.03 | 19.50 | 3.30 | 0.00 | 5.77 | 0.07 | 22.60 | 0.10 | 5.94 | 800 |
| M613 | 1.5 | 11.50 | 1.03 | 19.00 | 3.30 | 0.00 | 5.79 | 0.06 | 22.02 | 0.10 | 5.95 | 800 |
| M614 | 1.5 | 11.50 | 1.03 | 18.50 | 3.30 | 0.00 | 5.80 | 0.06 | 21.44 | 0.10 | 5.96 | 800 |
| M615 | 1.5 | 11.50 | 1.03 | 18.00 | 3.30 | 0.00 | 5.82 | 0.06 | 20.87 | 0.09 | 5.97 | 800 |
| M616 | 1.5 | 11.50 | 1.03 | 17.50 | 3.30 | 0.00 | 5.83 | 0.06 | 20.29 | 0.09 | 5.98 | 800 |
| M617 | 1.5 | 11.50 | 1.03 | 17.00 | 3.30 | 0.00 | 5.85 | 0.06 | 19.71 | 0.09 | 6.00 | 800 |
| M618 | 1.5 | 11.50 | 1.03 | 16.50 | 3.30 | 0.00 | 5.91 | 0.07 | 19.14 | 0.09 | 6.07 | 800 |
| M619 | 1.5 | 11.50 | 1.03 | 16.00 | 3.30 | 0.00 | 5.92 | 0.07 | 18.56 | 0.09 | 6.08 | 800 |
| M620 | 1.5 | 11.50 | 1.03 | 15.50 | 3.30 | 0.00 | 5.93 | 0.07 | 17.98 | 0.09 | 6.09 | 850 |
| M621 | 1.5 | 11.50 | 1.03 | 15.00 | 3.30 | 0.00 | 5.94 | 0.07 | 17.40 | 0.09 | 6.10 | 850 |
| M622 | 1.5 | 11.50 | 1.03 | 14.50 | 3.30 | 0.00 | 5.94 | 0.07 | 16.82 | 0.09 | 6.10 | 850 |
| M623 | 1.5 | 11.50 | 1.03 | 14.00 | 3.30 | 0.00 | 5.95 | 0.07 | 16.24 | 0.09 | 6.11 | 850 |
| M624 | 1.5 | 11.50 | 1.03 | 13.50 | 3.30 | 0.00 | 5.96 | 0.07 | 15.66 | 0.09 | 6.12 | 850 |
| M625 | 1.5 | 11.50 | 1.03 | 13.00 | 3.30 | 0.00 | 5.97 | 0.07 | 15.08 | 0.09 | 6.13 | 850 |
| M626 | 1.5 | 11.50 | 1.03 | 12.00 | 3.30 | 0.00 | 5.98 | 0.06 | 13.92 | 0.09 | 6.13 | 850 |
| M627 | 1.5 | 11.50 | 1.03 | 12.50 | 3.30 | 0.00 | 5.97 | 0.07 | 14.50 | 0.09 | 6.13 | 850 |
| M628 | 1.5 | 11.50 | 1.03 | 11.50 | 3.30 | 0.00 | 5.99 | 0.06 | 13.34 | 0.09 | 6.14 | 850 |
| M629 | 1.5 | 11.50 | 1.03 | 11.00 | 3.30 | 0.00 | 6.00 | 0.06 | 12.76 | 0.08 | 6.14 | 900 |
| M630 | 1.5 | 11.50 | 1.03 | 10.50 | 3.30 | 0.00 | 6.00 | 0.06 | 12.18 | 0.08 | 6.14 | 900 |
| M631 | 1.5 | 11.50 | 1.03 | 10.00 | 3.30 | 0.00 | 6.01 | 0.06 | 11.60 | 0.08 | 6.15 | 900 |
| M632 | 1.5 | 11.50 | 1.03 | 9.50 | 3.30 | 0.00 | 6.02 | 0.06 | 11.02 | 0.08 | 6.16 | 900 |
| M633 | 1.5 | 11.50 | 1.03 | 9.00 | 3.30 | 0.00 | 6.03 | 0.06 | 10.44 | 0.08 | 6.17 | 900 |
| M634 | 1.5 | 11.50 | 1.03 | 8.50 | 3.30 | 0.00 | 6.04 | 0.06 | 9.86 | 0.08 | 6.18 | 900 |
| M635 | 1.5 | 11.50 | 1.03 | 8.00 | 3.30 | 0.00 | 6.04 | 0.06 | 9.28 | 0.08 | 6.18 | 900 |
| M636 | 1.5 | 11.50 | 1.03 | 7.50 | 3.30 | 0.00 | 6.05 | 0.06 | 8.70 | 0.08 | 6.19 | 900 |
| M637 | 1.5 | 12.00 | 1.03 | 22.50 | 3.30 | 0.00 | 6.12 | 0.08 | 26.05 | 0.12 | 6.32 | 750 |
| M638 | 1.5 | 12.00 | 1.03 | 22.00 | 3.30 | 0.00 | 6.14 | 0.08 | 25.48 | 0.11 | 6.33 | 750 |
| M639 | 1.5 | 12.00 | 1.03 | 21.50 | 3.30 | 0.00 | 6.15 | 0.08 | 24.90 | 0.11 | 6.34 | 750 |
| M640 | 1.5 | 12.00 | 1.03 | 21.00 | 3.30 | 0.00 | 6.17 | 0.08 | 24.32 | 0.11 | 6.36 | 750 |
| M641 | 1.5 | 12.00 | 1.03 | 20.50 | 3.30 | 0.00 | 6.18 | 0.08 | 23.74 | 0.11 | 6.37 | 800 |
| M642 | 1.5 | 12.00 | 1.03 | 20.00 | 3.30 | 0.00 | 6.19 | 0.08 | 23.16 | 0.11 | 6.38 | 800 |
| M643 | 1.5 | 12.00 | 1.03 | 19.50 | 3.30 | 0.00 | 6.21 | 0.07 | 22.59 | 0.11 | 6.39 | 800 |
| M644 | 1.5 | 12.00 | 1.03 | 19.00 | 3.30 | 0.00 | 6.22 | 0.07 | 22.01 | 0.11 | 6.40 | 800 |
| M645 | 1.5 | 12.00 | 1.03 | 18.50 | 3.30 | 0.00 | 6.24 | 0.07 | 21.43 | 0.11 | 6.42 | 800 |
| M646 | 1.5 | 12.00 | 1.03 | 18.00 | 3.30 | 0.00 | 6.25 | 0.07 | 20.85 | 0.11 | 6.43 | 850 |
| M647 | 1.5 | 12.00 | 1.03 | 17.50 | 3.30 | 0.00 | 6.27 | 0.07 | 20.28 | 0.10 | 6.44 | 800 |
| M648 | 1.5 | 12.00 | 1.03 | 17.00 | 3.30 | 0.00 | 6.28 | 0.07 | 19.70 | 0.10 | 6.45 | 800 |
| M649 | 1.5 | 12.00 | 1.03 | 16.50 | 3.30 | 0.00 | 6.41 | 0.07 | 19.13 | 0.10 | 6.58 | 800 |
| M650 | 1.5 | 12.00 | 1.03 | 15.50 | 3.30 | 0.00 | 6.42 | 0.07 | 17.97 | 0.10 | 6.59 | 800 |
| M651 | 1.5 | 12.00 | 1.03 | 16.00 | 3.30 | 0.00 | 6.42 | 0.07 | 18.55 | 0.10 | 6.59 | 800 |
| M652 | 1.5 | 12.00 | 1.03 | 15.00 | 3.30 | 0.00 | 6.43 | 0.07 | 17.39 | 0.10 | 6.60 | 850 |
| M653 | 1.5 | 12.00 | 1.03 | 14.50 | 3.30 | 0.00 | 6.44 | 0.07 | 16.81 | 0.10 | 6.61 | 850 |
| M654 | 1.5 | 12.00 | 1.03 | 14.00 | 3.30 | 0.00 | 6.45 | 0.07 | 16.24 | 0.10 | 6.62 | 850 |
| M655 | 1.5 | 12.00 | 1.03 | 13.50 | 3.30 | 0.00 | 6.46 | 0.07 | 15.66 | 0.10 | 6.63 | 850 |
| M656 | 1.5 | 12.00 | 1.03 | 13.00 | 3.30 | 0.00 | 6.46 | 0.07 | 15.08 | 0.10 | 6.63 | 850 |
| M657 | 1.5 | 12.00 | 1.03 | 12.50 | 3.30 | 0.00 | 6.47 | 0.07 | 14.50 | 0.10 | 6.64 | 850 |
| M658 | 1.5 | 12.00 | 1.03 | 12.00 | 3.30 | 0.00 | 6.48 | 0.07 | 13.92 | 0.09 | 6.64 | 850 |
| M659 | 1.5 | 12.00 | 1.03 | 11.50 | 3.30 | 0.00 | 6.49 | 0.07 | 13.34 | 0.09 | 6.65 | 850 |
| M660 | 1.5 | 12.00 | 1.03 | 10.50 | 3.30 | 0.00 | 6.50 | 0.06 | 12.18 | 0.09 | 6.65 | 900 |
| M661 | 1.5 | 12.00 | 1.03 | 11.00 | 3.30 | 0.00 | 6.50 | 0.07 | 12.76 | 0.09 | 6.66 | 850 |
| M662 | 1.5 | 12.00 | 1.03 | 10.00 | 3.30 | 0.00 | 6.51 | 0.06 | 11.60 | 0.09 | 6.66 | 900 |
| M663 | 1.5 | 12.00 | 1.03 | 9.50 | 3.30 | 0.00 | 6.52 | 0.06 | 11.02 | 0.09 | 6.67 | 900 |
| M664 | 1.5 | 12.00 | 1.03 | 9.00 | 3.30 | 0.00 | 6.53 | 0.06 | 10.44 | 0.09 | 6.68 | 900 |
| M665 | 1.5 | 12.00 | 1.03 | 8.00 | 3.30 | 0.00 | 6.54 | 0.06 | 9.28 | 0.09 | 6.69 | 900 |
| M666 | 1.5 | 12.00 | 1.03 | 8.50 | 3.30 | 0.00 | 6.54 | 0.06 | 9.86 | 0.09 | 6.69 | 900 |
| M667 | 1.5 | 12.00 | 1.03 | 7.50 | 3.30 | 0.00 | 6.55 | 0.06 | 8.70 | 0.09 | 6.70 | 900 |
| M668 | 1.5 | 12.50 | 1.03 | 22.50 | 3.30 | 0.00 | 6.58 | 0.09 | 26.04 | 0.13 | 6.80 | 750 |
| M669 | 1.5 | 12.50 | 1.03 | 22.00 | 3.30 | 0.00 | 6.59 | 0.09 | 25.47 | 0.13 | 6.81 | 750 |
| M670 | 1.5 | 12.50 | 1.03 | 21.50 | 3.30 | 0.00 | 6.60 | 0.09 | 24.89 | 0.13 | 6.82 | 750 |
| M671 | 1.5 | 12.50 | 1.03 | 21.00 | 3.30 | 0.00 | 6.62 | 0.09 | 24.31 | 0.12 | 6.83 | 750 |
| M672 | 1.5 | 12.50 | 1.03 | 20.50 | 3.30 | 0.00 | 6.63 | 0.08 | 23.73 | 0.12 | 6.83 | 750 |
| M673 | 1.5 | 12.50 | 1.03 | 20.00 | 3.30 | 0.00 | 6.65 | 0.08 | 23.16 | 0.12 | 6.85 | 800 |
| M674 | 1.5 | 12.50 | 1.03 | 19.50 | 3.30 | 0.00 | 6.66 | 0.08 | 22.58 | 0.12 | 6.86 | 800 |
| M675 | 1.5 | 12.50 | 1.03 | 19.00 | 3.30 | 0.00 | 6.67 | 0.08 | 22.00 | 0.12 | 6.87 | 800 |
| M676 | 1.5 | 12.50 | 1.03 | 18.50 | 3.30 | 0.00 | 6.69 | 0.08 | 21.42 | 0.12 | 6.89 | 800 |
| M677 | 1.5 | 12.50 | 1.03 | 17.50 | 3.30 | 0.00 | 6.71 | 0.07 | 20.27 | 0.11 | 6.89 | 800 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M678 | 1.5 | 12.50 | 1.03 | 18.00 | 3.30 | 0.00 | 6.70 | 0.08 | 20.84 | 0.12 | 6.90 | 800 |
| M679 | 1.5 | 12.50 | 1.03 | 17.00 | 3.30 | 0.00 | 6.73 | 0.07 | 19.69 | 0.11 | 6.91 | 800 |
| M680 | 1.5 | 12.50 | 1.03 | 16.50 | 3.30 | 0.00 | 6.74 | 0.07 | 19.11 | 0.11 | 6.92 | 800 |
| M681 | 1.5 | 12.50 | 1.03 | 15.50 | 3.30 | 0.00 | 6.92 | 0.07 | 17.97 | 0.11 | 7.10 | 800 |
| M682 | 1.5 | 12.50 | 1.03 | 16.00 | 3.30 | 0.00 | 6.92 | 0.08 | 18.55 | 0.11 | 7.11 | 850 |
| M683 | 1.5 | 12.50 | 1.03 | 15.00 | 3.30 | 0.00 | 6.93 | 0.07 | 17.39 | 0.11 | 7.11 | 850 |
| M684 | 1.5 | 12.50 | 1.03 | 14.50 | 3.30 | 0.00 | 6.94 | 0.07 | 16.81 | 0.11 | 7.12 | 850 |
| M685 | 1.5 | 12.50 | 1.03 | 14.00 | 3.30 | 0.00 | 6.95 | 0.07 | 16.23 | 0.11 | 7.13 | 850 |
| M686 | 1.5 | 12.50 | 1.03 | 13.50 | 3.30 | 0.00 | 6.96 | 0.07 | 15.65 | 0.11 | 7.14 | 850 |
| M687 | 1.5 | 12.50 | 1.03 | 13.00 | 3.30 | 0.00 | 6.96 | 0.07 | 15.07 | 0.11 | 7.14 | 850 |
| M688 | 1.5 | 12.50 | 1.03 | 12.50 | 3.30 | 0.00 | 6.97 | 0.07 | 14.49 | 0.10 | 7.14 | 850 |
| M689 | 1.5 | 12.50 | 1.03 | 12.00 | 3.30 | 0.00 | 6.98 | 0.07 | 13.91 | 0.10 | 7.15 | 850 |
| M690 | 1.5 | 12.50 | 1.03 | 11.50 | 3.30 | 0.00 | 6.99 | 0.07 | 13.34 | 0.10 | 7.16 | 850 |
| M691 | 1.5 | 12.50 | 1.03 | 11.00 | 3.30 | 0.00 | 7.00 | 0.07 | 12.76 | 0.10 | 7.17 | 850 |
| M692 | 1.5 | 12.50 | 1.03 | 10.50 | 3.30 | 0.00 | 7.00 | 0.07 | 12.18 | 0.10 | 7.17 | 900 |
| M693 | 1.5 | 12.50 | 1.03 | 10.00 | 3.30 | 0.00 | 7.01 | 0.07 | 11.60 | 0.10 | 7.18 | 900 |
| M694 | 1.5 | 12.50 | 1.03 | 9.50 | 3.30 | 0.00 | 7.02 | 0.06 | 11.02 | 0.10 | 7.18 | 900 |
| M695 | 1.5 | 12.50 | 1.03 | 9.00 | 3.30 | 0.00 | 7.03 | 0.06 | 10.44 | 0.10 | 7.19 | 900 |
| M696 | 1.5 | 12.50 | 1.03 | 8.00 | 3.30 | 0.00 | 7.05 | 0.06 | 9.28 | 0.09 | 7.20 | 900 |
| M697 | 1.5 | 12.50 | 1.03 | 8.50 | 3.30 | 0.00 | 7.04 | 0.06 | 9.86 | 0.10 | 7.20 | 900 |
| M698 | 1.5 | 12.50 | 1.03 | 7.50 | 3.30 | 0.00 | 7.06 | 0.06 | 8.70 | 0.09 | 7.21 | 900 |
| M699 | 1.5 | 12.50 | 1.03 | 7.00 | 3.30 | 0.00 | 7.06 | 0.06 | 8.12 | 0.09 | 7.21 | 900 |
| M700 | 1.5 | 13.00 | 1.03 | 22.50 | 3.30 | 0.00 | 7.04 | 0.10 | 26.04 | 0.14 | 7.28 | 750 |
| M701 | 1.5 | 13.00 | 1.03 | 22.00 | 3.30 | 0.00 | 7.06 | 0.10 | 25.46 | 0.14 | 7.30 | 750 |
| M702 | 1.5 | 13.00 | 1.03 | 21.50 | 3.30 | 0.00 | 7.07 | 0.10 | 24.88 | 0.14 | 7.31 | 750 |
| M703 | 1.5 | 13.00 | 1.03 | 21.00 | 3.30 | 0.00 | 7.08 | 0.09 | 24.30 | 0.14 | 7.31 | 750 |
| M704 | 1.5 | 13.00 | 1.03 | 20.50 | 3.30 | 0.00 | 7.10 | 0.09 | 23.73 | 0.13 | 7.32 | 750 |
| M705 | 1.5 | 13.00 | 1.03 | 20.00 | 3.30 | 0.00 | 7.11 | 0.09 | 23.15 | 0.13 | 7.33 | 800 |
| M706 | 1.5 | 13.00 | 1.03 | 19.50 | 3.30 | 0.00 | 7.12 | 0.09 | 22.57 | 0.13 | 7.34 | 800 |
| M707 | 1.5 | 13.00 | 1.03 | 19.00 | 3.30 | 0.00 | 7.14 | 0.09 | 21.99 | 0.13 | 7.36 | 800 |
| M708 | 1.5 | 13.00 | 1.03 | 18.50 | 3.30 | 0.00 | 7.15 | 0.08 | 21.41 | 0.13 | 7.36 | 800 |
| M709 | 1.5 | 13.00 | 1.03 | 18.00 | 3.30 | 0.00 | 7.16 | 0.08 | 20.84 | 0.13 | 7.37 | 800 |
| M710 | 1.5 | 13.00 | 1.03 | 17.50 | 3.30 | 0.00 | 7.18 | 0.08 | 20.26 | 0.13 | 7.39 | 800 |
| M711 | 1.5 | 13.00 | 1.03 | 17.00 | 3.30 | 0.00 | 7.19 | 0.08 | 19.68 | 0.12 | 7.39 | 800 |
| M712 | 1.5 | 13.00 | 1.03 | 16.50 | 3.30 | 0.00 | 7.20 | 0.08 | 19.10 | 0.12 | 7.40 | 800 |
| M713 | 1.5 | 13.00 | 1.03 | 16.00 | 3.30 | 0.00 | 7.22 | 0.08 | 18.52 | 0.12 | 7.42 | 850 |
| M714 | 1.5 | 13.00 | 1.03 | 15.50 | 3.30 | 0.00 | 7.43 | 0.08 | 17.97 | 0.12 | 7.63 | 800 |
| M715 | 1.5 | 13.00 | 1.03 | 15.00 | 3.30 | 0.00 | 7.43 | 0.08 | 17.39 | 0.12 | 7.63 | 850 |
| M716 | 1.5 | 13.00 | 1.03 | 14.50 | 3.30 | 0.00 | 7.44 | 0.07 | 16.81 | 0.12 | 7.63 | 850 |
| M717 | 1.5 | 13.00 | 1.03 | 14.00 | 3.30 | 0.00 | 7.45 | 0.07 | 16.23 | 0.12 | 7.64 | 850 |
| M718 | 1.5 | 13.00 | 1.03 | 13.50 | 3.30 | 0.00 | 7.46 | 0.07 | 15.65 | 0.12 | 7.65 | 850 |
| M719 | 1.5 | 13.00 | 1.03 | 13.00 | 3.30 | 0.00 | 7.47 | 0.07 | 15.07 | 0.11 | 7.65 | 850 |
| M720 | 1.5 | 13.00 | 1.03 | 12.00 | 3.30 | 0.00 | 7.48 | 0.07 | 13.91 | 0.11 | 7.66 | 850 |
| M721 | 1.5 | 13.00 | 1.03 | 12.50 | 3.30 | 0.00 | 7.48 | 0.07 | 14.49 | 0.11 | 7.66 | 850 |
| M722 | 1.5 | 13.00 | 1.03 | 11.50 | 3.30 | 0.00 | 7.49 | 0.07 | 13.33 | 0.11 | 7.67 | 850 |
| M723 | 1.5 | 13.00 | 1.03 | 11.00 | 3.30 | 0.00 | 7.50 | 0.07 | 12.75 | 0.11 | 7.68 | 850 |
| M724 | 1.5 | 13.00 | 1.03 | 10.50 | 3.30 | 0.00 | 7.51 | 0.07 | 12.17 | 0.11 | 7.69 | 900 |
| M725 | 1.5 | 13.00 | 1.03 | 10.00 | 3.30 | 0.00 | 7.52 | 0.07 | 11.60 | 0.11 | 7.70 | 900 |
| M726 | 1.5 | 13.00 | 1.03 | 8.50 | 3.30 | 0.00 | 7.54 | 0.06 | 9.86 | 0.10 | 7.70 | 900 |
| M727 | 1.5 | 13.00 | 1.03 | 9.50 | 3.30 | 0.00 | 7.53 | 0.07 | 11.02 | 0.11 | 7.71 | 900 |
| M728 | 1.5 | 13.00 | 1.03 | 8.00 | 3.30 | 0.00 | 7.55 | 0.06 | 9.28 | 0.10 | 7.71 | 900 |
| M729 | 1.5 | 13.00 | 1.03 | 9.00 | 3.30 | 0.00 | 7.54 | 0.07 | 10.44 | 0.11 | 7.72 | 900 |
| M730 | 1.5 | 13.00 | 1.03 | 7.50 | 3.30 | 0.00 | 7.56 | 0.06 | 8.70 | 0.10 | 7.72 | 900 |
| M731 | 1.5 | 13.00 | 1.03 | 7.00 | 3.30 | 0.00 | 7.57 | 0.06 | 8.12 | 0.10 | 7.73 | 900 |
| M732 | 1.5 | 13.50 | 1.03 | 22.50 | 3.30 | 0.00 | 7.52 | 0.11 | 26.03 | 0.15 | 7.78 | 750 |
| M733 | 1.5 | 13.50 | 1.03 | 22.00 | 3.30 | 0.00 | 7.53 | 0.11 | 25.45 | 0.15 | 7.79 | 750 |
| M734 | 1.5 | 13.50 | 1.03 | 21.50 | 3.30 | 0.00 | 7.55 | 0.10 | 24.88 | 0.15 | 7.80 | 750 |
| M735 | 1.5 | 13.50 | 1.03 | 21.00 | 3.30 | 0.00 | 7.56 | 0.10 | 24.30 | 0.15 | 7.81 | 750 |
| M736 | 1.5 | 13.50 | 1.03 | 20.50 | 3.30 | 0.00 | 7.57 | 0.10 | 23.72 | 0.15 | 7.82 | 750 |
| M737 | 1.5 | 13.50 | 1.03 | 20.00 | 3.30 | 0.00 | 7.59 | 0.10 | 23.14 | 0.15 | 7.84 | 800 |
| M738 | 1.5 | 13.50 | 1.03 | 19.00 | 3.30 | 0.00 | 7.61 | 0.09 | 21.99 | 0.14 | 7.84 | 800 |
| M739 | 1.5 | 13.50 | 1.03 | 19.50 | 3.30 | 0.00 | 7.60 | 0.10 | 22.56 | 0.14 | 7.84 | 800 |
| M740 | 1.5 | 13.50 | 1.03 | 18.50 | 3.30 | 0.00 | 7.62 | 0.09 | 21.41 | 0.14 | 7.85 | 800 |
| M741 | 1.5 | 13.50 | 1.03 | 18.00 | 3.30 | 0.00 | 7.64 | 0.09 | 20.83 | 0.14 | 7.87 | 800 |
| M742 | 1.5 | 13.50 | 1.03 | 17.50 | 3.30 | 0.00 | 7.65 | 0.09 | 20.25 | 0.14 | 7.88 | 800 |
| M743 | 1.5 | 13.50 | 1.03 | 17.00 | 3.30 | 0.00 | 7.66 | 0.09 | 19.68 | 0.14 | 7.89 | 800 |
| M744 | 1.5 | 13.50 | 1.03 | 16.50 | 3.30 | 0.00 | 7.68 | 0.08 | 19.10 | 0.14 | 7.90 | 800 |
| M745 | 1.5 | 13.50 | 1.03 | 16.00 | 3.30 | 0.00 | 7.69 | 0.08 | 18.52 | 0.13 | 7.90 | 800 |
| M746 | 1.5 | 13.50 | 1.03 | 15.50 | 3.30 | 0.00 | 7.70 | 0.08 | 17.94 | 0.13 | 7.91 | 800 |
| M747 | 1.5 | 13.50 | 1.03 | 15.00 | 3.30 | 0.00 | 7.72 | 0.08 | 17.36 | 0.13 | 7.93 | 850 |
| M748 | 1.5 | 13.50 | 1.03 | 14.50 | 3.30 | 0.00 | 7.95 | 0.08 | 16.81 | 0.13 | 8.16 | 850 |
| M749 | 1.5 | 13.50 | 1.03 | 13.50 | 3.30 | 0.00 | 7.96 | 0.07 | 15.65 | 0.13 | 8.16 | 850 |
| M750 | 1.5 | 13.50 | 1.03 | 13.00 | 3.30 | 0.00 | 7.97 | 0.07 | 15.07 | 0.12 | 8.16 | 850 |
| M751 | 1.5 | 13.50 | 1.03 | 14.00 | 3.30 | 0.00 | 7.96 | 0.08 | 16.23 | 0.13 | 8.17 | 850 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M752 | 1.5 | 13.50 | 1.03 | 12.50 | 3.30 | 0.00 | 7.98 | 0.07 | 14.49 | 0.12 | 8.17 | 850 |
| M753 | 1.5 | 13.50 | 1.03 | 12.00 | 3.30 | 0.00 | 7.99 | 0.07 | 13.91 | 0.12 | 8.18 | 850 |
| M754 | 1.5 | 13.50 | 1.03 | 11.50 | 3.30 | 0.00 | 8.00 | 0.07 | 13.33 | 0.12 | 8.19 | 850 |
| M755 | 1.5 | 13.50 | 1.03 | 11.00 | 3.30 | 0.00 | 8.01 | 0.07 | 12.75 | 0.12 | 8.20 | 850 |
| M756 | 1.5 | 13.50 | 1.03 | 10.50 | 3.30 | 0.00 | 8.02 | 0.07 | 12.17 | 0.12 | 8.21 | 850 |
| M757 | 1.5 | 13.50 | 1.03 | 10.00 | 3.30 | 0.00 | 8.03 | 0.07 | 11.59 | 0.12 | 8.22 | 900 |
| M758 | 1.5 | 13.50 | 1.03 | 9.00 | 3.30 | 0.00 | 8.04 | 0.07 | 10.44 | 0.11 | 8.22 | 900 |
| M759 | 1.5 | 13.50 | 1.03 | 9.50 | 3.30 | 0.00 | 8.03 | 0.07 | 11.01 | 0.12 | 8.22 | 900 |
| M760 | 1.5 | 13.50 | 1.03 | 8.50 | 3.30 | 0.00 | 8.05 | 0.07 | 9.86 | 0.11 | 8.23 | 900 |
| M761 | 1.5 | 13.50 | 1.03 | 7.50 | 3.30 | 0.00 | 8.07 | 0.06 | 8.70 | 0.11 | 8.24 | 900 |
| M762 | 1.5 | 13.50 | 1.03 | 8.00 | 3.30 | 0.00 | 8.06 | 0.07 | 9.28 | 0.11 | 8.24 | 900 |
| M763 | 1.5 | 13.50 | 1.03 | 7.00 | 3.30 | 0.00 | 8.08 | 0.06 | 8.12 | 0.11 | 8.25 | 900 |
| M764 | 1.5 | 14.00 | 1.03 | 22.50 | 3.30 | 0.00 | 8.00 | 0.12 | 26.03 | 0.17 | 8.29 | 750 |
| M765 | 1.5 | 14.00 | 1.03 | 22.00 | 3.30 | 0.00 | 8.02 | 0.11 | 25.45 | 0.17 | 8.30 | 750 |
| M766 | 1.5 | 14.00 | 1.03 | 21.50 | 3.30 | 0.00 | 8.03 | 0.11 | 24.87 | 0.17 | 8.31 | 750 |
| M767 | 1.5 | 14.00 | 1.03 | 21.00 | 3.30 | 0.00 | 8.04 | 0.11 | 24.29 | 0.16 | 8.31 | 750 |
| M768 | 1.5 | 14.00 | 1.03 | 20.50 | 3.30 | 0.00 | 8.05 | 0.11 | 23.72 | 0.16 | 8.32 | 750 |
| M769 | 1.5 | 14.00 | 1.03 | 20.00 | 3.30 | 0.00 | 8.07 | 0.10 | 23.14 | 0.16 | 8.33 | 800 |
| M770 | 1.5 | 14.00 | 1.03 | 19.50 | 3.30 | 0.00 | 8.08 | 0.10 | 22.56 | 0.16 | 8.34 | 800 |
| M771 | 1.5 | 14.00 | 1.03 | 19.00 | 3.30 | 0.00 | 8.09 | 0.10 | 21.98 | 0.16 | 8.35 | 800 |
| M772 | 1.5 | 14.00 | 1.03 | 18.50 | 3.30 | 0.00 | 8.11 | 0.10 | 21.40 | 0.15 | 8.36 | 800 |
| M773 | 1.5 | 14.00 | 1.03 | 18.00 | 3.30 | 0.00 | 8.12 | 0.10 | 20.83 | 0.15 | 8.37 | 800 |
| M774 | 1.5 | 14.00 | 1.03 | 17.50 | 3.30 | 0.00 | 8.13 | 0.10 | 20.25 | 0.15 | 8.38 | 800 |
| M775 | 1.5 | 14.00 | 1.03 | 17.00 | 3.30 | 0.00 | 8.15 | 0.09 | 19.67 | 0.15 | 8.39 | 800 |
| M776 | 1.5 | 14.00 | 1.03 | 16.50 | 3.30 | 0.00 | 8.16 | 0.09 | 19.09 | 0.15 | 8.40 | 800 |
| M777 | 1.5 | 14.00 | 1.03 | 16.00 | 3.30 | 0.00 | 8.17 | 0.09 | 18.52 | 0.15 | 8.41 | 850 |
| M778 | 1.5 | 14.00 | 1.03 | 15.50 | 3.30 | 0.00 | 8.18 | 0.09 | 17.94 | 0.14 | 8.41 | 800 |
| M779 | 1.5 | 14.00 | 1.03 | 15.00 | 3.30 | 0.00 | 8.20 | 0.09 | 17.36 | 0.14 | 8.43 | 800 |
| M780 | 1.5 | 14.00 | 1.03 | 14.50 | 3.30 | 0.00 | 8.21 | 0.08 | 16.78 | 0.14 | 8.43 | 850 |
| M781 | 1.5 | 14.00 | 1.03 | 14.00 | 3.30 | 0.00 | 8.46 | 0.08 | 16.23 | 0.14 | 8.68 | 850 |
| M782 | 1.5 | 14.00 | 1.03 | 13.50 | 3.30 | 0.00 | 8.47 | 0.08 | 15.65 | 0.13 | 8.68 | 850 |
| M783 | 1.5 | 14.00 | 1.03 | 12.50 | 3.30 | 0.00 | 8.49 | 0.07 | 14.49 | 0.13 | 8.69 | 850 |
| M784 | 1.5 | 14.00 | 1.03 | 13.00 | 3.30 | 0.00 | 8.48 | 0.08 | 15.07 | 0.13 | 8.69 | 850 |
| M785 | 1.5 | 14.00 | 1.03 | 12.00 | 3.30 | 0.00 | 8.50 | 0.07 | 13.91 | 0.13 | 8.70 | 850 |
| M786 | 1.5 | 14.00 | 1.03 | 11.50 | 3.30 | 0.00 | 8.51 | 0.07 | 13.33 | 0.13 | 8.71 | 850 |
| M787 | 1.5 | 14.00 | 1.03 | 11.00 | 3.30 | 0.00 | 8.52 | 0.07 | 12.75 | 0.13 | 8.72 | 850 |
| M788 | 1.5 | 14.00 | 1.03 | 10.50 | 3.30 | 0.00 | 8.53 | 0.07 | 12.17 | 0.13 | 8.73 | 850 |
| M789 | 1.5 | 14.00 | 1.03 | 10.00 | 3.30 | 0.00 | 8.54 | 0.07 | 11.59 | 0.13 | 8.74 | 900 |
| M790 | 1.5 | 14.00 | 1.03 | 9.50 | 3.30 | 0.00 | 8.54 | 0.07 | 11.01 | 0.13 | 8.74 | 900 |
| M791 | 1.5 | 14.00 | 1.03 | 9.00 | 3.30 | 0.00 | 8.55 | 0.07 | 10.43 | 0.12 | 8.74 | 900 |
| M792 | 1.5 | 14.00 | 1.03 | 8.50 | 3.30 | 0.00 | 8.56 | 0.07 | 9.86 | 0.12 | 8.75 | 900 |
| M793 | 1.5 | 14.00 | 1.03 | 8.00 | 3.30 | 0.00 | 8.57 | 0.07 | 9.28 | 0.12 | 8.76 | 900 |
| M794 | 1.5 | 14.00 | 1.03 | 7.50 | 3.30 | 0.00 | 8.58 | 0.07 | 8.70 | 0.12 | 8.77 | 900 |
| M795 | 1.5 | 14.50 | 1.03 | 22.50 | 3.30 | 0.00 | 8.49 | 0.12 | 26.03 | 0.18 | 8.79 | 750 |
| M796 | 1.5 | 14.50 | 1.03 | 22.00 | 3.30 | 0.00 | 8.50 | 0.12 | 25.45 | 0.18 | 8.80 | 750 |
| M797 | 1.5 | 14.50 | 1.03 | 21.50 | 3.30 | 0.00 | 8.52 | 0.12 | 24.87 | 0.18 | 8.82 | 750 |
| M798 | 1.5 | 14.50 | 1.03 | 21.00 | 3.30 | 0.00 | 8.53 | 0.12 | 24.29 | 0.18 | 8.83 | 750 |
| M799 | 1.5 | 14.50 | 1.03 | 20.50 | 3.30 | 0.00 | 8.54 | 0.11 | 23.71 | 0.18 | 8.83 | 750 |
| M800 | 1.5 | 14.50 | 1.03 | 20.00 | 3.30 | 0.00 | 8.56 | 0.11 | 23.14 | 0.17 | 8.84 | 750 |
| M801 | 1.5 | 14.50 | 1.03 | 19.50 | 3.30 | 0.00 | 8.57 | 0.11 | 22.56 | 0.17 | 8.85 | 800 |
| M802 | 1.5 | 14.50 | 1.03 | 19.00 | 3.30 | 0.00 | 8.58 | 0.11 | 21.98 | 0.17 | 8.86 | 800 |
| M803 | 1.5 | 14.50 | 1.03 | 18.50 | 3.30 | 0.00 | 8.60 | 0.11 | 21.40 | 0.17 | 8.88 | 800 |
| M804 | 1.5 | 14.50 | 1.03 | 17.50 | 3.30 | 0.00 | 8.62 | 0.10 | 20.25 | 0.16 | 8.88 | 800 |
| M805 | 1.5 | 14.50 | 1.03 | 18.00 | 3.30 | 0.00 | 8.61 | 0.10 | 20.82 | 0.17 | 8.88 | 800 |
| M806 | 1.5 | 14.50 | 1.03 | 17.00 | 3.30 | 0.00 | 8.63 | 0.10 | 19.67 | 0.16 | 8.89 | 800 |
| M807 | 1.5 | 14.50 | 1.03 | 16.50 | 3.30 | 0.00 | 8.65 | 0.10 | 19.09 | 0.16 | 8.91 | 800 |
| M808 | 1.5 | 14.50 | 1.03 | 16.00 | 3.30 | 0.00 | 8.66 | 0.10 | 18.51 | 0.16 | 8.92 | 800 |
| M809 | 1.5 | 14.50 | 1.03 | 15.50 | 3.30 | 0.00 | 8.67 | 0.09 | 17.93 | 0.16 | 8.92 | 800 |
| M810 | 1.5 | 14.50 | 1.03 | 15.00 | 3.30 | 0.00 | 8.69 | 0.09 | 17.36 | 0.16 | 8.94 | 800 |
| M811 | 1.5 | 14.50 | 1.03 | 14.50 | 3.30 | 0.00 | 8.70 | 0.09 | 16.78 | 0.15 | 8.94 | 850 |
| M812 | 1.5 | 14.50 | 1.03 | 14.00 | 3.30 | 0.00 | 8.71 | 0.09 | 16.20 | 0.15 | 8.95 | 850 |
| M813 | 1.5 | 14.50 | 1.03 | 13.50 | 3.30 | 0.00 | 8.96 | 0.08 | 15.65 | 0.15 | 9.19 | 850 |
| M814 | 1.5 | 14.50 | 1.03 | 13.00 | 3.30 | 0.00 | 8.98 | 0.08 | 15.07 | 0.14 | 9.20 | 850 |
| M815 | 1.5 | 14.50 | 1.03 | 12.50 | 3.30 | 0.00 | 8.99 | 0.08 | 14.49 | 0.14 | 9.21 | 850 |
| M816 | 1.5 | 14.50 | 1.03 | 12.00 | 3.30 | 0.00 | 9.01 | 0.08 | 13.91 | 0.14 | 9.23 | 850 |
| M817 | 1.5 | 14.50 | 1.03 | 11.50 | 3.30 | 0.00 | 9.02 | 0.07 | 13.33 | 0.14 | 9.23 | 850 |
| M818 | 1.5 | 14.50 | 1.03 | 11.00 | 3.30 | 0.00 | 9.03 | 0.07 | 12.75 | 0.14 | 9.24 | 850 |
| M819 | 1.5 | 14.50 | 1.03 | 10.50 | 3.30 | 0.00 | 9.04 | 0.07 | 12.17 | 0.14 | 9.25 | 850 |
| M820 | 1.5 | 14.50 | 1.03 | 10.00 | 3.30 | 0.00 | 9.05 | 0.07 | 11.59 | 0.14 | 9.26 | 900 |
| M821 | 1.5 | 14.50 | 1.03 | 9.50 | 3.30 | 0.00 | 9.06 | 0.07 | 11.01 | 0.13 | 9.26 | 900 |
| M822 | 1.5 | 14.50 | 1.03 | 8.50 | 3.30 | 0.00 | 9.07 | 0.07 | 9.86 | 0.13 | 9.27 | 900 |
| M823 | 1.5 | 14.50 | 1.03 | 9.00 | 3.30 | 0.00 | 9.07 | 0.07 | 10.43 | 0.13 | 9.27 | 900 |
| M824 | 1.5 | 14.50 | 1.03 | 8.00 | 3.30 | 0.00 | 9.08 | 0.07 | 9.28 | 0.13 | 9.28 | 900 |
| M825 | 1.5 | 14.50 | 1.03 | 7.50 | 3.30 | 0.00 | 9.09 | 0.07 | 8.70 | 0.13 | 9.29 | 900 |

TABLE 7-continued

Alloy Compositions (in wt. %, Fe Balance) of alloys intended to form soft coatings.

| | Feedstock Chemistry | | | | | Coating Chemistry | | | | | | |
|---|---|---|---|---|---|---|---|---|---|---|---|---|
| No | Al | Cr | Mn | Ni | Si | Al | Cr | Mn | Ni | Si | WSS | TransT |
| M826 | 1.5 | 14.50 | 1.03 | 7.00 | 3.30 | 0.00 | 9.10 | 0.07 | 8.12 | 0.13 | 9.30 | 900 |
| M827 | 1.5 | 15.00 | 1.03 | 22.50 | 3.30 | 0.00 | 8.99 | 0.13 | 26.02 | 0.20 | 9.32 | 750 |
| M828 | 1.5 | 15.00 | 1.03 | 22.00 | 3.30 | 0.00 | 9.00 | 0.13 | 25.45 | 0.20 | 9.33 | 750 |
| M829 | 1.5 | 15.00 | 1.03 | 21.50 | 3.30 | 0.00 | 9.01 | 0.13 | 24.87 | 0.19 | 9.33 | 750 |
| M830 | 1.5 | 15.00 | 1.03 | 21.00 | 3.30 | 0.00 | 9.02 | 0.12 | 24.29 | 0.19 | 9.33 | 750 |
| M831 | 1.5 | 15.00 | 1.03 | 20.50 | 3.30 | 0.00 | 9.04 | 0.12 | 23.71 | 0.19 | 9.35 | 750 |
| M832 | 1.5 | 15.00 | 1.03 | 20.00 | 3.30 | 0.00 | 9.05 | 0.12 | 23.13 | 0.19 | 9.36 | 750 |
| M833 | 1.5 | 15.00 | 1.03 | 19.50 | 3.30 | 0.00 | 9.06 | 0.12 | 22.56 | 0.19 | 9.37 | 800 |
| M834 | 1.5 | 15.00 | 1.03 | 19.00 | 3.30 | 0.00 | 9.08 | 0.11 | 21.98 | 0.18 | 9.37 | 800 |
| M835 | 1.5 | 15.00 | 1.03 | 18.50 | 3.30 | 0.00 | 9.09 | 0.11 | 21.40 | 0.18 | 9.38 | 800 |
| M836 | 1.5 | 15.00 | 1.03 | 18.00 | 3.30 | 0.00 | 9.10 | 0.11 | 20.82 | 0.18 | 9.39 | 800 |
| M837 | 1.5 | 15.00 | 1.03 | 17.50 | 3.30 | 0.00 | 9.11 | 0.11 | 20.24 | 0.18 | 9.40 | 800 |
| M838 | 1.5 | 15.00 | 1.03 | 16.50 | 3.30 | 0.00 | 9.14 | 0.10 | 19.09 | 0.17 | 9.41 | 800 |
| M839 | 1.5 | 15.00 | 1.03 | 17.00 | 3.30 | 0.00 | 9.13 | 0.11 | 19.67 | 0.18 | 9.42 | 800 |
| M840 | 1.5 | 15.00 | 1.03 | 16.00 | 3.30 | 0.00 | 9.15 | 0.10 | 18.51 | 0.17 | 9.42 | 800 |
| M841 | 1.5 | 15.00 | 1.03 | 15.50 | 3.30 | 0.00 | 9.17 | 0.10 | 17.93 | 0.17 | 9.44 | 800 |
| M842 | 1.5 | 15.00 | 1.03 | 15.00 | 3.30 | 0.00 | 9.18 | 0.10 | 17.35 | 0.17 | 9.45 | 800 |
| M843 | 1.5 | 15.00 | 1.03 | 14.50 | 3.30 | 0.00 | 9.19 | 0.10 | 16.78 | 0.17 | 9.46 | 850 |
| M844 | 1.5 | 15.00 | 1.03 | 14.00 | 3.30 | 0.00 | 9.20 | 0.09 | 16.20 | 0.17 | 9.46 | 850 |
| M845 | 1.5 | 15.00 | 1.03 | 13.50 | 3.30 | 0.00 | 9.22 | 0.09 | 15.62 | 0.16 | 9.47 | 850 |
| M846 | 1.5 | 15.00 | 1.03 | 13.00 | 3.30 | 0.00 | 9.45 | 0.08 | 15.07 | 0.16 | 9.69 | 850 |
| M847 | 1.5 | 15.00 | 1.03 | 12.50 | 3.30 | 0.00 | 9.47 | 0.08 | 14.49 | 0.15 | 9.70 | 850 |
| M848 | 1.5 | 15.00 | 1.03 | 12.00 | 3.30 | 0.00 | 9.49 | 0.08 | 13.91 | 0.15 | 9.72 | 850 |
| M849 | 1.5 | 15.00 | 1.03 | 11.50 | 3.30 | 0.00 | 9.50 | 0.08 | 13.33 | 0.15 | 9.73 | 850 |
| M850 | 1.5 | 15.00 | 1.03 | 11.00 | 3.30 | 0.00 | 9.52 | 0.08 | 12.75 | 0.15 | 9.75 | 850 |
| M851 | 1.5 | 15.00 | 1.03 | 10.50 | 3.30 | 0.00 | 9.53 | 0.08 | 12.17 | 0.15 | 9.76 | 850 |
| M852 | 1.5 | 15.00 | 1.03 | 10.00 | 3.30 | 0.00 | 9.55 | 0.07 | 11.59 | 0.15 | 9.77 | 900 |
| M853 | 1.5 | 15.00 | 1.03 | 9.50 | 3.30 | 0.00 | 9.57 | 0.07 | 11.01 | 0.14 | 9.78 | 900 |
| M854 | 1.5 | 15.00 | 1.03 | 9.00 | 3.30 | 0.00 | 9.58 | 0.07 | 10.43 | 0.14 | 9.79 | 900 |
| M855 | 1.5 | 15.00 | 1.03 | 8.50 | 3.30 | 0.00 | 9.59 | 0.07 | 9.86 | 0.14 | 9.80 | 900 |
| M856 | 1.5 | 15.00 | 1.03 | 8.00 | 3.30 | 0.00 | 9.60 | 0.07 | 9.28 | 0.14 | 9.81 | 900 |
| M857 | 1.5 | 15.00 | 1.03 | 7.50 | 3.30 | 0.00 | 9.61 | 0.07 | 8.70 | 0.14 | 9.82 | 900 |
| M858 | 1.5 | 15.00 | 1.03 | 7.00 | 3.30 | 0.00 | 9.62 | 0.07 | 8.12 | 0.14 | 9.83 | 900 |
| M859 | 1.5 | 15.50 | 1.03 | 22.50 | 3.30 | 0.00 | 9.48 | 0.14 | 26.03 | 0.21 | 9.83 | 750 |
| M860 | 1.5 | 15.50 | 1.03 | 21.50 | 3.30 | 0.00 | 9.51 | 0.13 | 24.87 | 0.21 | 9.85 | 750 |
| M861 | 1.5 | 15.50 | 1.03 | 22.00 | 3.30 | 0.00 | 9.50 | 0.14 | 25.44 | 0.21 | 9.85 | 750 |
| M862 | 1.5 | 15.50 | 1.03 | 21.00 | 3.30 | 0.00 | 9.52 | 0.13 | 24.29 | 0.21 | 9.86 | 750 |
| M863 | 1.5 | 15.50 | 1.03 | 20.50 | 3.30 | 0.00 | 9.54 | 0.13 | 23.71 | 0.21 | 9.88 | 750 |
| M864 | 1.5 | 15.50 | 1.03 | 19.50 | 3.30 | 0.00 | 9.56 | 0.12 | 22.56 | 0.20 | 9.88 | 800 |
| M865 | 1.5 | 15.50 | 1.03 | 20.00 | 3.30 | 0.00 | 9.55 | 0.13 | 23.13 | 0.20 | 9.88 | 750 |
| M866 | 1.5 | 15.50 | 1.03 | 19.00 | 3.30 | 0.00 | 9.57 | 0.12 | 21.98 | 0.20 | 9.89 | 800 |
| M867 | 1.5 | 15.50 | 1.03 | 18.50 | 3.30 | 0.00 | 9.59 | 0.12 | 21.40 | 0.20 | 9.91 | 800 |
| M868 | 1.5 | 15.50 | 1.03 | 18.00 | 3.30 | 0.00 | 9.60 | 0.12 | 20.82 | 0.19 | 9.91 | 800 |
| M869 | 1.5 | 15.50 | 1.03 | 17.50 | 3.30 | 0.00 | 9.61 | 0.11 | 20.24 | 0.19 | 9.91 | 800 |
| M870 | 1.5 | 15.50 | 1.03 | 17.00 | 3.30 | 0.00 | 9.63 | 0.11 | 19.67 | 0.19 | 9.93 | 800 |
| M871 | 1.5 | 15.50 | 1.03 | 16.50 | 3.30 | 0.00 | 9.64 | 0.11 | 19.09 | 0.19 | 9.94 | 800 |
| M872 | 1.5 | 15.50 | 1.03 | 16.00 | 3.30 | 0.00 | 9.65 | 0.11 | 18.51 | 0.19 | 9.95 | 800 |
| M873 | 1.5 | 15.50 | 1.03 | 15.50 | 3.30 | 0.00 | 9.66 | 0.11 | 17.93 | 0.18 | 9.95 | 800 |
| M874 | 1.5 | 15.50 | 1.03 | 15.00 | 3.30 | 0.00 | 9.68 | 0.10 | 17.35 | 0.18 | 9.96 | 800 |
| M875 | 1.5 | 15.50 | 1.03 | 14.50 | 3.30 | 0.00 | 9.69 | 0.10 | 16.78 | 0.18 | 9.97 | 850 |
| M876 | 1.5 | 15.50 | 1.03 | 14.00 | 3.30 | 0.00 | 9.70 | 0.10 | 16.20 | 0.18 | 9.98 | 850 |

Table 8 shows alloys which meet the thermodynamic criteria of alloys intended to form a hard coating. Table 8 shows the feedstock chemistry of the alloy in addition to coating chemistry of the alloy and the corresponding weighted solid mole fraction (denoted as WSS).

TABLE 8

Alloy Compositions (in wt. %, Fe Balance) of alloys intended to form hard coatings.

| | Feedstock Chemistry | | | | | Coating Chemistry | | | | | |
|---|---|---|---|---|---|---|---|---|---|---|---|
| Alloy # | Al | B | C | Mn | Si | Al | B | C | Mn | Si | WSS |
| M877 | 0.92 | 1.84 | 6.99 | 0.92 | 3.04 | 0.0% | 2.6% | 6.3% | 0.0% | 0.0% | 88.8% |
| M878 | 0.92 | 2.12 | 6.81 | 0.92 | 3.04 | 0.0% | 3.0% | 5.9% | 0.0% | 0.0% | 88.8% |
| M879 | 0.92 | 2.39 | 6.81 | 0.92 | 3.04 | 0.0% | 3.4% | 5.5% | 0.0% | 0.0% | 88.7% |
| M880 | 0.92 | 2.39 | 6.26 | 0.92 | 3.04 | 0.0% | 3.3% | 5.5% | 0.0% | 0.0% | 88.7% |
| M881 | 0.92 | 2.67 | 6.81 | 0.92 | 3.04 | 0.0% | 3.8% | 5.1% | 0.0% | 0.0% | 88.7% |

TABLE 8-continued

Alloy Compositions (in wt. %, Fe Balance) of alloys intended to form hard coatings.

| | Feedstock Chemistry | | | | | Coating Chemistry | | | | | |
|---|---|---|---|---|---|---|---|---|---|---|---|
| Alloy # | Al | B | C | Mn | Si | Al | B | C | Mn | Si | WSS |
| M882 | 0.92 | 2.39 | 6.99 | 0.92 | 3.04 | 0.0% | 3.4% | 5.5% | 0.0% | 0.0% | 88.7% |
| M883 | 0.92 | 3.50 | 5.34 | 0.92 | 3.04 | 0.0% | 8.8% | 0.0% | 0.0% | 0.0% | 88.1% |
| M884 | 0.92 | 3.22 | 5.89 | 0.92 | 3.04 | 0.0% | 4.5% | 4.3% | 0.0% | 0.0% | 88.6% |
| M885 | 0.92 | 2.94 | 6.62 | 0.92 | 3.04 | 0.0% | 4.2% | 4.7% | 0.0% | 0.0% | 88.6% |
| M886 | 0.92 | 3.77 | 5.34 | 0.92 | 3.04 | 0.0% | 5.3% | 3.6% | 0.0% | 0.0% | 88.5% |
| M887 | 0.92 | 3.22 | 6.07 | 0.92 | 3.04 | 0.0% | 4.5% | 4.3% | 0.0% | 0.0% | 88.6% |
| M888 | 0.92 | 3.22 | 6.62 | 0.92 | 3.04 | 0.0% | 4.6% | 4.3% | 0.0% | 0.0% | 88.6% |
| M889 | 0.92 | 3.22 | 6.26 | 0.92 | 3.04 | 0.0% | 4.5% | 4.3% | 0.0% | 0.0% | 88.6% |
| M890 | 0.92 | 4.32 | 5.15 | 0.92 | 3.04 | 0.0% | 6.1% | 2.8% | 0.0% | 0.0% | 88.4% |
| M891 | 0.92 | 3.50 | 6.81 | 0.92 | 3.04 | 0.0% | 5.0% | 3.9% | 0.0% | 0.0% | 88.5% |
| M892 | 0.92 | 3.50 | 6.62 | 0.92 | 3.04 | 0.0% | 5.0% | 3.9% | 0.0% | 0.0% | 88.5% |
| M893 | 0.92 | 3.77 | 6.81 | 0.92 | 3.04 | 0.0% | 5.4% | 3.5% | 0.0% | 0.0% | 88.5% |
| M894 | 0.92 | 3.50 | 6.26 | 0.92 | 3.04 | 0.0% | 4.9% | 3.9% | 0.0% | 0.0% | 88.5% |
| M895 | 0.92 | 3.77 | 6.07 | 0.92 | 3.04 | 0.0% | 5.3% | 3.5% | 0.0% | 0.0% | 88.5% |
| M896 | 0.92 | 3.50 | 6.99 | 0.92 | 3.04 | 0.0% | 5.0% | 3.9% | 0.0% | 0.0% | 88.5% |
| M897 | 0.92 | 2.39 | 7.18 | 0.92 | 3.04 | 0.0% | 3.4% | 5.5% | 0.0% | 0.0% | 88.7% |
| M898 | 0.92 | 4.60 | 5.34 | 0.92 | 3.04 | 0.0% | 6.5% | 2.3% | 0.0% | 0.0% | 88.4% |
| M899 | 0.92 | 3.77 | 6.44 | 0.92 | 3.04 | 0.0% | 5.4% | 3.5% | 0.0% | 0.0% | 88.5% |
| M900 | 0.92 | 3.77 | 6.99 | 0.92 | 3.04 | 0.0% | 5.4% | 3.4% | 0.0% | 0.0% | 88.5% |
| M901 | 0.92 | 5.15 | 5.15 | 0.92 | 3.04 | 0.0% | 7.3% | 1.5% | 0.0% | 0.0% | 88.3% |
| M902 | 0.92 | 4.60 | 5.89 | 0.92 | 3.04 | 0.0% | 6.5% | 2.3% | 0.0% | 0.0% | 88.4% |
| M903 | 0.92 | 4.32 | 6.07 | 0.92 | 3.04 | 0.0% | 6.2% | 2.7% | 0.0% | 0.0% | 88.4% |
| M904 | 0.92 | 4.32 | 6.62 | 0.92 | 3.04 | 0.0% | 6.2% | 2.6% | 0.0% | 0.0% | 88.4% |
| M905 | 0.92 | 4.32 | 5.52 | 0.92 | 3.04 | 0.0% | 6.1% | 2.7% | 0.0% | 0.0% | 88.4% |
| M906 | 0.92 | 5.43 | 5.15 | 0.92 | 3.04 | 0.0% | 7.7% | 1.1% | 0.0% | 0.0% | 88.2% |
| M907 | 0.92 | 4.60 | 6.07 | 0.92 | 3.04 | 0.0% | 6.6% | 2.3% | 0.0% | 0.0% | 88.4% |
| M908 | 0.92 | 4.32 | 5.70 | 0.92 | 3.04 | 0.0% | 6.1% | 2.7% | 0.0% | 0.0% | 88.4% |
| M909 | 0.92 | 4.88 | 6.81 | 0.92 | 3.04 | 0.0% | 7.1% | 1.8% | 0.0% | 0.0% | 88.3% |
| M910 | 0.92 | 5.15 | 5.89 | 0.92 | 3.04 | 0.0% | 7.4% | 1.5% | 0.0% | 0.0% | 88.3% |
| M911 | 0.92 | 4.60 | 6.44 | 0.92 | 3.04 | 0.0% | 6.6% | 2.2% | 0.0% | 0.0% | 88.4% |
| M912 | 0.92 | 4.60 | 5.70 | 0.92 | 3.04 | 0.0% | 6.5% | 2.3% | 0.0% | 0.0% | 88.4% |
| M913 | 0.92 | 5.98 | 5.15 | 0.92 | 3.04 | 0.0% | 8.5% | 0.3% | 0.0% | 0.0% | 88.1% |
| M914 | 0.92 | 5.15 | 6.26 | 0.92 | 3.04 | 0.0% | 7.4% | 1.4% | 0.0% | 0.0% | 88.3% |
| M915 | 0.92 | 3.77 | 7.18 | 0.92 | 3.04 | 0.0% | 5.4% | 3.4% | 0.0% | 0.0% | 88.5% |
| M916 | 0.92 | 5.15 | 5.52 | 0.92 | 3.04 | 0.0% | 7.3% | 1.5% | 0.0% | 0.0% | 88.3% |
| M917 | 0.92 | 4.88 | 6.99 | 0.92 | 3.04 | 0.0% | 7.1% | 1.8% | 0.0% | 0.0% | 88.3% |
| M918 | 0.92 | 5.43 | 6.07 | 0.92 | 3.04 | 0.0% | 7.8% | 1.0% | 0.0% | 0.0% | 88.2% |
| M919 | 0.92 | 5.70 | 5.89 | 0.92 | 3.04 | 0.0% | 8.2% | 0.6% | 0.0% | 0.0% | 88.2% |
| M920 | 0.92 | 5.98 | 5.34 | 0.92 | 3.04 | 0.0% | 8.6% | 0.3% | 0.0% | 0.0% | 88.1% |
| M921 | 0.92 | 5.70 | 6.07 | 0.92 | 3.04 | 0.0% | 8.2% | 0.6% | 0.0% | 0.0% | 88.2% |
| M922 | 0.92 | 5.43 | 6.62 | 0.92 | 3.04 | 0.0% | 7.9% | 0.9% | 0.0% | 0.0% | 88.2% |
| M923 | 0.92 | 5.98 | 5.89 | 0.92 | 3.04 | 0.0% | 8.6% | 0.2% | 0.0% | 0.0% | 88.1% |
| M924 | 0.92 | 6.81 | 5.15 | 0.92 | 3.04 | 0.0% | 9.9% | 0.0% | 0.0% | 0.0% | 99.1% |
| M925 | 0.92 | 5.70 | 6.44 | 0.92 | 3.04 | 0.0% | 8.3% | 0.5% | 0.0% | 0.0% | 88.2% |
| M926 | 0.92 | 5.70 | 6.62 | 0.92 | 3.04 | 0.0% | 8.3% | 0.5% | 0.0% | 0.0% | 88.2% |
| M927 | 0.92 | 7.08 | 5.15 | 0.92 | 3.04 | 0.0% | 10.4% | 0.0% | 0.0% | 0.0% | 103.7% |
| M928 | 0.92 | 4.60 | 7.18 | 0.92 | 3.04 | 0.0% | 6.7% | 2.2% | 0.0% | 0.0% | 88.3% |
| M929 | 0.92 | 6.26 | 6.81 | 0.92 | 3.04 | 0.0% | 9.2% | 0.0% | 0.0% | 0.0% | 92.4% |
| M930 | 0.92 | 6.53 | 5.89 | 0.92 | 3.04 | 0.0% | 9.6% | 0.0% | 0.0% | 0.0% | 95.7% |
| M931 | 0.92 | 7.36 | 5.15 | 0.92 | 3.04 | 0.0% | 10.8% | 0.0% | 0.0% | 0.0% | 108.1% |
| M932 | 0.92 | 4.88 | 7.18 | 0.92 | 3.04 | 0.0% | 7.1% | 1.7% | 0.0% | 0.0% | 88.3% |
| M933 | 0.92 | 5.98 | 5.70 | 0.92 | 3.04 | 0.0% | 8.6% | 0.2% | 0.0% | 0.0% | 88.1% |
| M934 | 0.92 | 6.26 | 6.99 | 0.92 | 3.04 | 0.0% | 9.3% | 0.0% | 0.0% | 0.0% | 92.7% |
| M935 | 0.92 | 7.08 | 5.34 | 0.92 | 3.04 | 0.0% | 10.4% | 0.0% | 0.0% | 0.0% | 104.0% |
| M936 | 0.92 | 6.81 | 6.81 | 0.92 | 3.04 | 0.0% | 10.2% | 0.0% | 0.0% | 0.0% | 101.9% |
| M937 | 0.92 | 6.26 | 5.70 | 0.92 | 3.04 | 0.0% | 9.1% | 0.0% | 0.0% | 0.0% | 90.6% |
| M938 | 0.92 | 6.53 | 6.44 | 0.92 | 3.04 | 0.0% | 9.7% | 0.0% | 0.0% | 0.0% | 96.6% |
| M939 | 0.92 | 7.08 | 6.81 | 0.92 | 3.04 | 0.0% | 10.6% | 0.0% | 0.0% | 0.0% | 106.4% |
| M940 | 0.92 | 6.81 | 6.26 | 0.92 | 3.04 | 0.0% | 10.1% | 0.0% | 0.0% | 0.0% | 100.9% |
| M941 | 1.38 | 3.22 | 5.15 | 0.92 | 3.04 | 0.0% | 8.8% | 0.0% | 0.0% | 0.0% | 88.1% |
| M942 | 0.92 | 6.81 | 6.44 | 0.92 | 3.04 | 0.0% | 10.1% | 0.0% | 0.0% | 0.0% | 101.2% |
| M943 | 0.92 | 7.36 | 6.07 | 0.92 | 3.04 | 0.0% | 11.0% | 0.0% | 0.0% | 0.0% | 109.6% |
| M944 | 0.92 | 7.08 | 6.99 | 0.92 | 3.04 | 0.0% | 10.7% | 0.0% | 0.0% | 0.0% | 106.7% |
| M945 | 0.92 | 7.36 | 6.62 | 0.92 | 3.04 | 0.0% | 11.1% | 0.0% | 0.0% | 0.0% | 110.6% |
| M946 | 0.92 | 7.36 | 6.99 | 0.92 | 3.04 | 0.0% | 11.1% | 0.0% | 0.0% | 0.0% | 111.2% |
| M947 | 0.92 | 7.36 | 5.70 | 0.92 | 3.04 | 0.0% | 10.9% | 0.0% | 0.0% | 0.0% | 109.0% |
| M948 | 0.92 | 6.26 | 7.18 | 0.92 | 3.04 | 0.0% | 9.3% | 0.0% | 0.0% | 0.0% | 93.0% |
| M949 | 0.92 | 7.36 | 5.52 | 0.92 | 3.04 | 0.0% | 10.9% | 0.0% | 0.0% | 0.0% | 108.7% |
| M950 | 0.00 | 1.84 | 7.36 | 0.92 | 3.04 | 0.0% | 2.6% | 6.2% | 0.0% | 0.0% | 88.8% |
| M951 | 0.00 | 4.60 | 7.36 | 0.92 | 3.04 | 0.0% | 6.8% | 2.0% | 0.0% | 0.0% | 88.3% |
| M952 | 0.00 | 5.15 | 7.36 | 0.92 | 3.04 | 0.0% | 7.7% | 1.2% | 0.0% | 0.0% | 88.2% |
| M953 | 0.00 | 5.98 | 7.36 | 0.92 | 3.04 | 0.0% | 9.0% | 0.0% | 0.0% | 0.0% | 89.9% |
| M954 | 0.00 | 6.53 | 7.36 | 0.92 | 3.04 | 0.0% | 10.0% | 0.0% | 0.0% | 0.0% | 99.7% |
| M955 | 0.00 | 7.36 | 7.36 | 0.92 | 3.04 | 0.0% | 11.4% | 0.0% | 0.0% | 0.0% | 113.5% |

TABLE 8-continued

Alloy Compositions (in wt. %, Fe Balance) of alloys intended to form hard coatings.

| | Feedstock Chemistry | | | | | Coating Chemistry | | | | | |
|---|---|---|---|---|---|---|---|---|---|---|---|
| Alloy # | Al | B | C | Mn | Si | Al | B | C | Mn | Si | WSS |
| M956 | 0.92 | 2.39 | 7.36 | 0.92 | 3.04 | 0.0% | 3.4% | 5.5% | 0.0% | 0.0% | 88.7% |
| M957 | 0.92 | 3.22 | 7.36 | 0.92 | 3.04 | 0.0% | 4.6% | 4.2% | 0.0% | 0.0% | 88.6% |
| M958 | 0.92 | 4.05 | 7.36 | 0.92 | 3.04 | 0.0% | 5.9% | 3.0% | 0.0% | 0.0% | 88.4% |
| M959 | 0.92 | 4.88 | 7.36 | 0.92 | 3.04 | 0.0% | 7.1% | 1.7% | 0.0% | 0.0% | 88.3% |
| M960 | 0.92 | 5.70 | 7.36 | 0.92 | 3.04 | 0.0% | 8.4% | 0.4% | 0.0% | 0.0% | 88.1% |
| M961 | 0.92 | 6.53 | 7.36 | 0.92 | 3.04 | 0.0% | 9.8% | 0.0% | 0.0% | 0.0% | 98.1% |
| M962 | 0.92 | 7.36 | 7.36 | 0.92 | 3.04 | 0.0% | 11.2% | 0.0% | 0.0% | 0.0% | 111.8% |
| M963 | 0.00 | 4.60 | 4.05 | 0.92 | 3.04 | 0.0% | 8.8% | 0.0% | 0.0% | 0.0% | 88.1% |
| M964 | 0.00 | 3.50 | 4.42 | 0.92 | 3.04 | 0.0% | 8.8% | 0.0% | 0.0% | 0.0% | 88.1% |
| M965 | 0.00 | 3.77 | 4.42 | 0.92 | 3.04 | 0.0% | 8.8% | 0.0% | 0.0% | 0.0% | 88.1% |
| M966 | 0.00 | 4.05 | 4.42 | 0.92 | 3.04 | 0.0% | 8.8% | 0.0% | 0.0% | 0.0% | 88.1% |
| M967 | 0.00 | 4.32 | 4.42 | 0.92 | 3.04 | 0.0% | 8.8% | 0.0% | 0.0% | 0.0% | 88.1% |
| M968 | 0.00 | 4.32 | 4.23 | 0.92 | 3.04 | 0.0% | 8.8% | 0.0% | 0.0% | 0.0% | 88.1% |
| M969 | 0.00 | 4.60 | 4.23 | 0.92 | 3.04 | 0.0% | 8.8% | 0.0% | 0.0% | 0.0% | 88.1% |
| M970 | 0.00 | 7.08 | 4.05 | 0.92 | 3.04 | 0.0% | 10.3% | 0.0% | 0.0% | 0.0% | 103.4% |
| M971 | 0.00 | 7.36 | 4.05 | 0.92 | 3.04 | 0.0% | 10.8% | 0.0% | 0.0% | 0.0% | 107.9% |
| M972 | 0.00 | 5.98 | 4.42 | 0.92 | 3.04 | 0.0% | 8.6% | 0.2% | 0.0% | 0.0% | 88.1% |
| M973 | 0.00 | 5.70 | 4.23 | 0.92 | 3.04 | 0.0% | 8.8% | 0.0% | 0.0% | 0.0% | 88.1% |
| M974 | 0.00 | 5.98 | 4.23 | 0.92 | 3.04 | 0.0% | 8.8% | 0.0% | 0.0% | 0.0% | 88.1% |
| M975 | 0.00 | 3.77 | 4.60 | 0.92 | 3.04 | 0.0% | 8.8% | 0.0% | 0.0% | 0.0% | 88.1% |
| M976 | 0.00 | 4.05 | 4.60 | 0.92 | 3.04 | 0.0% | 8.8% | 0.0% | 0.0% | 0.0% | 88.1% |
| M977 | 0.00 | 7.36 | 4.42 | 0.92 | 3.04 | 0.0% | 10.8% | 0.0% | 0.0% | 0.0% | 108.5% |
| M978 | 0.00 | 3.50 | 4.78 | 0.92 | 3.04 | 0.0% | 8.8% | 0.0% | 0.0% | 0.0% | 88.1% |
| M979 | 0.00 | 3.77 | 4.78 | 0.92 | 3.04 | 0.0% | 8.8% | 0.0% | 0.0% | 0.0% | 88.1% |
| M980 | 0.00 | 3.22 | 4.97 | 0.92 | 3.04 | 0.0% | 8.8% | 0.0% | 0.0% | 0.0% | 88.1% |
| M981 | 0.00 | 4.32 | 4.78 | 0.92 | 3.04 | 0.0% | 8.8% | 0.0% | 0.0% | 0.0% | 88.1% |
| M982 | 0.00 | 3.77 | 4.97 | 0.92 | 3.04 | 0.0% | 8.8% | 0.0% | 0.0% | 0.0% | 88.1% |
| M983 | 0.46 | 3.77 | 4.05 | 0.92 | 3.04 | 0.0% | 8.8% | 0.0% | 0.0% | 0.0% | 88.1% |
| M984 | 0.00 | 5.15 | 4.78 | 0.92 | 3.04 | 0.0% | 8.8% | 0.0% | 0.0% | 0.0% | 88.1% |
| M985 | 0.00 | 5.43 | 4.78 | 0.92 | 3.04 | 0.0% | 7.8% | 1.0% | 0.0% | 0.0% | 88.2% |
| M986 | 0.00 | 6.53 | 4.60 | 0.92 | 3.04 | 0.0% | 9.5% | 0.0% | 0.0% | 0.0% | 95.2% |
| M987 | 0.00 | 5.70 | 4.78 | 0.92 | 3.04 | 0.0% | 8.2% | 0.6% | 0.0% | 0.0% | 88.2% |
| M988 | 0.46 | 3.50 | 4.42 | 0.92 | 3.04 | 0.0% | 8.8% | 0.0% | 0.0% | 0.0% | 88.1% |
| M989 | 0.00 | 5.15 | 4.97 | 0.92 | 3.04 | 0.0% | 7.4% | 1.4% | 0.0% | 0.0% | 88.3% |
| M990 | 0.46 | 3.77 | 4.42 | 0.92 | 3.04 | 0.0% | 8.8% | 0.0% | 0.0% | 0.0% | 88.1% |
| M991 | 0.00 | 6.26 | 4.78 | 0.92 | 3.04 | 0.0% | 9.1% | 0.0% | 0.0% | 0.0% | 90.7% |
| M992 | 0.46 | 5.15 | 4.05 | 0.92 | 3.04 | 0.0% | 8.8% | 0.0% | 0.0% | 0.0% | 88.1% |
| M993 | 0.46 | 4.32 | 4.42 | 0.92 | 3.04 | 0.0% | 8.8% | 0.0% | 0.0% | 0.0% | 88.1% |
| M994 | 0.00 | 6.81 | 4.78 | 0.92 | 3.04 | 0.0% | 10.0% | 0.0% | 0.0% | 0.0% | 100.1% |
| M995 | 0.46 | 5.70 | 4.05 | 0.92 | 3.04 | 0.0% | 8.8% | 0.0% | 0.0% | 0.0% | 88.1% |
| M996 | 0.00 | 7.08 | 4.78 | 0.92 | 3.04 | 0.0% | 10.5% | 0.0% | 0.0% | 0.0% | 104.7% |
| M997 | 0.00 | 6.53 | 4.97 | 0.92 | 3.04 | 0.0% | 9.6% | 0.0% | 0.0% | 0.0% | 95.8% |
| M998 | 0.00 | 6.81 | 4.97 | 0.92 | 3.04 | 0.0% | 10.0% | 0.0% | 0.0% | 0.0% | 100.4% |
| M999 | 0.46 | 6.26 | 4.05 | 0.92 | 3.04 | 0.0% | 8.9% | 0.0% | 0.0% | 0.0% | 88.7% |
| M1000 | 0.46 | 6.53 | 4.05 | 0.92 | 3.04 | 0.0% | 9.3% | 0.0% | 0.0% | 0.0% | 93.5% |
| M1001 | 0.46 | 5.43 | 4.23 | 0.92 | 3.04 | 0.0% | 8.8% | 0.0% | 0.0% | 0.0% | 88.1% |
| M1002 | 0.46 | 6.81 | 4.05 | 0.92 | 3.04 | 0.0% | 9.8% | 0.0% | 0.0% | 0.0% | 98.1% |
| M1003 | 0.46 | 3.50 | 4.60 | 0.92 | 3.04 | 0.0% | 8.8% | 0.0% | 0.0% | 0.0% | 88.1% |
| M1004 | 0.46 | 3.50 | 4.78 | 0.92 | 3.04 | 0.0% | 8.8% | 0.0% | 0.0% | 0.0% | 88.1% |
| M1005 | 0.46 | 3.77 | 4.78 | 0.92 | 3.04 | 0.0% | 8.8% | 0.0% | 0.0% | 0.0% | 88.1% |
| M1006 | 0.46 | 3.50 | 4.97 | 0.92 | 3.04 | 0.0% | 8.8% | 0.0% | 0.0% | 0.0% | 88.1% |
| M1007 | 0.46 | 3.77 | 4.97 | 0.92 | 3.04 | 0.0% | 8.8% | 0.0% | 0.0% | 0.0% | 88.1% |
| M1008 | 0.46 | 4.60 | 4.78 | 0.92 | 3.04 | 0.0% | 8.8% | 0.0% | 0.0% | 0.0% | 88.1% |
| M1009 | 0.92 | 3.77 | 4.05 | 0.92 | 3.04 | 0.0% | 8.8% | 0.0% | 0.0% | 0.0% | 88.1% |
| M1010 | 0.92 | 3.77 | 4.42 | 0.92 | 3.04 | 0.0% | 8.8% | 0.0% | 0.0% | 0.0% | 88.1% |
| M1011 | 0.92 | 4.32 | 4.42 | 0.92 | 3.04 | 0.0% | 8.8% | 0.0% | 0.0% | 0.0% | 88.1% |
| M1012 | 0.92 | 5.15 | 4.05 | 0.92 | 3.04 | 0.0% | 8.8% | 0.0% | 0.0% | 0.0% | 88.1% |
| M1013 | 0.92 | 5.43 | 4.05 | 0.92 | 3.04 | 0.0% | 7.6% | 1.2% | 0.0% | 0.0% | 88.2% |
| M1014 | 0.92 | 3.50 | 4.60 | 0.92 | 3.04 | 0.0% | 8.8% | 0.0% | 0.0% | 0.0% | 88.1% |
| M1015 | 0.92 | 2.94 | 4.78 | 0.92 | 3.04 | 0.0% | 8.8% | 0.0% | 0.0% | 0.0% | 88.1% |
| M1016 | 0.92 | 3.77 | 4.60 | 0.92 | 3.04 | 0.0% | 8.8% | 0.0% | 0.0% | 0.0% | 88.1% |
| M1017 | 0.92 | 5.43 | 4.23 | 0.92 | 3.04 | 0.0% | 7.6% | 1.2% | 0.0% | 0.0% | 88.2% |
| M1018 | 0.92 | 4.05 | 4.60 | 0.92 | 3.04 | 0.0% | 8.8% | 0.0% | 0.0% | 0.0% | 88.1% |
| M1019 | 0.92 | 6.53 | 4.05 | 0.92 | 3.04 | 0.0% | 9.3% | 0.0% | 0.0% | 0.0% | 92.8% |
| M1020 | 0.92 | 5.98 | 4.23 | 0.92 | 3.04 | 0.0% | 8.4% | 0.4% | 0.0% | 0.0% | 88.1% |
| M1021 | 0.92 | 3.77 | 4.78 | 0.92 | 3.04 | 0.0% | 8.8% | 0.0% | 0.0% | 0.0% | 88.1% |
| M1022 | 0.92 | 3.22 | 4.97 | 0.92 | 3.04 | 0.0% | 8.8% | 0.0% | 0.0% | 0.0% | 88.1% |
| M1023 | 0.92 | 7.08 | 4.05 | 0.92 | 3.04 | 0.0% | 10.2% | 0.0% | 0.0% | 0.0% | 101.9% |
| M1024 | 0.92 | 4.32 | 4.78 | 0.92 | 3.04 | 0.0% | 8.8% | 0.0% | 0.0% | 0.0% | 88.1% |
| M1025 | 0.92 | 7.08 | 4.42 | 0.92 | 3.04 | 0.0% | 10.2% | 0.0% | 0.0% | 0.0% | 102.5% |
| M1026 | 0.92 | 3.77 | 4.97 | 0.92 | 3.04 | 0.0% | 8.8% | 0.0% | 0.0% | 0.0% | 88.1% |
| M1027 | 0.92 | 7.08 | 4.23 | 0.92 | 3.04 | 0.0% | 10.2% | 0.0% | 0.0% | 0.0% | 102.2% |
| M1028 | 0.92 | 4.88 | 4.78 | 0.92 | 3.04 | 0.0% | 6.8% | 2.0% | 0.0% | 0.0% | 88.3% |
| M1029 | 0.92 | 5.70 | 4.60 | 0.92 | 3.04 | 0.0% | 8.0% | 0.8% | 0.0% | 0.0% | 88.2% |

TABLE 8-continued

Alloy Compositions (in wt. %, Fe Balance) of alloys intended to form hard coatings.

| | Feedstock Chemistry | | | | | Coating Chemistry | | | | | |
|---|---|---|---|---|---|---|---|---|---|---|---|
| Alloy # | Al | B | C | Mn | Si | Al | B | C | Mn | Si | WSS |
| M1030 | 1.38 | 2.94 | 4.42 | 0.92 | 3.04 | 0.0% | 8.8% | 0.0% | 0.0% | 0.0% | 88.1% |
| M1031 | 1.38 | 3.22 | 4.42 | 0.92 | 3.04 | 0.0% | 8.8% | 0.0% | 0.0% | 0.0% | 88.1% |
| M1032 | 0.92 | 4.60 | 4.97 | 0.92 | 3.04 | 0.0% | 6.5% | 2.4% | 0.0% | 0.0% | 88.4% |
| M1033 | 1.38 | 4.05 | 4.05 | 0.92 | 3.04 | 0.0% | 8.8% | 0.0% | 0.0% | 0.0% | 88.1% |
| M1034 | 1.38 | 3.77 | 4.42 | 0.92 | 3.04 | 0.0% | 8.8% | 0.0% | 0.0% | 0.0% | 88.1% |
| M1035 | 0.92 | 4.88 | 4.97 | 0.92 | 3.04 | 0.0% | 6.9% | 2.0% | 0.0% | 0.0% | 88.3% |
| M1036 | 1.38 | 4.60 | 4.05 | 0.92 | 3.04 | 0.0% | 8.8% | 0.0% | 0.0% | 0.0% | 88.1% |
| M1037 | 1.38 | 3.50 | 4.23 | 0.92 | 3.04 | 0.0% | 8.8% | 0.0% | 0.0% | 0.0% | 88.1% |
| M1038 | 1.38 | 4.32 | 4.42 | 0.92 | 3.04 | 0.0% | 8.8% | 0.0% | 0.0% | 0.0% | 88.1% |
| M1039 | 0.92 | 5.43 | 4.97 | 0.92 | 3.04 | 0.0% | 7.7% | 1.1% | 0.0% | 0.0% | 88.2% |
| M1040 | 0.92 | 7.08 | 4.60 | 0.92 | 3.04 | 0.0% | 10.3% | 0.0% | 0.0% | 0.0% | 102.8% |
| M1041 | 0.92 | 5.70 | 4.97 | 0.92 | 3.04 | 0.0% | 8.1% | 0.7% | 0.0% | 0.0% | 88.2% |
| M1042 | 0.92 | 7.08 | 4.78 | 0.92 | 3.04 | 0.0% | 10.3% | 0.0% | 0.0% | 0.0% | 103.1% |
| M1043 | 0.92 | 6.81 | 4.97 | 0.92 | 3.04 | 0.0% | 9.9% | 0.0% | 0.0% | 0.0% | 98.8% |
| M1044 | 1.84 | 2.94 | 4.05 | 0.92 | 3.04 | 0.0% | 8.8% | 0.0% | 0.0% | 0.0% | 88.1% |
| M1045 | 1.84 | 3.22 | 4.05 | 0.92 | 3.04 | 0.0% | 8.8% | 0.0% | 0.0% | 0.0% | 88.1% |
| M1046 | 1.38 | 3.50 | 4.78 | 0.92 | 3.04 | 0.0% | 8.8% | 0.0% | 0.0% | 0.0% | 88.1% |
| M1047 | 1.84 | 3.77 | 4.05 | 0.92 | 3.04 | 0.0% | 8.8% | 0.0% | 0.0% | 0.0% | 88.1% |
| M1048 | 1.84 | 3.22 | 4.42 | 0.92 | 3.04 | 0.0% | 8.8% | 0.0% | 0.0% | 0.0% | 88.1% |
| M1049 | 1.84 | 3.22 | 4.23 | 0.92 | 3.04 | 0.0% | 8.8% | 0.0% | 0.0% | 0.0% | 88.1% |
| M1050 | 1.38 | 3.22 | 4.97 | 0.92 | 3.04 | 0.0% | 8.8% | 0.0% | 0.0% | 0.0% | 88.1% |
| M1051 | 1.84 | 3.77 | 4.60 | 0.92 | 3.04 | 0.0% | 8.8% | 0.0% | 0.0% | 0.0% | 88.1% |
| M1052 | 2.30 | 3.50 | 4.05 | 0.92 | 3.04 | 0.0% | 8.8% | 0.0% | 0.0% | 0.0% | 88.1% |
| M1053 | 2.30 | 3.22 | 4.42 | 0.92 | 3.04 | 0.0% | 8.8% | 0.0% | 0.0% | 0.0% | 88.1% |
| M1054 | 2.30 | 3.50 | 4.23 | 0.92 | 3.04 | 0.0% | 8.8% | 0.0% | 0.0% | 0.0% | 88.1% |
| M1055 | 1.84 | 3.22 | 4.97 | 0.92 | 3.04 | 0.0% | 8.8% | 0.0% | 0.0% | 0.0% | 88.1% |
| M1056 | 2.76 | 3.22 | 4.05 | 0.92 | 3.04 | 0.0% | 8.8% | 0.0% | 0.0% | 0.0% | 88.1% |
| M1057 | 2.76 | 3.50 | 4.05 | 0.92 | 3.04 | 0.0% | 8.8% | 0.0% | 0.0% | 0.0% | 88.1% |
| M1058 | 0.00 | 5.15 | 3.50 | 0.92 | 3.04 | 0.0% | 8.8% | 0.0% | 0.0% | 0.0% | 88.1% |
| M1059 | 0.00 | 4.05 | 3.68 | 0.92 | 3.04 | 0.0% | 8.8% | 0.0% | 0.0% | 0.0% | 88.1% |
| M1060 | 0.00 | 4.32 | 3.68 | 0.92 | 3.04 | 0.0% | 8.8% | 0.0% | 0.0% | 0.0% | 88.1% |
| M1061 | 0.00 | 5.70 | 3.50 | 0.92 | 3.04 | 0.0% | 8.8% | 0.0% | 0.0% | 0.0% | 88.1% |
| M1062 | 0.00 | 5.15 | 3.31 | 0.92 | 3.04 | 0.0% | 8.8% | 0.0% | 0.0% | 0.0% | 88.1% |
| M1063 | 0.00 | 4.88 | 3.86 | 0.92 | 3.04 | 0.0% | 8.8% | 0.0% | 0.0% | 0.0% | 88.1% |
| M1064 | 0.00 | 4.88 | 3.68 | 0.92 | 3.04 | 0.0% | 8.8% | 0.0% | 0.0% | 0.0% | 88.1% |
| M1065 | 0.00 | 5.15 | 3.86 | 0.92 | 3.04 | 0.0% | 8.8% | 0.0% | 0.0% | 0.0% | 88.1% |
| M1066 | 0.00 | 5.43 | 3.86 | 0.92 | 3.04 | 0.0% | 8.8% | 0.0% | 0.0% | 0.0% | 88.1% |
| M1067 | 0.00 | 5.98 | 3.31 | 0.92 | 3.04 | 0.0% | 8.8% | 0.0% | 0.0% | 0.0% | 88.1% |
| M1068 | 0.00 | 5.70 | 3.13 | 0.92 | 3.04 | 0.0% | 8.8% | 0.0% | 0.0% | 0.0% | 88.1% |
| M1069 | 0.00 | 7.36 | 3.50 | 0.92 | 3.04 | 0.0% | 10.7% | 0.0% | 0.0% | 0.0% | 107.0% |
| M1070 | 0.00 | 6.26 | 3.68 | 0.92 | 3.04 | 0.0% | 8.8% | 0.0% | 0.0% | 0.0% | 88.1% |
| M1071 | 0.00 | 6.26 | 3.13 | 0.92 | 3.04 | 0.0% | 8.8% | 0.0% | 0.0% | 0.0% | 88.1% |
| M1072 | 0.00 | 6.53 | 3.68 | 0.92 | 3.04 | 0.0% | 8.8% | 0.0% | 0.0% | 0.0% | 88.1% |
| M1073 | 0.00 | 7.36 | 1.84 | 0.92 | 3.04 | 0.0% | 10.4% | 0.0% | 0.0% | 0.0% | 104.3% |
| M1074 | 0.00 | 7.08 | 3.31 | 0.92 | 3.04 | 0.0% | 8.8% | 0.0% | 0.0% | 0.0% | 88.1% |
| M1075 | 0.00 | 6.81 | 3.68 | 0.92 | 3.04 | 0.0% | 9.8% | 0.0% | 0.0% | 0.0% | 98.3% |
| M1076 | 0.00 | 6.81 | 3.13 | 0.92 | 3.04 | 0.0% | 8.8% | 0.0% | 0.0% | 0.0% | 88.1% |
| M1077 | 0.00 | 7.36 | 2.58 | 0.92 | 3.04 | 0.0% | 8.8% | 0.0% | 0.0% | 0.0% | 88.1% |
| M1078 | 0.00 | 7.36 | 2.21 | 0.92 | 3.04 | 0.0% | 10.5% | 0.0% | 0.0% | 0.0% | 104.9% |
| M1079 | 0.00 | 7.36 | 2.39 | 0.92 | 3.04 | 0.0% | 10.5% | 0.0% | 0.0% | 0.0% | 105.2% |
| M1080 | 0.46 | 4.32 | 3.50 | 0.92 | 3.04 | 0.0% | 8.8% | 0.0% | 0.0% | 0.0% | 88.1% |
| M1081 | 0.46 | 4.32 | 3.68 | 0.92 | 3.04 | 0.0% | 8.8% | 0.0% | 0.0% | 0.0% | 88.1% |
| M1082 | 0.46 | 5.43 | 3.50 | 0.92 | 3.04 | 0.0% | 8.8% | 0.0% | 0.0% | 0.0% | 88.1% |
| M1083 | 0.46 | 4.60 | 3.13 | 0.92 | 3.04 | 0.0% | 8.8% | 0.0% | 0.0% | 0.0% | 88.1% |
| M1084 | 0.46 | 5.15 | 3.86 | 0.92 | 3.04 | 0.0% | 8.8% | 0.0% | 0.0% | 0.0% | 88.1% |
| M1085 | 0.46 | 4.88 | 3.13 | 0.92 | 3.04 | 0.0% | 8.8% | 0.0% | 0.0% | 0.0% | 88.1% |
| M1086 | 0.46 | 5.70 | 3.31 | 0.92 | 3.04 | 0.0% | 8.8% | 0.0% | 0.0% | 0.0% | 88.1% |
| M1087 | 0.46 | 6.26 | 3.50 | 0.92 | 3.04 | 0.0% | 8.8% | 0.0% | 0.0% | 0.0% | 88.1% |
| M1088 | 0.46 | 6.26 | 3.68 | 0.92 | 3.04 | 0.0% | 8.8% | 0.0% | 0.0% | 0.0% | 88.1% |
| M1089 | 0.46 | 6.26 | 3.31 | 0.92 | 3.04 | 0.0% | 8.8% | 0.0% | 0.0% | 0.0% | 88.1% |
| M1090 | 0.46 | 6.53 | 3.31 | 0.92 | 3.04 | 0.0% | 8.8% | 0.0% | 0.0% | 0.0% | 88.1% |
| M1091 | 0.46 | 6.26 | 2.94 | 0.92 | 3.04 | 0.0% | 8.8% | 0.0% | 0.0% | 0.0% | 88.1% |
| M1092 | 0.46 | 6.53 | 2.94 | 0.92 | 3.04 | 0.0% | 8.8% | 0.0% | 0.0% | 0.0% | 88.1% |
| M1093 | 0.46 | 6.81 | 2.94 | 0.92 | 3.04 | 0.0% | 8.8% | 0.0% | 0.0% | 0.0% | 88.1% |
| M1094 | 0.46 | 7.08 | 2.76 | 0.92 | 3.04 | 0.0% | 8.8% | 0.0% | 0.0% | 0.0% | 88.1% |
| M1095 | 0.92 | 3.50 | 3.68 | 0.92 | 3.04 | 0.0% | 8.8% | 0.0% | 0.0% | 0.0% | 88.1% |
| M1096 | 0.92 | 3.77 | 3.86 | 0.92 | 3.04 | 0.0% | 8.8% | 0.0% | 0.0% | 0.0% | 88.1% |
| M1097 | 0.92 | 4.32 | 3.50 | 0.92 | 3.04 | 0.0% | 8.8% | 0.0% | 0.0% | 0.0% | 88.1% |
| M1098 | 0.92 | 4.32 | 3.68 | 0.92 | 3.04 | 0.0% | 8.8% | 0.0% | 0.0% | 0.0% | 88.1% |
| M1099 | 0.92 | 4.05 | 3.86 | 0.92 | 3.04 | 0.0% | 8.8% | 0.0% | 0.0% | 0.0% | 88.1% |
| M1100 | 0.92 | 4.05 | 2.94 | 0.92 | 3.04 | 0.0% | 8.8% | 0.0% | 0.0% | 0.0% | 88.1% |
| M1101 | 0.92 | 4.32 | 3.31 | 0.92 | 3.04 | 0.0% | 8.8% | 0.0% | 0.0% | 0.0% | 88.1% |
| M1102 | 0.92 | 4.60 | 3.86 | 0.92 | 3.04 | 0.0% | 8.8% | 0.0% | 0.0% | 0.0% | 88.1% |
| M1103 | 0.92 | 4.05 | 2.76 | 0.92 | 3.04 | 0.0% | 8.8% | 0.0% | 0.0% | 0.0% | 88.1% |

TABLE 8-continued

Alloy Compositions (in wt. %, Fe Balance) of alloys intended to form hard coatings.

| | Feedstock Chemistry | | | | | Coating Chemistry | | | | | |
|---|---|---|---|---|---|---|---|---|---|---|---|
| Alloy # | Al | B | C | Mn | Si | Al | B | C | Mn | Si | WSS |
| M1104 | 0.92 | 5.15 | 3.68 | 0.92 | 3.04 | 0.0% | 8.8% | 0.0% | 0.0% | 0.0% | 88.1% |
| M1105 | 0.92 | 5.15 | 3.50 | 0.92 | 3.04 | 0.0% | 8.8% | 0.0% | 0.0% | 0.0% | 88.1% |
| M1106 | 0.92 | 4.88 | 3.13 | 0.92 | 3.04 | 0.0% | 8.8% | 0.0% | 0.0% | 0.0% | 88.1% |
| M1107 | 0.92 | 4.88 | 2.94 | 0.92 | 3.04 | 0.0% | 8.8% | 0.0% | 0.0% | 0.0% | 88.1% |
| M1108 | 0.92 | 5.43 | 3.31 | 0.92 | 3.04 | 0.0% | 8.8% | 0.0% | 0.0% | 0.0% | 88.1% |
| M1109 | 0.92 | 5.15 | 3.13 | 0.92 | 3.04 | 0.0% | 8.8% | 0.0% | 0.0% | 0.0% | 88.1% |
| M1110 | 0.92 | 5.15 | 3.86 | 0.92 | 3.04 | 0.0% | 8.8% | 0.0% | 0.0% | 0.0% | 88.1% |
| M1111 | 0.92 | 5.15 | 2.94 | 0.92 | 3.04 | 0.0% | 8.8% | 0.0% | 0.0% | 0.0% | 88.1% |
| M1112 | 0.92 | 5.70 | 3.50 | 0.92 | 3.04 | 0.0% | 8.8% | 0.0% | 0.0% | 0.0% | 88.1% |
| M1113 | 0.92 | 4.88 | 2.76 | 0.92 | 3.04 | 0.0% | 8.8% | 0.0% | 0.0% | 0.0% | 88.1% |
| M1114 | 0.92 | 5.43 | 3.13 | 0.92 | 3.04 | 0.0% | 8.8% | 0.0% | 0.0% | 0.0% | 88.1% |
| M1115 | 0.92 | 5.98 | 3.31 | 0.92 | 3.04 | 0.0% | 8.8% | 0.0% | 0.0% | 0.0% | 88.1% |
| M1116 | 0.92 | 5.15 | 2.76 | 0.92 | 3.04 | 0.0% | 8.8% | 0.0% | 0.0% | 0.0% | 88.1% |
| M1117 | 0.92 | 5.98 | 3.50 | 0.92 | 3.04 | 0.0% | 8.8% | 0.0% | 0.0% | 0.0% | 88.1% |
| M1118 | 0.92 | 5.70 | 2.94 | 0.92 | 3.04 | 0.0% | 8.8% | 0.0% | 0.0% | 0.0% | 88.1% |
| M1119 | 0.92 | 6.26 | 3.31 | 0.92 | 3.04 | 0.0% | 8.8% | 0.0% | 0.0% | 0.0% | 88.1% |
| M1120 | 0.92 | 5.43 | 2.76 | 0.92 | 3.04 | 0.0% | 8.8% | 0.0% | 0.0% | 0.0% | 88.1% |
| M1121 | 0.92 | 5.98 | 3.13 | 0.92 | 3.04 | 0.0% | 8.8% | 0.0% | 0.0% | 0.0% | 88.1% |
| M1122 | 0.92 | 5.98 | 3.86 | 0.92 | 3.04 | 0.0% | 8.4% | 0.4% | 0.0% | 0.0% | 88.1% |
| M1123 | 0.92 | 6.53 | 3.50 | 0.92 | 3.04 | 0.0% | 9.2% | 0.0% | 0.0% | 0.0% | 91.9% |
| M1124 | 0.92 | 6.26 | 2.94 | 0.92 | 3.04 | 0.0% | 8.8% | 0.0% | 0.0% | 0.0% | 88.1% |
| M1125 | 0.92 | 6.26 | 2.58 | 0.92 | 3.04 | 0.0% | 8.8% | 0.0% | 0.0% | 0.0% | 88.1% |
| M1126 | 0.92 | 6.53 | 3.13 | 0.92 | 3.04 | 0.0% | 8.8% | 0.0% | 0.0% | 0.0% | 88.1% |
| M1127 | 0.92 | 7.08 | 3.31 | 0.92 | 3.04 | 0.0% | 10.1% | 0.0% | 0.0% | 0.0% | 100.7% |
| M1128 | 0.92 | 6.81 | 3.13 | 0.92 | 3.04 | 0.0% | 9.6% | 0.0% | 0.0% | 0.0% | 95.9% |
| M1129 | 0.92 | 6.53 | 3.86 | 0.92 | 3.04 | 0.0% | 9.2% | 0.0% | 0.0% | 0.0% | 92.5% |
| M1130 | 0.92 | 7.36 | 3.50 | 0.92 | 3.04 | 0.0% | 10.5% | 0.0% | 0.0% | 0.0% | 105.4% |
| M1131 | 0.92 | 7.36 | 2.21 | 0.92 | 3.04 | 0.0% | 8.8% | 0.0% | 0.0% | 0.0% | 88.0% |
| M1132 | 0.92 | 6.53 | 2.76 | 0.92 | 3.04 | 0.0% | 8.8% | 0.0% | 0.0% | 0.0% | 88.1% |
| M1133 | 0.92 | 7.36 | 1.84 | 0.92 | 3.04 | 0.0% | 10.3% | 0.0% | 0.0% | 0.0% | 102.7% |
| M1134 | 0.92 | 7.36 | 3.13 | 0.92 | 3.04 | 0.0% | 10.5% | 0.0% | 0.0% | 0.0% | 104.8% |
| M1135 | 0.92 | 6.81 | 2.76 | 0.92 | 3.04 | 0.0% | 8.8% | 0.0% | 0.0% | 0.0% | 88.1% |
| M1136 | 0.92 | 7.36 | 3.86 | 0.92 | 3.04 | 0.0% | 10.6% | 0.0% | 0.0% | 0.0% | 106.0% |
| M1137 | 1.38 | 3.77 | 3.68 | 0.92 | 3.04 | 0.0% | 8.8% | 0.0% | 0.0% | 0.0% | 88.1% |
| M1138 | 1.38 | 4.32 | 3.68 | 0.92 | 3.04 | 0.0% | 8.8% | 0.0% | 0.0% | 0.0% | 88.1% |
| M1139 | 1.38 | 4.60 | 3.68 | 0.92 | 3.04 | 0.0% | 8.8% | 0.0% | 0.0% | 0.0% | 88.1% |
| M1140 | 1.38 | 4.05 | 2.21 | 0.92 | 3.04 | 0.0% | 8.8% | 0.0% | 0.0% | 0.0% | 88.1% |
| M1141 | 1.38 | 4.32 | 2.39 | 0.92 | 3.04 | 0.0% | 8.8% | 0.0% | 0.0% | 0.0% | 88.1% |
| M1142 | 1.38 | 4.05 | 2.58 | 0.92 | 3.04 | 0.0% | 8.8% | 0.0% | 0.0% | 0.0% | 88.1% |
| M1143 | 1.38 | 5.15 | 3.68 | 0.92 | 3.04 | 0.0% | 8.8% | 0.0% | 0.0% | 0.0% | 88.1% |
| M1144 | 1.38 | 5.43 | 3.68 | 0.92 | 3.04 | 0.0% | 8.8% | 0.0% | 0.0% | 0.0% | 88.1% |
| M1145 | 1.38 | 4.60 | 2.58 | 0.92 | 3.04 | 0.0% | 8.8% | 0.0% | 0.0% | 0.0% | 88.1% |
| M1146 | 1.38 | 3.50 | 3.86 | 0.92 | 3.04 | 0.0% | 8.8% | 0.0% | 0.0% | 0.0% | 88.1% |
| M1147 | 1.38 | 4.88 | 2.58 | 0.92 | 3.04 | 0.0% | 8.8% | 0.0% | 0.0% | 0.0% | 88.1% |
| M1148 | 1.38 | 5.15 | 2.39 | 0.92 | 3.04 | 0.0% | 8.8% | 0.0% | 0.0% | 0.0% | 88.1% |
| M1149 | 1.38 | 5.15 | 3.31 | 0.92 | 3.04 | 0.0% | 8.8% | 0.0% | 0.0% | 0.0% | 88.1% |
| M1150 | 1.38 | 4.88 | 3.13 | 0.92 | 3.04 | 0.0% | 8.8% | 0.0% | 0.0% | 0.0% | 88.1% |
| M1151 | 1.38 | 5.15 | 2.58 | 0.92 | 3.04 | 0.0% | 8.8% | 0.0% | 0.0% | 0.0% | 88.1% |
| M1152 | 1.38 | 4.05 | 3.86 | 0.92 | 3.04 | 0.0% | 8.8% | 0.0% | 0.0% | 0.0% | 88.1% |
| M1153 | 1.38 | 4.32 | 2.94 | 0.92 | 3.04 | 0.0% | 8.8% | 0.0% | 0.0% | 0.0% | 88.1% |
| M1154 | 1.38 | 5.70 | 3.31 | 0.92 | 3.04 | 0.0% | 8.8% | 0.0% | 0.0% | 0.0% | 88.1% |
| M1155 | 1.38 | 5.70 | 2.21 | 0.92 | 3.04 | 0.0% | 8.8% | 0.0% | 0.0% | 0.0% | 88.1% |
| M1156 | 1.38 | 5.43 | 3.13 | 0.92 | 3.04 | 0.0% | 8.8% | 0.0% | 0.0% | 0.0% | 88.1% |
| M1157 | 1.38 | 5.43 | 3.50 | 0.92 | 3.04 | 0.0% | 8.8% | 0.0% | 0.0% | 0.0% | 88.1% |
| M1158 | 1.38 | 5.98 | 2.58 | 0.92 | 3.04 | 0.0% | 8.8% | 0.0% | 0.0% | 0.0% | 88.1% |
| M1159 | 1.38 | 5.98 | 2.21 | 0.92 | 3.04 | 0.0% | 8.8% | 0.0% | 0.0% | 0.0% | 88.1% |
| M1160 | 1.38 | 6.26 | 2.21 | 0.92 | 3.04 | 0.0% | 8.8% | 0.0% | 0.0% | 0.0% | 88.1% |
| M1161 | 1.38 | 6.53 | 2.58 | 0.92 | 3.04 | 0.0% | 8.8% | 0.0% | 0.0% | 0.0% | 88.1% |
| M1162 | 1.38 | 4.88 | 2.76 | 0.92 | 3.04 | 0.0% | 8.8% | 0.0% | 0.0% | 0.0% | 88.1% |
| M1163 | 1.38 | 6.53 | 2.39 | 0.92 | 3.04 | 0.0% | 8.8% | 0.0% | 0.0% | 0.0% | 88.1% |
| M1164 | 1.38 | 6.53 | 2.21 | 0.92 | 3.04 | 0.0% | 8.8% | 0.0% | 0.0% | 0.0% | 88.1% |
| M1165 | 1.38 | 6.81 | 2.21 | 0.92 | 3.04 | 0.0% | 8.8% | 0.0% | 0.0% | 0.0% | 88.1% |
| M1166 | 1.38 | 5.70 | 2.94 | 0.92 | 3.04 | 0.0% | 8.8% | 0.0% | 0.0% | 0.0% | 88.1% |
| M1167 | 1.38 | 7.08 | 2.39 | 0.92 | 3.04 | 0.0% | 8.8% | 0.0% | 0.0% | 0.0% | 88.1% |
| M1168 | 1.38 | 5.98 | 2.94 | 0.92 | 3.04 | 0.0% | 8.8% | 0.0% | 0.0% | 0.0% | 88.1% |
| M1169 | 1.38 | 6.26 | 2.94 | 0.92 | 3.04 | 0.0% | 8.8% | 0.0% | 0.0% | 0.0% | 88.1% |
| M1170 | 1.38 | 5.98 | 2.76 | 0.92 | 3.04 | 0.0% | 8.8% | 0.0% | 0.0% | 0.0% | 88.1% |
| M1171 | 1.38 | 6.53 | 2.76 | 0.92 | 3.04 | 0.0% | 8.8% | 0.0% | 0.0% | 0.0% | 88.1% |
| M1172 | 1.84 | 4.05 | 3.68 | 0.92 | 3.04 | 0.0% | 8.8% | 0.0% | 0.0% | 0.0% | 88.1% |
| M1173 | 1.84 | 3.50 | 3.31 | 0.92 | 3.04 | 0.0% | 8.8% | 0.0% | 0.0% | 0.0% | 88.1% |
| M1174 | 1.84 | 4.60 | 3.68 | 0.92 | 3.04 | 0.0% | 8.8% | 0.0% | 0.0% | 0.0% | 88.1% |
| M1175 | 1.84 | 3.77 | 3.50 | 0.92 | 3.04 | 0.0% | 8.8% | 0.0% | 0.0% | 0.0% | 88.1% |
| M1176 | 1.84 | 4.88 | 3.68 | 0.92 | 3.04 | 0.0% | 8.8% | 0.0% | 0.0% | 0.0% | 88.1% |
| M1177 | 1.84 | 4.05 | 2.02 | 0.92 | 3.04 | 0.0% | 8.8% | 0.0% | 0.0% | 0.0% | 88.1% |

TABLE 8-continued

Alloy Compositions (in wt. %, Fe Balance) of alloys intended to form hard coatings.

| | Feedstock Chemistry | | | | | Coating Chemistry | | | | | |
|---|---|---|---|---|---|---|---|---|---|---|---|
| Alloy # | Al | B | C | Mn | Si | Al | B | C | Mn | Si | WSS |
| M1178 | 1.84 | 4.32 | 2.02 | 0.92 | 3.04 | 0.0% | 8.8% | 0.0% | 0.0% | 0.0% | 88.1% |
| M1179 | 1.84 | 4.32 | 2.21 | 0.92 | 3.04 | 0.0% | 8.8% | 0.0% | 0.0% | 0.0% | 88.1% |
| M1180 | 1.84 | 3.22 | 3.86 | 0.92 | 3.04 | 0.0% | 8.8% | 0.0% | 0.0% | 0.0% | 88.1% |
| M1181 | 1.84 | 4.32 | 2.39 | 0.92 | 3.04 | 0.0% | 8.8% | 0.0% | 0.0% | 0.0% | 88.1% |
| M1182 | 1.84 | 4.60 | 3.50 | 0.92 | 3.04 | 0.0% | 8.8% | 0.0% | 0.0% | 0.0% | 88.1% |
| M1183 | 1.84 | 4.60 | 2.21 | 0.92 | 3.04 | 0.0% | 8.8% | 0.0% | 0.0% | 0.0% | 88.1% |
| M1184 | 1.84 | 5.15 | 2.58 | 0.92 | 3.04 | 0.0% | 8.8% | 0.0% | 0.0% | 0.0% | 88.1% |
| M1185 | 1.84 | 3.50 | 2.94 | 0.92 | 3.04 | 0.0% | 8.8% | 0.0% | 0.0% | 0.0% | 88.1% |
| M1186 | 1.84 | 4.32 | 3.13 | 0.92 | 3.04 | 0.0% | 8.8% | 0.0% | 0.0% | 0.0% | 88.1% |
| M1187 | 1.84 | 5.43 | 2.58 | 0.92 | 3.04 | 0.0% | 8.8% | 0.0% | 0.0% | 0.0% | 88.1% |
| M1188 | 1.84 | 4.88 | 2.21 | 0.92 | 3.04 | 0.0% | 8.8% | 0.0% | 0.0% | 0.0% | 88.1% |
| M1189 | 1.84 | 3.77 | 2.94 | 0.92 | 3.04 | 0.0% | 8.8% | 0.0% | 0.0% | 0.0% | 88.1% |
| M1190 | 1.84 | 5.15 | 2.02 | 0.92 | 3.04 | 0.0% | 8.8% | 0.0% | 0.0% | 0.0% | 88.1% |
| M1191 | 1.84 | 5.43 | 1.84 | 0.92 | 3.04 | 0.0% | 8.8% | 0.0% | 0.0% | 0.0% | 88.1% |
| M1192 | 1.84 | 5.70 | 1.84 | 0.92 | 3.04 | 0.0% | 8.8% | 0.0% | 0.0% | 0.0% | 88.1% |
| M1193 | 1.84 | 4.32 | 3.86 | 0.92 | 3.04 | 0.0% | 8.8% | 0.0% | 0.0% | 0.0% | 88.1% |
| M1194 | 1.84 | 5.98 | 1.84 | 0.92 | 3.04 | 0.0% | 8.8% | 0.0% | 0.0% | 0.0% | 88.1% |
| M1195 | 1.84 | 4.60 | 2.94 | 0.92 | 3.04 | 0.0% | 8.8% | 0.0% | 0.0% | 0.0% | 88.1% |
| M1196 | 1.84 | 6.26 | 2.58 | 0.92 | 3.04 | 0.0% | 8.8% | 0.0% | 0.0% | 0.0% | 88.1% |
| M1197 | 1.84 | 4.32 | 2.76 | 0.92 | 3.04 | 0.0% | 8.8% | 0.0% | 0.0% | 0.0% | 88.1% |
| M1198 | 1.84 | 5.98 | 2.21 | 0.92 | 3.04 | 0.0% | 8.8% | 0.0% | 0.0% | 0.0% | 88.1% |
| M1199 | 1.84 | 6.53 | 2.02 | 0.92 | 3.04 | 0.0% | 8.8% | 0.0% | 0.0% | 0.0% | 88.1% |
| M1200 | 1.84 | 6.26 | 2.39 | 0.92 | 3.04 | 0.0% | 8.8% | 0.0% | 0.0% | 0.0% | 88.1% |
| M1201 | 1.84 | 5.43 | 2.94 | 0.92 | 3.04 | 0.0% | 8.8% | 0.0% | 0.0% | 0.0% | 88.1% |
| M1202 | 1.84 | 6.53 | 2.21 | 0.92 | 3.04 | 0.0% | 8.8% | 0.0% | 0.0% | 0.0% | 88.1% |
| M1203 | 1.84 | 5.70 | 2.94 | 0.92 | 3.04 | 0.0% | 8.8% | 0.0% | 0.0% | 0.0% | 88.1% |
| M1204 | 1.84 | 6.81 | 2.21 | 0.92 | 3.04 | 0.0% | 8.8% | 0.0% | 0.0% | 0.0% | 88.1% |
| M1205 | 1.84 | 7.08 | 2.21 | 0.92 | 3.04 | 0.0% | 8.8% | 0.0% | 0.0% | 0.0% | 88.1% |
| M1206 | 1.84 | 6.26 | 2.76 | 0.92 | 3.04 | 0.0% | 8.8% | 0.0% | 0.0% | 0.0% | 88.1% |
| M1207 | 2.30 | 3.22 | 3.68 | 0.92 | 3.04 | 0.0% | 8.8% | 0.0% | 0.0% | 0.0% | 88.1% |
| M1208 | 2.30 | 3.50 | 3.68 | 0.92 | 3.04 | 0.0% | 8.8% | 0.0% | 0.0% | 0.0% | 88.1% |
| M1209 | 2.30 | 3.77 | 3.68 | 0.92 | 3.04 | 0.0% | 8.8% | 0.0% | 0.0% | 0.0% | 88.1% |
| M1210 | 2.30 | 4.05 | 3.68 | 0.92 | 3.04 | 0.0% | 8.8% | 0.0% | 0.0% | 0.0% | 88.1% |
| M1211 | 2.30 | 3.77 | 2.58 | 0.92 | 3.04 | 0.0% | 8.8% | 0.0% | 0.0% | 0.0% | 88.1% |
| M1212 | 2.30 | 4.32 | 3.68 | 0.92 | 3.04 | 0.0% | 8.8% | 0.0% | 0.0% | 0.0% | 88.1% |
| M1213 | 2.30 | 3.50 | 3.13 | 0.92 | 3.04 | 0.0% | 8.8% | 0.0% | 0.0% | 0.0% | 88.1% |
| M1214 | 2.30 | 4.60 | 3.31 | 0.92 | 3.04 | 0.0% | 8.8% | 0.0% | 0.0% | 0.0% | 88.1% |
| M1215 | 2.30 | 4.60 | 2.02 | 0.92 | 3.04 | 0.0% | 8.8% | 0.0% | 0.0% | 0.0% | 88.1% |
| M1216 | 2.30 | 3.50 | 2.94 | 0.92 | 3.04 | 0.0% | 8.8% | 0.0% | 0.0% | 0.0% | 88.1% |
| M1217 | 2.30 | 4.05 | 2.39 | 0.92 | 3.04 | 0.0% | 8.8% | 0.0% | 0.0% | 0.0% | 88.1% |
| M1218 | 2.30 | 2.94 | 3.86 | 0.92 | 3.04 | 0.0% | 8.8% | 0.0% | 0.0% | 0.0% | 88.1% |
| M1219 | 2.30 | 4.88 | 1.84 | 0.92 | 3.04 | 0.0% | 8.8% | 0.0% | 0.0% | 0.0% | 88.1% |
| M1220 | 2.30 | 3.50 | 2.76 | 0.92 | 3.04 | 0.0% | 8.8% | 0.0% | 0.0% | 0.0% | 88.1% |
| M1221 | 2.30 | 3.22 | 3.86 | 0.92 | 3.04 | 0.0% | 8.8% | 0.0% | 0.0% | 0.0% | 88.1% |
| M1222 | 2.30 | 5.15 | 1.84 | 0.92 | 3.04 | 0.0% | 8.8% | 0.0% | 0.0% | 0.0% | 88.1% |
| M1223 | 2.30 | 4.60 | 2.58 | 0.92 | 3.04 | 0.0% | 8.8% | 0.0% | 0.0% | 0.0% | 88.1% |
| M1224 | 2.30 | 4.88 | 2.58 | 0.92 | 3.04 | 0.0% | 8.8% | 0.0% | 0.0% | 0.0% | 88.1% |
| M1225 | 2.30 | 4.32 | 2.94 | 0.92 | 3.04 | 0.0% | 8.8% | 0.0% | 0.0% | 0.0% | 88.1% |
| M1226 | 2.30 | 3.77 | 3.86 | 0.92 | 3.04 | 0.0% | 8.8% | 0.0% | 0.0% | 0.0% | 88.1% |
| M1227 | 2.30 | 4.05 | 2.76 | 0.92 | 3.04 | 0.0% | 8.8% | 0.0% | 0.0% | 0.0% | 88.1% |
| M1228 | 2.30 | 4.88 | 2.39 | 0.92 | 3.04 | 0.0% | 8.8% | 0.0% | 0.0% | 0.0% | 88.1% |
| M1229 | 2.30 | 5.15 | 2.58 | 0.92 | 3.04 | 0.0% | 8.8% | 0.0% | 0.0% | 0.0% | 88.1% |
| M1230 | 2.30 | 4.60 | 2.21 | 0.92 | 3.04 | 0.0% | 8.8% | 0.0% | 0.0% | 0.0% | 88.1% |
| M1231 | 2.30 | 5.43 | 2.58 | 0.92 | 3.04 | 0.0% | 8.8% | 0.0% | 0.0% | 0.0% | 88.1% |
| M1232 | 2.30 | 5.98 | 1.84 | 0.92 | 3.04 | 0.0% | 8.8% | 0.0% | 0.0% | 0.0% | 88.1% |
| M1233 | 2.30 | 5.70 | 2.58 | 0.92 | 3.04 | 0.0% | 8.8% | 0.0% | 0.0% | 0.0% | 88.1% |
| M1234 | 2.30 | 4.60 | 2.76 | 0.92 | 3.04 | 0.0% | 8.8% | 0.0% | 0.0% | 0.0% | 88.1% |
| M1235 | 2.30 | 5.43 | 2.39 | 0.92 | 3.04 | 0.0% | 8.8% | 0.0% | 0.0% | 0.0% | 88.1% |
| M1236 | 2.30 | 5.43 | 2.21 | 0.92 | 3.04 | 0.0% | 8.8% | 0.0% | 0.0% | 0.0% | 88.1% |
| M1237 | 2.30 | 5.98 | 2.39 | 0.92 | 3.04 | 0.0% | 8.8% | 0.0% | 0.0% | 0.0% | 88.1% |
| M1238 | 2.30 | 5.70 | 2.76 | 0.92 | 3.04 | 0.0% | 8.8% | 0.0% | 0.0% | 0.0% | 88.1% |
| M1239 | 2.76 | 3.22 | 3.31 | 0.92 | 3.04 | 0.0% | 8.8% | 0.0% | 0.0% | 0.0% | 88.1% |
| M1240 | 2.76 | 3.22 | 3.68 | 0.92 | 3.04 | 0.0% | 8.8% | 0.0% | 0.0% | 0.0% | 88.1% |
| M1241 | 2.76 | 2.94 | 3.50 | 0.92 | 3.04 | 0.0% | 8.8% | 0.0% | 0.0% | 0.0% | 88.1% |
| M1242 | 2.76 | 2.94 | 3.13 | 0.92 | 3.04 | 0.0% | 8.8% | 0.0% | 0.0% | 0.0% | 88.1% |
| M1243 | 2.76 | 3.77 | 3.50 | 0.92 | 3.04 | 0.0% | 8.8% | 0.0% | 0.0% | 0.0% | 88.1% |
| M1244 | 2.76 | 4.05 | 1.84 | 0.92 | 3.04 | 0.0% | 8.8% | 0.0% | 0.0% | 0.0% | 88.1% |
| M1245 | 2.76 | 3.50 | 2.58 | 0.92 | 3.04 | 0.0% | 8.8% | 0.0% | 0.0% | 0.0% | 88.1% |
| M1246 | 2.76 | 3.50 | 2.39 | 0.92 | 3.04 | 0.0% | 8.8% | 0.0% | 0.0% | 0.0% | 88.1% |
| M1247 | 2.76 | 4.05 | 3.13 | 0.92 | 3.04 | 0.0% | 8.8% | 0.0% | 0.0% | 0.0% | 88.1% |
| M1248 | 2.76 | 4.32 | 3.50 | 0.92 | 3.04 | 0.0% | 8.8% | 0.0% | 0.0% | 0.0% | 88.1% |
| M1249 | 2.76 | 4.32 | 1.84 | 0.92 | 3.04 | 0.0% | 8.8% | 0.0% | 0.0% | 0.0% | 88.1% |
| M1250 | 2.76 | 4.05 | 2.39 | 0.92 | 3.04 | 0.0% | 8.8% | 0.0% | 0.0% | 0.0% | 88.1% |
| M1251 | 2.76 | 4.88 | 2.02 | 0.92 | 3.04 | 0.0% | 8.8% | 0.0% | 0.0% | 0.0% | 88.1% |

TABLE 8-continued

Alloy Compositions (in wt. %, Fe Balance) of alloys intended to form hard coatings.

| | Feedstock Chemistry | | | | | Coating Chemistry | | | | | |
|---|---|---|---|---|---|---|---|---|---|---|---|
| Alloy # | Al | B | C | Mn | Si | Al | B | C | Mn | Si | WSS |
| M1252 | 2.76 | 4.32 | 2.58 | 0.92 | 3.04 | 0.0% | 8.8% | 0.0% | 0.0% | 0.0% | 88.1% |
| M1253 | 2.76 | 3.77 | 2.94 | 0.92 | 3.04 | 0.0% | 8.8% | 0.0% | 0.0% | 0.0% | 88.1% |
| M1254 | 2.76 | 5.15 | 2.02 | 0.92 | 3.04 | 0.0% | 8.8% | 0.0% | 0.0% | 0.0% | 88.1% |
| M1255 | 2.76 | 5.43 | 2.02 | 0.92 | 3.04 | 0.0% | 8.8% | 0.0% | 0.0% | 0.0% | 88.1% |
| M1256 | 2.76 | 4.88 | 2.39 | 0.92 | 3.04 | 0.0% | 8.8% | 0.0% | 0.0% | 0.0% | 88.1% |
| M1257 | 2.76 | 4.32 | 2.94 | 0.92 | 3.04 | 0.0% | 8.8% | 0.0% | 0.0% | 0.0% | 88.1% |
| M1258 | 2.76 | 5.43 | 1.84 | 0.92 | 3.04 | 0.0% | 8.8% | 0.0% | 0.0% | 0.0% | 88.1% |
| M1259 | 2.76 | 5.15 | 2.58 | 0.92 | 3.04 | 0.0% | 8.8% | 0.0% | 0.0% | 0.0% | 88.1% |
| M1260 | 2.76 | 5.98 | 2.02 | 0.92 | 3.04 | 0.0% | 8.8% | 0.0% | 0.0% | 0.0% | 88.1% |
| M1261 | 2.76 | 4.60 | 2.21 | 0.92 | 3.04 | 0.0% | 8.8% | 0.0% | 0.0% | 0.0% | 88.1% |
| M1262 | 2.76 | 3.77 | 3.86 | 0.92 | 3.04 | 0.0% | 8.8% | 0.0% | 0.0% | 0.0% | 88.1% |
| M1263 | 2.76 | 5.98 | 1.84 | 0.92 | 3.04 | 0.0% | 8.8% | 0.0% | 0.0% | 0.0% | 88.1% |
| M1264 | 2.76 | 4.88 | 2.76 | 0.92 | 3.04 | 0.0% | 8.8% | 0.0% | 0.0% | 0.0% | 88.1% |
| M1265 | 2.76 | 6.26 | 1.84 | 0.92 | 3.04 | 0.0% | 8.8% | 0.0% | 0.0% | 0.0% | 88.1% |
| M1266 | 2.76 | 5.43 | 2.76 | 0.92 | 3.04 | 0.0% | 8.8% | 0.0% | 0.0% | 0.0% | 88.1% |
| M1267 | 0.00 | 2.94 | 5.34 | 0.92 | 3.04 | 0.0% | 8.8% | 0.0% | 0.0% | 0.0% | 88.1% |
| M1268 | 0.00 | 3.22 | 5.52 | 0.92 | 3.04 | 0.0% | 8.8% | 0.0% | 0.0% | 0.0% | 88.1% |
| M1269 | 0.00 | 3.50 | 5.52 | 0.92 | 3.04 | 0.0% | 8.8% | 0.0% | 0.0% | 0.0% | 88.1% |
| M1270 | 0.00 | 3.50 | 5.15 | 0.92 | 3.04 | 0.0% | 8.8% | 0.0% | 0.0% | 0.0% | 88.1% |
| M1271 | 0.00 | 4.05 | 5.52 | 0.92 | 3.04 | 0.0% | 8.8% | 0.0% | 0.0% | 0.0% | 88.1% |
| M1272 | 0.00 | 4.05 | 5.15 | 0.92 | 3.04 | 0.0% | 8.8% | 0.0% | 0.0% | 0.0% | 88.1% |
| M1273 | 0.00 | 2.39 | 6.99 | 0.92 | 3.04 | 0.0% | 3.4% | 5.4% | 0.0% | 0.0% | 88.7% |
| M1274 | 0.00 | 4.32 | 5.52 | 0.92 | 3.04 | 0.0% | 6.2% | 2.6% | 0.0% | 0.0% | 88.4% |
| M1275 | 0.00 | 2.94 | 6.81 | 0.92 | 3.04 | 0.0% | 4.2% | 4.6% | 0.0% | 0.0% | 88.6% |
| M1276 | 0.00 | 4.05 | 5.70 | 0.92 | 3.04 | 0.0% | 5.8% | 3.0% | 0.0% | 0.0% | 88.4% |
| M1277 | 0.00 | 4.60 | 5.52 | 0.92 | 3.04 | 0.0% | 6.6% | 2.2% | 0.0% | 0.0% | 88.4% |
| M1278 | 0.00 | 3.22 | 6.81 | 0.92 | 3.04 | 0.0% | 4.6% | 4.2% | 0.0% | 0.0% | 88.6% |
| M1279 | 0.00 | 4.05 | 5.89 | 0.92 | 3.04 | 0.0% | 5.8% | 3.0% | 0.0% | 0.0% | 88.4% |
| M1280 | 0.00 | 4.32 | 5.70 | 0.92 | 3.04 | 0.0% | 6.2% | 2.6% | 0.0% | 0.0% | 88.4% |
| M1281 | 0.00 | 3.77 | 6.26 | 0.92 | 3.04 | 0.0% | 5.4% | 3.4% | 0.0% | 0.0% | 88.5% |
| M1282 | 0.00 | 4.60 | 5.70 | 0.92 | 3.04 | 0.0% | 6.6% | 2.2% | 0.0% | 0.0% | 88.3% |
| M1283 | 0.00 | 4.32 | 5.89 | 0.92 | 3.04 | 0.0% | 6.2% | 2.6% | 0.0% | 0.0% | 88.4% |
| M1284 | 0.00 | 4.88 | 5.15 | 0.92 | 3.04 | 0.0% | 7.0% | 1.8% | 0.0% | 0.0% | 88.3% |
| M1285 | 0.00 | 3.77 | 6.44 | 0.92 | 3.04 | 0.0% | 5.4% | 3.4% | 0.0% | 0.0% | 88.5% |
| M1286 | 0.00 | 4.88 | 5.70 | 0.92 | 3.04 | 0.0% | 7.0% | 1.8% | 0.0% | 0.0% | 88.3% |
| M1287 | 0.00 | 4.05 | 6.07 | 0.92 | 3.04 | 0.0% | 5.8% | 3.0% | 0.0% | 0.0% | 88.4% |
| M1288 | 0.00 | 3.50 | 6.99 | 0.92 | 3.04 | 0.0% | 5.1% | 3.8% | 0.0% | 0.0% | 88.5% |
| M1289 | 0.00 | 5.43 | 5.52 | 0.92 | 3.04 | 0.0% | 7.9% | 1.0% | 0.0% | 0.0% | 88.2% |
| M1290 | 0.00 | 4.32 | 6.44 | 0.92 | 3.04 | 0.0% | 6.3% | 2.6% | 0.0% | 0.0% | 88.4% |
| M1291 | 0.00 | 4.88 | 5.89 | 0.92 | 3.04 | 0.0% | 7.1% | 1.8% | 0.0% | 0.0% | 88.3% |
| M1292 | 0.00 | 5.43 | 5.15 | 0.92 | 3.04 | 0.0% | 7.8% | 1.0% | 0.0% | 0.0% | 88.2% |
| M1293 | 0.00 | 2.94 | 7.18 | 0.92 | 3.04 | 0.0% | 4.3% | 4.6% | 0.0% | 0.0% | 88.6% |
| M1294 | 0.00 | 5.70 | 5.52 | 0.92 | 3.04 | 0.0% | 8.3% | 0.5% | 0.0% | 0.0% | 88.2% |
| M1295 | 0.00 | 4.32 | 6.62 | 0.92 | 3.04 | 0.0% | 6.3% | 2.5% | 0.0% | 0.0% | 88.4% |
| M1296 | 0.00 | 5.15 | 5.89 | 0.92 | 3.04 | 0.0% | 7.5% | 1.3% | 0.0% | 0.0% | 88.3% |
| M1297 | 0.00 | 4.60 | 6.81 | 0.92 | 3.04 | 0.0% | 6.7% | 2.1% | 0.0% | 0.0% | 88.3% |
| M1298 | 0.00 | 4.60 | 6.62 | 0.92 | 3.04 | 0.0% | 6.7% | 2.1% | 0.0% | 0.0% | 88.3% |
| M1299 | 0.00 | 4.88 | 6.07 | 0.92 | 3.04 | 0.0% | 7.1% | 1.7% | 0.0% | 0.0% | 88.3% |
| M1300 | 0.00 | 5.70 | 5.70 | 0.92 | 3.04 | 0.0% | 8.3% | 0.5% | 0.0% | 0.0% | 88.2% |
| M1301 | 0.00 | 3.50 | 7.18 | 0.92 | 3.04 | 0.0% | 5.1% | 3.8% | 0.0% | 0.0% | 88.5% |
| M1302 | 0.00 | 6.26 | 5.15 | 0.92 | 3.04 | 0.0% | 9.1% | 0.0% | 0.0% | 0.0% | 91.3% |
| M1303 | 0.00 | 5.15 | 6.07 | 0.92 | 3.04 | 0.0% | 7.5% | 1.3% | 0.0% | 0.0% | 88.2% |
| M1304 | 0.00 | 5.70 | 5.89 | 0.92 | 3.04 | 0.0% | 8.3% | 0.5% | 0.0% | 0.0% | 88.2% |
| M1305 | 0.00 | 4.05 | 7.18 | 0.92 | 3.04 | 0.0% | 5.9% | 2.9% | 0.0% | 0.0% | 88.4% |
| M1306 | 0.00 | 6.53 | 5.15 | 0.92 | 3.04 | 0.0% | 9.6% | 0.0% | 0.0% | 0.0% | 96.1% |
| M1307 | 0.00 | 6.53 | 5.52 | 0.92 | 3.04 | 0.0% | 9.7% | 0.0% | 0.0% | 0.0% | 96.7% |
| M1308 | 0.00 | 5.98 | 5.89 | 0.92 | 3.04 | 0.0% | 8.8% | 0.0% | 0.0% | 0.0% | 88.1% |
| M1309 | 0.00 | 6.26 | 5.70 | 0.92 | 3.04 | 0.0% | 9.2% | 0.0% | 0.0% | 0.0% | 92.2% |
| M1310 | 0.00 | 4.88 | 6.99 | 0.92 | 3.04 | 0.0% | 7.2% | 1.6% | 0.0% | 0.0% | 88.3% |
| M1311 | 0.00 | 5.70 | 6.07 | 0.92 | 3.04 | 0.0% | 8.4% | 0.5% | 0.0% | 0.0% | 88.2% |
| M1312 | 0.00 | 5.98 | 6.26 | 0.92 | 3.04 | 0.0% | 8.8% | 0.0% | 0.0% | 0.0% | 88.1% |
| M1313 | 0.00 | 6.53 | 5.70 | 0.92 | 3.04 | 0.0% | 9.7% | 0.0% | 0.0% | 0.0% | 97.0% |
| M1314 | 0.00 | 7.08 | 5.15 | 0.92 | 3.04 | 0.0% | 10.5% | 0.0% | 0.0% | 0.0% | 105.3% |
| M1315 | 0.00 | 7.08 | 5.34 | 0.92 | 3.04 | 0.0% | 10.6% | 0.0% | 0.0% | 0.0% | 105.6% |
| M1316 | 0.00 | 5.98 | 6.07 | 0.92 | 3.04 | 0.0% | 8.8% | 0.0% | 0.0% | 0.0% | 88.1% |
| M1317 | 0.00 | 5.70 | 6.44 | 0.92 | 3.04 | 0.0% | 8.4% | 0.4% | 0.0% | 0.0% | 88.1% |
| M1318 | 0.00 | 7.36 | 5.15 | 0.92 | 3.04 | 0.0% | 11.0% | 0.0% | 0.0% | 0.0% | 109.7% |
| M1319 | 0.00 | 6.53 | 6.26 | 0.92 | 3.04 | 0.0% | 9.8% | 0.0% | 0.0% | 0.0% | 97.9% |
| M1320 | 0.00 | 6.81 | 5.89 | 0.92 | 3.04 | 0.0% | 10.2% | 0.0% | 0.0% | 0.0% | 101.9% |
| M1321 | 0.00 | 5.98 | 6.44 | 0.92 | 3.04 | 0.0% | 8.8% | 0.0% | 0.0% | 0.0% | 88.4% |
| M1322 | 0.00 | 7.08 | 5.89 | 0.92 | 3.04 | 0.0% | 10.7% | 0.0% | 0.0% | 0.0% | 106.5% |
| M1323 | 0.00 | 6.81 | 6.81 | 0.92 | 3.04 | 0.0% | 10.3% | 0.0% | 0.0% | 0.0% | 103.5% |
| M1324 | 0.00 | 5.43 | 7.18 | 0.92 | 3.04 | 0.0% | 8.1% | 0.7% | 0.0% | 0.0% | 88.2% |
| M1325 | 0.00 | 7.36 | 5.89 | 0.92 | 3.04 | 0.0% | 11.1% | 0.0% | 0.0% | 0.0% | 111.0% |

TABLE 8-continued

Alloy Compositions (in wt. %, Fe Balance) of alloys intended to form hard coatings.

| | Feedstock Chemistry | | | | | Coating Chemistry | | | | | |
|---|---|---|---|---|---|---|---|---|---|---|---|
| Alloy # | Al | B | C | Mn | Si | Al | B | C | Mn | Si | WSS |
| M1326 | 0.00 | 7.08 | 6.81 | 0.92 | 3.04 | 0.0% | 10.8% | 0.0% | 0.0% | 0.0% | 108.1% |
| M1327 | 0.00 | 6.53 | 6.44 | 0.92 | 3.04 | 0.0% | 9.8% | 0.0% | 0.0% | 0.0% | 98.2% |
| M1328 | 0.00 | 6.53 | 6.99 | 0.92 | 3.04 | 0.0% | 9.9% | 0.0% | 0.0% | 0.0% | 99.1% |
| M1329 | 0.00 | 5.98 | 7.18 | 0.92 | 3.04 | 0.0% | 9.0% | 0.0% | 0.0% | 0.0% | 89.6% |
| M1330 | 0.00 | 7.08 | 6.62 | 0.92 | 3.04 | 0.0% | 10.8% | 0.0% | 0.0% | 0.0% | 107.8% |
| M1331 | 0.00 | 7.08 | 6.44 | 0.92 | 3.04 | 0.0% | 10.7% | 0.0% | 0.0% | 0.0% | 107.5% |
| M1332 | 0.00 | 7.36 | 6.62 | 0.92 | 3.04 | 0.0% | 11.2% | 0.0% | 0.0% | 0.0% | 112.2% |
| M1333 | 0.00 | 6.53 | 7.18 | 0.92 | 3.04 | 0.0% | 9.9% | 0.0% | 0.0% | 0.0% | 99.4% |
| M1334 | 0.00 | 6.81 | 7.18 | 0.92 | 3.04 | 0.0% | 10.4% | 0.0% | 0.0% | 0.0% | 104.1% |
| M1335 | 0.46 | 3.77 | 5.15 | 0.92 | 3.04 | 0.0% | 8.8% | 0.0% | 0.0% | 0.0% | 88.1% |
| M1336 | 0.46 | 3.50 | 5.52 | 0.92 | 3.04 | 0.0% | 8.8% | 0.0% | 0.0% | 0.0% | 88.1% |
| M1337 | 0.46 | 3.77 | 5.52 | 0.92 | 3.04 | 0.0% | 8.8% | 0.0% | 0.0% | 0.0% | 88.1% |
| M1338 | 0.46 | 5.98 | 5.34 | 0.92 | 3.04 | 0.0% | 8.6% | 0.2% | 0.0% | 0.0% | 88.1% |
| M1339 | 0.46 | 5.98 | 5.89 | 0.92 | 3.04 | 0.0% | 8.7% | 0.1% | 0.0% | 0.0% | 88.1% |

Performance Criteria:

In some embodiments, the alloys can be fully described by performance characteristics which they possess. In all arc spray applications, it can be advantageous for the coating to exhibit high adhesion and produce minimal hexavalent chromium fumes.

Coating adhesion is commonly measured via ASTM 4541 or ASTM C633 both which generate similar values and used interchangeably. ASTM 4541 and ASTM C633 are both hereby incorporated by reference in their entirety. In some embodiments, the alloy coating possesses 5,000 psi (or about 5,000 psi) or higher adhesion. In some embodiments, the alloy coating possesses 7,000 psi (or about 7,000 psi) or higher adhesion. In some embodiments, the alloy coating possesses 9,000 psi (or about 9,000 psi) or higher adhesion. This can be true for both the hard and soft alloys, making both of them applicable for coating applications.

The adhesion measurements conducted using ASTM 4541 standard are shown in the below Table 9.

TABLE 9

ASTM 4541 Adhesion Results

| Alloy | ASTM 4541 |
|---|---|
| X1 | 7,292 |
| X2 | 8,772 |
| X3 | 9,822 |
| X4 | 10,000+ |
| X5 | 9,876 |
| X7 | 6,250 |
| X8 | 6,000 |
| X9 | 10,000+ |

In some embodiments, it can be advantageous for the coating microhardness to be below a certain value which is a measure a machinability for soft alloys. As coating microhardness is decreased, the coating can be more easily machined. In some embodiments, the coating has a Vickers microhardness of 500 or below (or about 500 or below). In some embodiments, the coating has a Vickers microhardness of 450 or below (or about 450 or below). In some embodiments, the coating has a Vickers microhardness of 400 or below (or about 400 or below).

The Vickers microhardness of alloys with good machinability are shown in 10.

TABLE 10

Vickers microhardness of Alloys configured as soft coatings: X3, X4, X5, and X9

| Alloy | Vickers Hardness |
|---|---|
| X3 | 418 |
| X4 | 366 |
| X5 | 459 |
| X9 | 150 |

Figure 4:
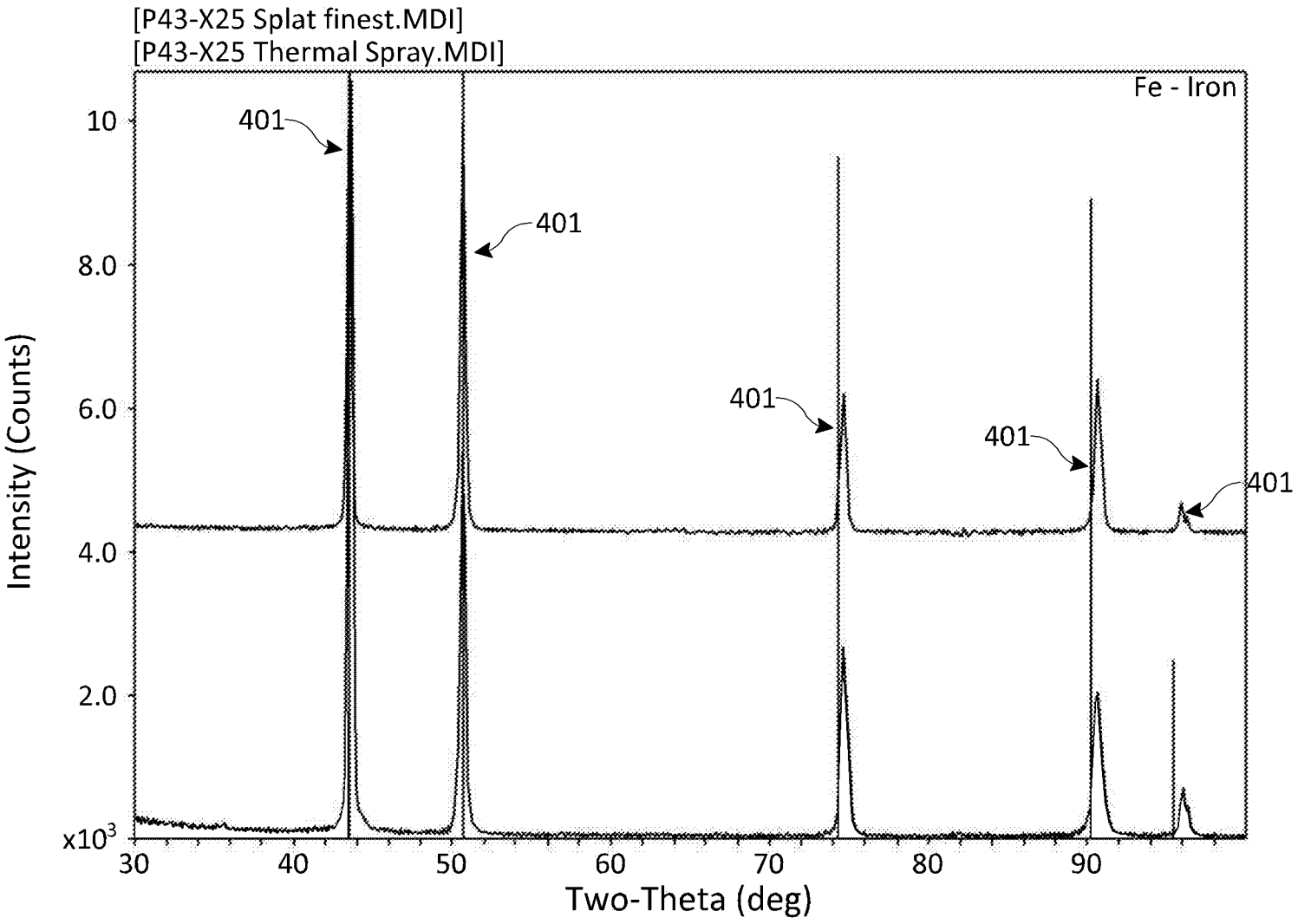
FIG. 4 shows an embodiment of an X-ray diffraction profile of Alloy X9.
Figure 5:
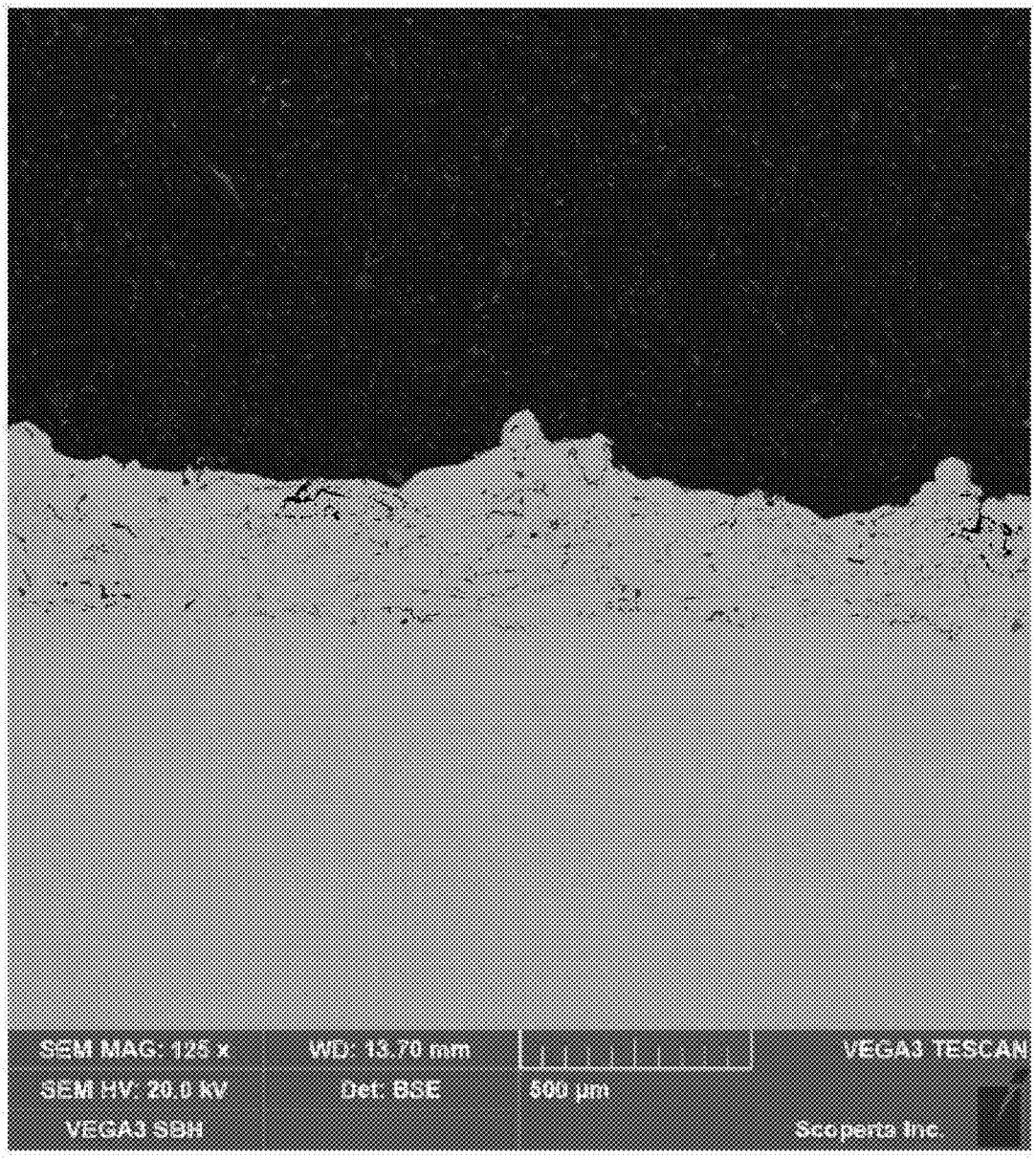
FIG. 5 shows a micrograph of an embodiment of a coating using Alloy X9.

Alloy X9 has the lowest hardness of the alloys discussed above. The low hardness of Alloy X9 can be due to the 100% austenitic nature of the coating structure. This has been verified with X-Ray diffraction on the sprayed coating. The X-Ray diffraction spectrum is shown in FIG. 4. As shown the only phase present in the coating is austenitic iron, which accounts for all 5 peaks [401]. An SEM micrograph of the coating is shown in FIG. 5.

On the other hand, in some embodiments it can be advantageous for the coating microhardness to be as high as possible to provide a hardfacing surface resistant to wear. As coating microhardness is decreased, the coating can be more easily machined.

In some embodiments, the coating has a Vickers microhardness of 800 or above (or about 800 or above). In some embodiments, the coating has a Vickers microhardness of 950 or above (or about 950 or above). In some embodiments, the coating has a Vickers microhardness of 1100 or above (or about 1100 or above).

Figure 6:
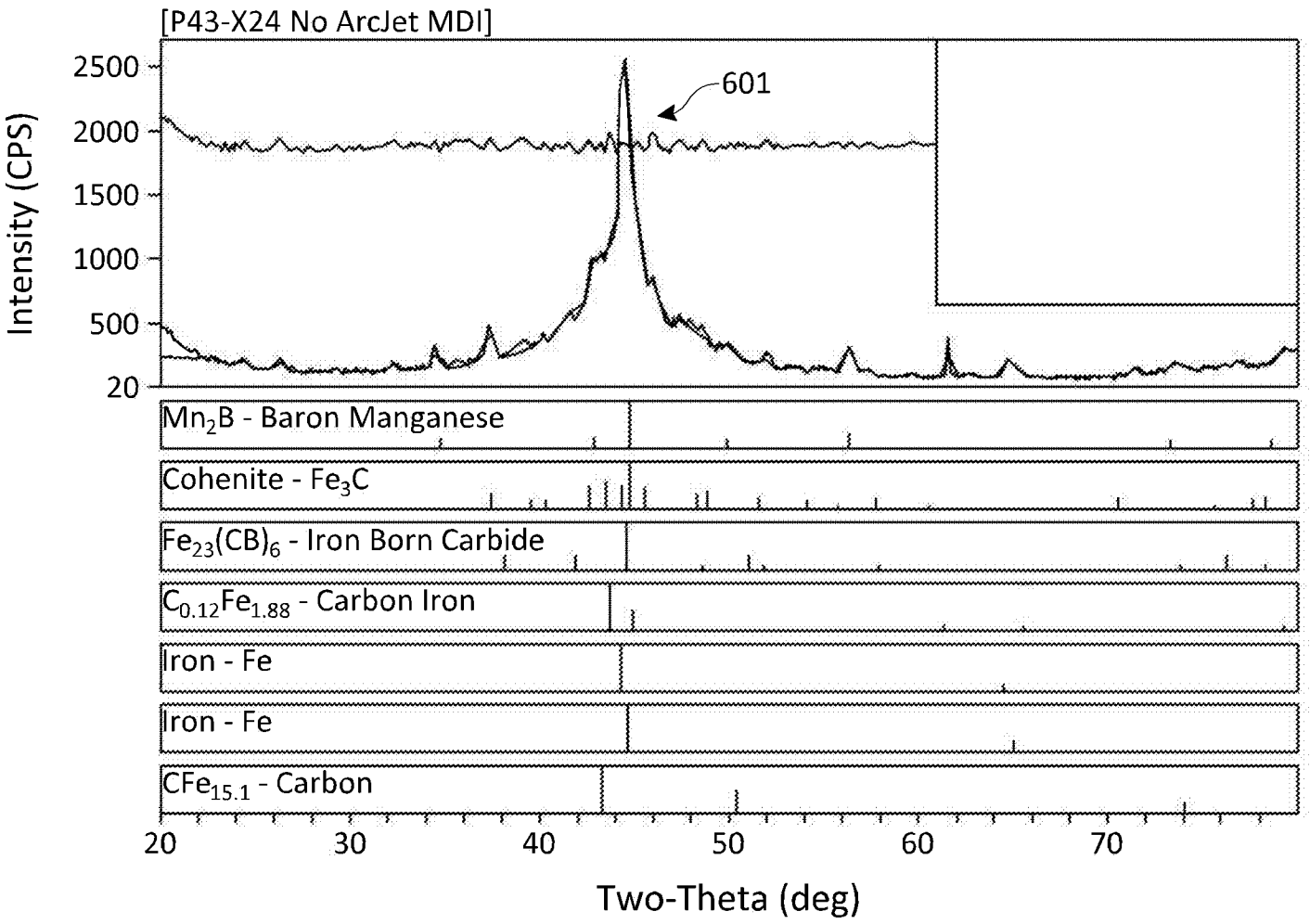
FIG. 6 shows an embodiment of an X-ray diffraction profile of Alloy X8.
Figure 7:
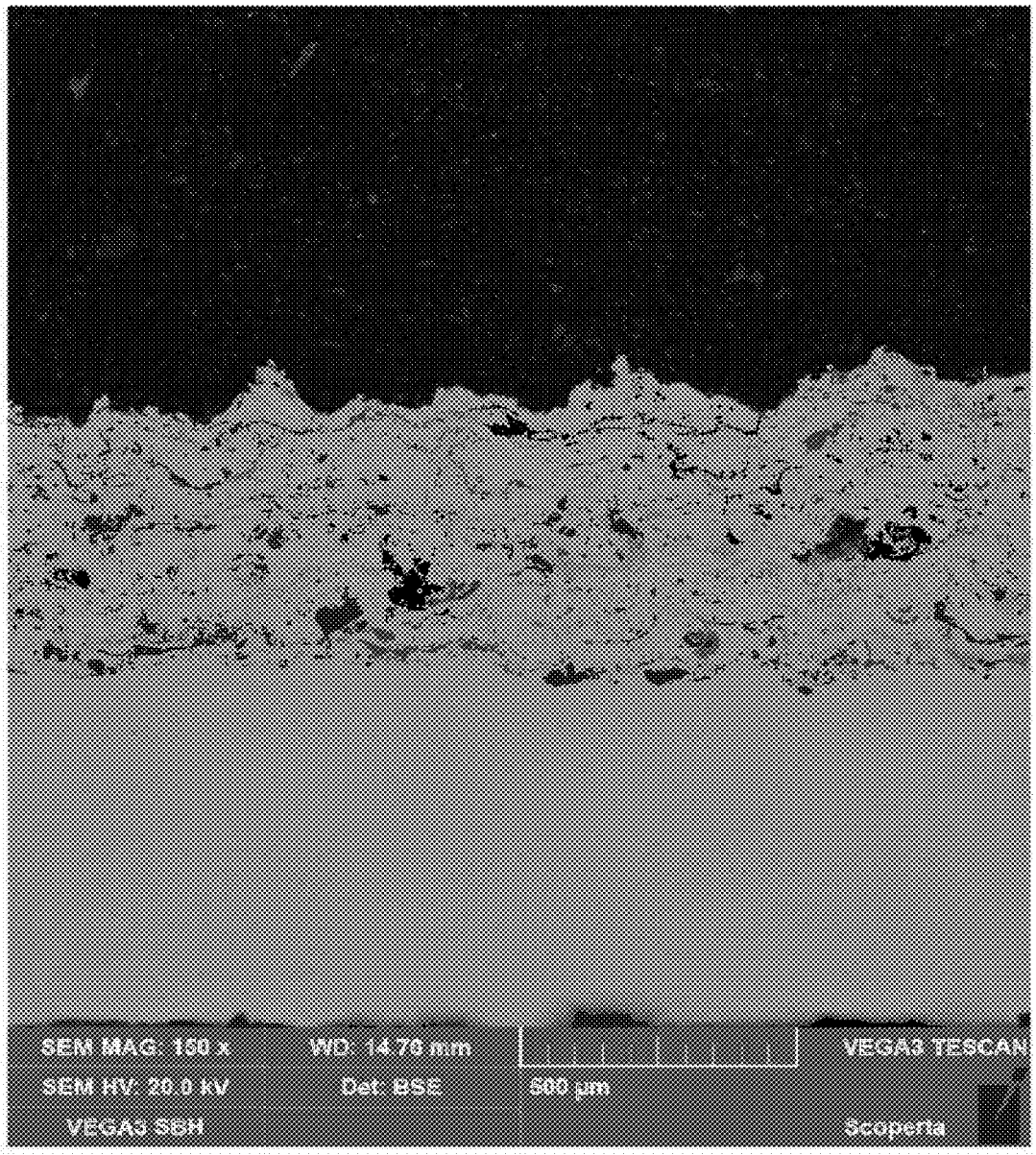
FIG. 7 shows a micrograph of an embodiment of a coating using Alloy X8.

The coatings presented in Table 11 below are very hard because they form very hard nanocrystalline/amorphous particles as opposed to a structure embedded with a high fraction of hard carbides or borides. Alloy X8 is an exemplary embodiment of this disclosure and the structure of the sprayed coating was evaluated with X-Ray Diffraction techniques. The X-Ray Diffraction Diagram for Alloy X8 is shown in FIG. 6. The diagram shows that Fe [601] to be the dominant phase, and the broad nature of the peak suggests that the Fe phase is amorphous or nanocrystalline. A micrograph of an X8 coating is shown in FIG. 7.

TABLE 11

Vickers microhardness of Alloys configured as hard coatings: X1, X2, X7, and X8

| Alloy | Vickers Hardness |
|---|---|
| X1 | 497 |
| X2 | 354 |
| X7 | 1,206 |
| X8 | 1,225 |

The relationships between thermodynamic properties, microstructural properties, and performance characteristics were previously unknown and determined in this study via extensive experimentation. The exemplary embodiments of this invention, X8 in the case of a hard arc spray coating, and X9 in the case of a soft arc spray coating were developed after manufacturing, spraying, and evaluating many thermal spray wires and comparing the wire microstructure and performance to thermodynamic behavior of the alloys.

Methods of Application

In some embodiments, two different alloys can be sprayed simultaneously in a twin wire arc spray process to achieve a coating which is configured for a higher finish than one alloy alone. The twin wire arc spray process can utilize two wires which are melted via an electric arc from one wire to another and sprayed onto a substrate via a pressurized gas stream. When two wires are sprayed simultaneously, the resultant coating can be comprised primarily of particles of alloy 1 and particles of alloy 2. In other words, there can be very little chemical mixing between the two wires during this process. Spraying a soft wire in combination with a hard wire can produce coatings with a high finish. High finish is generally equivalent to low surface roughness. A low surface roughness is advantageous for some applications, such as the repair of hydraulic cylinders. In this application it can be advantageous for the surface to be smooth (e.g. have a high finish/low roughness) in order for the cylinder to seal with an O-ring.

In some embodiments, two of the same alloys can be sprayed simultaneously in a twin wire arc spray process. The twin wire arc spray process can utilize two wires which are melted via an electric arc from one wire to another and sprayed onto a substrate via a pressurized gas stream. In some embodiments, only a single wire is used for the twin wire arc spray. In some embodiments, the sheaths for the two sprays can be different materials, but the powder configuration can allow for the same total elements to be sprayed from each of the wires. Thus, a single final coating composition can be formed from the thermal spray process.

In some embodiments, two metal cored wires of different alloys can be used to spray the coating. In some embodiments, one metal cored wire produces particles of 300 Vickers microhardness or below (or about 300 Vickers microhardness or below). In some embodiments, one metal cored wire produces particles of 1,000 Vickers microhardness or higher (or about 1,000 Vickers microhardness or higher).

In some embodiments, the coating produced by spraying the two different metal cored wires can produce a coating comprising both hard particles, >1,000 Vickers microhardness, as well as soft particles, <300 Vickers microhardness. The coating can be finished to 3 microns Ra or lower. In some embodiments, this coating can be finished to 2 microns Ra or better. In some embodiments, this coating can be finished to 1 micron Ra or better. The finishing step can involve grinding and polishing the roughness of the thermal spray coating with increasingly lower grit grind media (such as AlO used in sandpaper) until the coating reaches a specific surface roughness.

In some embodiments, the following alloys can be used as the metal cored wire which produces particles of high hardness, though it will be understood that other alloys disclosed herein can be used as well. The below alloys include Fe and, in wt. %:

- Al 2, B 4, Cr 13, Nb 6 (or Al about 2, B about 4, Cr about 13, Nb about 6)
- Al 2.5, C 5, Mn 1, Si 8 (or Al about 2.5, C about 5, Mn about 1, Si about 8)
- Al 1.5, C 5, Mn 1, Si 3.25 (or Al about 1.5, C about 5, Mn about 1, Si about 3.25)
- Al 1.5, B 4, C, 4, Mn 1, Ni, 1, Si 3.25 (or Al about 1.5, B about 4, C about 4, Mn about 1, Ni about 1, Si about 3.25)
- B 1.85, C 2.15, Mo 15.7, V 11 (or B about 1.85, C about 2.15, Mo about 15.7, V about 11)
- Al 1.5, B 5, C 4, Mn 1, Si 3.3 (or Al about 1.5, B about 5, C about 4, Mn about 1, Si about 3.3)

In some embodiments, the following alloys can be used as the metal cored wire which produces particles of low hardness, though other alloys can be used as well. The below alloys comprise Fe and, in wt. %:

- Al 1.5, C 1, Mn 1, Si 3.25 (or Al about 1.5, C about 1, Mn about 1, Si about 3.25)
- Al 1.5, C 1.5, Mn 1, Ni 12 (or Al about 1.5, C about 1.5, Mn about 1, Ni about 12)
- Al 1.5, Cr 11.27, Mn 1.03, Ni 20, Si 3.3 (or Al about 1.5, Cr about 11.27, Mn about 1.03, Ni about 20, Si about 3.3)

In some embodiments, Alloy X9 can be used in combination with alloy capable of producing 1,000 Vickers microhardness hard particles in the twin wire arc spray process.

In some embodiments, one Cr-free wire can be sprayed together with a $2^{nd}$ wire alloy, whereby the $2^{nd}$ wire alloy is more reactive on the galvanic series than the Cr-free wire. In such embodiments, both wires can be in the form of metal cored wires or solid wires. Such a technique can be used to spray a surface without the use of Cr, and doesn't result in the formation of rust when in contact with water. The particles of the $2^{nd}$ alloy acts to galvanically protect the particles of the Cr-free alloy.

In some embodiments, the Cr-free alloy can be the following, Fe and in wt. %:

- Al 1.5, C 1, Mn 1, Si 3.25 (or Al about 1.5, C about 1, Mn about 1, Si about 3.25)
- Al 1.5, C 1.5, Mn 1, Ni 12 (or Al about 1.5, C about 1.5, Mn about 1, Ni about 12)
- Al 1.5, Cr 0, Mn 1.03, Ni 20, Si 3.3 (or Al about 1.5, Cr about 0, Mn about 1.03, Ni about 20, Si about 3.3)
- Al 1.5, Cr 0, Mn 1.03, Ni 18, Si 3.3 (or Al about 1.5, Cr about 0, Mn about 1.03, Ni about 18, Si about 3.3)
- Al 1.5, Cr 0, Mn 1.03, Ni 15, Si 3.3 (or Al about 1.5, Cr about 0, Mn about 1.03, Ni about 15, Si about 3.3)
- Al 1.5, Cr 0, Mn 1.03, Ni 12, Si 3.3 (or Al about 1.5, Cr about 0, Mn about 1.03, Ni about 12, Si about 3.3)
- Al 1.5, Cr 0, Mn 1.03, Ni 10, Si 3.3 (or Al about 1.5, Cr about 0, Mn about 1.03, Ni about 10, Si about 3.3)

In some embodiments, the galvanically reactive alloy can be aluminum, zinc, or an aluminum or zinc containing alloy.

Applications and Processes for Use:

Embodiments of the alloys described in this patent can be used in a variety of applications and industries. Some non-limiting examples of applications of use include:

Surface Mining applications include the following components and coatings for the following components: Wear resistant sleeves and/or wear resistant hardfacing for slurry pipelines, mud pump components including pump housing or impeller or hardfacing for mud pump components, ore feed chute components including chute blocks or hardfacing of chute blocks, separation screens including but not limited to rotary breaker screens, banana screens, and shaker screens, liners for autogenous grinding mills and semi-autogenous grinding mills, ground engaging tools and hardfacing for ground engaging tools, drill bits and drill bit inserts, wear plate for buckets and dumptruck liners, heel blocks and hardfacing for heel blocks on mining shovels, grader blades and hardfacing for grader blades, stacker reclaimers, sizer crushers, general wear packages for mining components and other comminution components.

Upstream oil and gas applications include the following components and coatings for the following components: Downhole casing and downhole casing, drill pipe and coatings for drill pipe including hardbanding, mud management components, mud motors, fracking pump sleeves, fracking impellers, fracking blender pumps, stop collars, drill bits and drill bit components, directional drilling equipment and coatings for directional drilling equipment including stabilizers and centralizers, blow out preventers and coatings for blow out preventers and blow out preventer components including the shear rams, oil country tubular goods and coatings for oil country tubular goods.

Downstream oil and gas applications include the following components and coatings for the following components: Process vessels and coating for process vessels including steam generation equipment, amine vessels, distillation towers, cyclones, catalytic crackers, general refinery piping, corrosion under insulation protection, sulfur recovery units, convection hoods, sour stripper lines, scrubbers, hydrocarbon drums, and other refinery equipment and vessels.

Pulp and paper applications include the following components and coatings for the following components: Rolls used in paper machines including yankee dryers and other dryers, calendar rolls, machine rolls, press rolls, digesters, pulp mixers, pulpers, pumps, boilers, shredders, tissue machines, roll and bale handling machines, doctor blades, evaporators, pulp mills, head boxes, wire parts, press parts, M.G. cylinders, pope reels, winders, vacuum pumps, deflakers, and other pulp and paper equipment, Power generation applications include the following components and coatings for the following components: boiler tubes, precipitators, fireboxes, turbines, generators, cooling towers, condensers, chutes and troughs, augers, bag houses, ducts, ID fans, coal piping, and other power generation components.

Agriculture applications include the following components and coatings for the following components: chutes, base cutter blades, troughs, primary fan blades, secondary fan blades, augers and other agricultural applications.

Construction applications include the following components and coatings for the following components: cement chutes, cement piping, bag houses, mixing equipment and other construction applications Machine element applications include the following components and coatings for the following components: Shaft journals, paper rolls, gear boxes, drive rollers, cylinder blocks, hydraulic cylinders, impellers, general reclamation and dimensional restoration applications and other machine element applications Steel applications include the following components and coatings for the following components: cold rolling mills, hot rolling mills, wire rod mills, galvanizing lines, continue pickling lines, continuous casting rolls and other steel mill rolls, and other steel applications.

The alloys described in this patent can be produced and or deposited in a variety of techniques effectively. Some non-limiting examples of processes include:

Thermal spray process including those using a wire feedstock such as twin wire arc, spray, high velocity arc spray, combustion spray and those using a powder feedstock such as high velocity oxygen fuel, high velocity air spray, plasma spray, detonation gun spray, and cold spray. Wire feedstock can be in the form of a metal core wire, solid wire, or flux core wire. Powder feedstock can be either a single homogenous alloy or a combination of multiple alloy powder which result in the desired chemistry when melted together.

Welding processes including those using a wire feedstock including but not limited to metal inert gas (MIG) welding, tungsten inert gas (TIG) welding, arc welding, submerged arc welding, open arc welding, bulk welding, laser cladding, and those using a powder feedstock including but not limited to laser cladding and plasma transferred arc welding. Wire feedstock can be in the form of a metal core wire, solid wire, or flux core wire. Powder feedstock can be either a single homogenous alloy or a combination of multiple alloy powder which result in the desired chemistry when melted together.

Casting processes including processes typical to producing cast iron including but not limited to sand casting, permanent mold casting, chill casting, investment casting, lost foam casting, die casting, centrifugal casting, glass casting, slip casting and process typical to producing wrought steel products including continuous casting processes.

Post processing techniques including but not limited to rolling, forging, surface treatments such as carburizing, nitriding, carbonitriding, heat treatments including but not limited to austenitizing, normalizing, annealing, stress relieving, tempering, aging, quenching, cryogenic treatments, flame hardening, induction hardening, differential hardening, case hardening, decarburization, machining, grinding, cold working, work hardening, and welding.

From the foregoing description, it will be appreciated that an inventive thermal spray product and methods of use are disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. An iron-based cored wire alloy feedstock configured for twin wire arc thermal spray applications, the cored wire alloy feedstock comprising:

a powder and a sheath, wherein the powder and sheath combination have a composition comprising Fe and, in wt. %:

$0<Al\leq 2.5$;

Cr: about 10-15;

$0<Mn\leq 2$;

Ni: about 15-25; and

Si: about 2.97-5.

2. The cored wire alloy feedstock of claim 1, wherein the cored wire alloy feedstock is configured to form the coating after oxidation in a twin wire arc thermal spray application.

3. The cored wire alloy feedstock of claim 1, wherein the sheath has a diameter of 1/16" and a ratio of the powder to the sheath is about 20-40% by weight.

4. The cored wire alloy feedstock of claim 1, wherein the microhardness of the coating is 200 Vickers or below.

5. The cored wire alloy feedstock of claim 1, wherein the microhardness of the coating is 100 Vickers or below.

6. The cored wire alloy feedstock of claim 1, wherein the weighted solute fraction is less than 6 wt. % at a melting temperature of the cored wire alloy feedstock.

7. The cored wire alloy feedstock of claim 1, wherein the weighted solute fraction of the coating is less than 2 wt. % at a melting temperature of the cored wire alloy feedstock.

8. The cored wire alloy feedstock of claim 1, wherein the composition comprises Fe and, in wt. %:

Al: about 1.5;

Cr: about 11.27;

Mn: about 1.03;

Ni: about 20; and

Si: about 3.3.

9. The cored wire alloy feedstock of claim 1, wherein the composition comprises Fe and, in wt. %:

Al about 1.5, C about 1, Mn about 1, Si about 3.25; or

Al about 1.5, Cr about 11.27, Mn about 1.03, Ni about 20, and Si about 3.3.

10. The cored wire alloy feedstock of claim 1, wherein the austenite ferrite transition temperature is below about 950K.

11. A twin wire arc spray process using the cored wire alloy feedstock of claim 1 as a cored wire alloy feedstock.

12. An iron-based cored wire alloy feedstock configured for twin wire arc thermal spray applications, the cored wire alloy feedstock comprising:

a powder and a sheath, wherein the powder and sheath combination have a composition comprising at least 50 wt. % Fe and, in wt. %:

Al: 1.35-1.65;

Cr: 10-12.397;

Ni: 18-22; and

Si: about 2.97-3.63.

13. The iron-based cored wire alloy feedstock of claim 12, wherein the sheath has a diameter of 1/16" and a ratio of the powder to the sheath is about 20-40% by weight.

14. The iron-based cored wire alloy feedstock of claim 12, wherein the composition comprises Fe and, in wt. %

Mn: 0.927-1.133.

15. The iron-based cored wire alloy feedstock of claim 12, wherein the composition comprises Fe and, in wt. %:

Al about 1.5, C about 1, Mn about 1, Si about 3.25; or

Al about 1.5, Cr about 11.27, Mn about 1.03, Ni about 20, and Si about 3.3.

* * * * *